US011186959B2

(12) United States Patent
Coe

(10) Patent No.: US 11,186,959 B2
(45) Date of Patent: Nov. 30, 2021

(54) APPARATUS AND METHOD FOR PREPARING ASPHALT AND AGGREGATE MIXTURE

(71) Applicant: William B. Coe, Wrightwood, CA (US)

(72) Inventor: William B. Coe, Wrightwood, CA (US)

( * ) Notice: Subject to any disclaimer, the term of this patent is extended or adjusted under 35 U.S.C. 154(b) by 0 days.

(21) Appl. No.: 17/008,297

(22) Filed: Aug. 31, 2020

(65) Prior Publication Data

US 2020/0399840 A1 Dec. 24, 2020

Related U.S. Application Data

(63) Continuation of application No. 16/435,132, filed on Jun. 7, 2019, now Pat. No. 10,794,017, which is a continuation of application No. PCT/US2018/018068, filed on Feb. 13, 2018.

(60) Provisional application No. 62/569,330, filed on Oct. 6, 2017, provisional application No. 62/470,824, filed on Mar. 13, 2017, provisional application No. 62/468,892, filed on Mar. 8, 2017, provisional application No. 62/464,317, filed on Feb. 27, 2017, provisional application No. 62/462,819, filed on Feb. 23, 2017, provisional application No. 62/458,982, filed on Feb. 14, 2017.

(51) Int. Cl.

| | |
|---|---|
| ***E01C 23/00*** | (2006.01) |
| ***E01C 23/06*** | (2006.01) |
| ***E01C 19/00*** | (2006.01) |
| ***E01C 23/14*** | (2006.01) |
| *E01C 11/00* | (2006.01) |

(52) U.S. Cl.
CPC ..... *E01C 23/065* (2013.01); *E01C 19/002* (2013.01); *E01C 23/14* (2013.01); *E01C 11/005* (2013.01)

(58) Field of Classification Search
CPC .... E01C 11/005; E01C 19/002; E01C 23/065; E01C 23/14
USPC ..... 404/75, 77, 79, 91, 95
See application file for complete search history.

(56) References Cited

U.S. PATENT DOCUMENTS

| | | | |
|---|---|---|---|
| 2,704,967 | A | 3/1955 | Rostler |
| 3,066,582 | A | 12/1962 | Cutler |
| 3,262,375 | A | 7/1966 | Eigenmann |
| 3,513,005 | A | 5/1970 | Bradshaw et al. |
| 3,801,212 | A | 4/1974 | Cutler |
| 3,807,886 | A | 4/1974 | Cutler |
| 3,964,183 | A | 6/1976 | Mouat |
| 4,021,393 | A | 5/1977 | McDonald |

(Continued)

FOREIGN PATENT DOCUMENTS

| | | |
|---|---|---|
| CN | 101058970 | 10/2007 |
| DE | 3631121 | 4/1987 |

(Continued)

*Primary Examiner* — Raymond W Addie
(74) *Attorney, Agent, or Firm* — Knobbe, Martens, Olson & Bear, LLP

(57) ABSTRACT

An asphalt and aggregate mixture and methods for preparing and using same are provided which utilize solid phase auto regenerative cohesion and homogenization by liquid asphalt oligopolymerization technologies. The mixtures are suitable for use in installing asphalt/concrete pavement, repairing asphalt/concrete pavement, and providing overlays to existing asphalt/concrete pavement. The slurries can contain recycled asphalt/concrete pavement subject to treatment.

17 Claims, 23 Drawing Sheets

(56) References Cited

U.S. PATENT DOCUMENTS

| | | | | |
|---|---|---|---|---|
| 4,085,078 | A | 4/1978 | McDonald | |
| 4,113,401 | A | 9/1978 | McDonald | |
| 4,261,669 | A | 4/1981 | Edo | |
| 4,319,856 | A * | 3/1982 | Jeppson | E01C 23/14 219/699 |
| 4,347,016 | A * | 8/1982 | Sindelar | E01C 23/065 126/271.2 A |
| 4,358,554 | A | 11/1982 | Yan et al. | |
| 4,594,022 | A | 6/1986 | Jeppson | |
| 4,601,605 | A | 7/1986 | Damp | |
| 4,749,303 | A | 6/1988 | Keizer et al. | |
| 4,765,772 | A | 8/1988 | Benedetti et al. | |
| 4,849,020 | A | 7/1989 | Osborne et al. | |
| 4,854,771 | A | 8/1989 | Corbin, Jr. et al. | |
| 4,863,309 | A | 9/1989 | Corbin, Jr. et al. | |
| 4,969,772 | A | 11/1990 | Chiba et al. | |
| 4,994,508 | A | 2/1991 | Shiraki et al. | |
| 5,092,706 | A | 3/1992 | Bowen et al. | |
| 5,099,900 | A | 3/1992 | Gomberg | |
| 5,110,629 | A | 5/1992 | Gomberg | |
| 5,114,284 | A | 5/1992 | Keizer et al. | |
| 5,242,493 | A | 9/1993 | Glynn, Jr. et al. | |
| 5,248,407 | A | 9/1993 | Bardet et al. | |
| 5,251,999 | A | 10/1993 | McCracken | |
| 5,344,485 | A | 9/1994 | Glynn, Jr. | |
| 5,385,426 | A | 1/1995 | Omann | |
| 5,397,199 | A | 3/1995 | Frampton et al. | |
| 5,397,389 | A | 3/1995 | Glynn, Jr. | |
| 5,445,473 | A | 8/1995 | Chaverot et al. | |
| 5,556,225 | A | 9/1996 | Marino | |
| 5,599,133 | A | 2/1997 | Costello et al. | |
| 5,599,134 | A | 2/1997 | Macku | |
| 5,911,817 | A | 6/1999 | Hayner | |
| 5,925,695 | A | 7/1999 | Ohtsuka et al. | |
| 6,012,870 | A | 1/2000 | Dillingham | |
| 6,217,252 | B1 | 4/2001 | Tolliver et al. | |
| 6,346,561 | B1 | 2/2002 | Osborn | |
| 6,414,056 | B1 | 7/2002 | Puzic et al. | |
| 6,439,806 | B1 | 8/2002 | Dillingham | |
| 6,461,128 | B1 * | 10/2002 | Wood | E21B 43/129 418/153 |
| 6,492,439 | B2 | 12/2002 | Wollum et al. | |
| 6,554,531 | B2 | 4/2003 | Bodish | |
| 6,669,467 | B2 | 12/2003 | Kieswetter | |
| 6,759,453 | B2 | 7/2004 | Jelling et al. | |
| 6,805,738 | B2 | 10/2004 | Tasaki | |
| 6,872,072 | B2 | 3/2005 | Kieswetter | |
| 7,220,455 | B2 | 5/2007 | Bennett | |
| 7,316,521 | B2 | 1/2008 | Shiomoto et al. | |
| 7,402,619 | B2 | 7/2008 | Stephens | |
| 7,458,746 | B1 | 12/2008 | Zimmerman | |
| 7,517,934 | B2 | 4/2009 | Deeter et al. | |
| 7,534,068 | B2 | 5/2009 | Brouillette et al. | |
| 7,569,625 | B2 | 8/2009 | Keller | |
| 7,696,267 | B2 | 4/2010 | Sasagawa et al. | |
| 7,985,787 | B2 | 7/2011 | Martin | |
| 8,119,202 | B2 | 2/2012 | Wiley | |
| 8,138,242 | B2 | 3/2012 | Reinke et al. | |
| 8,808,445 | B2 | 8/2014 | Coe | |
| 8,926,742 | B2 | 1/2015 | Coe | |
| 8,962,730 | B2 | 2/2015 | Mruk | |
| 8,992,118 | B2 | 3/2015 | Coe | |
| 9,057,163 | B1 | 6/2015 | Coe | |
| 9,074,328 | B1 | 7/2015 | Coe | |
| 9,127,413 | B2 | 9/2015 | Coe | |
| 9,169,606 | B2 | 10/2015 | Coe | |
| 9,346,931 | B2 | 5/2016 | Odriozola | |
| 9,347,187 | B2 | 5/2016 | Coe | |
| 9,415,575 | B2 | 8/2016 | Beiermann | |
| 9,481,967 | B2 | 11/2016 | Coe | |
| 9,551,114 | B2 | 1/2017 | Coe | |
| 9,551,117 | B2 | 1/2017 | Coe | |
| 9,624,625 | B2 | 4/2017 | Coe | |
| 9,631,619 | B2 * | 4/2017 | Kourakos | F04C 2/1071 |
| 9,637,870 | B1 | 5/2017 | Coe | |
| 9,963,840 | B2 | 5/2018 | Hills | |
| 10,081,920 | B2 | 9/2018 | Coe | |
| 10,160,835 | B2 | 12/2018 | Wang | |
| 10,179,846 | B1 | 1/2019 | Crall | |
| 10,364,534 | B2 | 7/2019 | Coe | |
| 10,662,320 | B2 | 5/2020 | Coe | |
| 10,724,183 | B2 | 7/2020 | Coe | |
| 10,794,017 | B2 | 10/2020 | Coe | |
| 2003/0026653 | A1 | 2/2003 | Crupi | |
| 2004/0057794 | A1 | 3/2004 | Corcoran | |
| 2004/0240939 | A1 | 12/2004 | Hays et al. | |
| 2005/0004273 | A1 | 1/2005 | Chun et al. | |
| 2006/0229390 | A1 | 10/2006 | Chun et al. | |
| 2006/0241218 | A1 | 10/2006 | Kim et al. | |
| 2006/0269678 | A1 | 11/2006 | Bennett et al. | |
| 2007/0282059 | A1 | 12/2007 | Keller et al. | |
| 2009/0087262 | A1 | 4/2009 | Tucker et al. | |
| 2009/0226254 | A1 | 9/2009 | Jones | |
| 2011/0034594 | A1 | 2/2011 | Scholten et al. | |
| 2011/0129296 | A1 | 6/2011 | Van Velsor | |
| 2011/0143066 | A1 | 6/2011 | Roddy | |
| 2011/0243661 | A1 | 10/2011 | Baumgardner et al. | |
| 2011/0250016 | A1 | 10/2011 | Giles | |
| 2011/0274487 | A1 | 11/2011 | Sylvester | |
| 2012/0213584 | A1 | 8/2012 | Reinke et al. | |
| 2012/0301222 | A1 | 11/2012 | Laffey | |
| 2013/0104776 | A1 | 5/2013 | Vaidya | |
| 2014/0148555 | A1 | 5/2014 | Mruk et al. | |
| 2014/0329267 | A1 | 11/2014 | Odriozola et al. | |
| 2015/0071707 | A1 | 3/2015 | Kephart | |
| 2015/0080504 | A1 | 3/2015 | Coe | |
| 2015/0284916 | A1 | 10/2015 | Dworsky | |
| 2015/0345085 | A1 | 12/2015 | Frank | |
| 2016/0320803 | A1 | 11/2016 | Oh et al. | |
| 2017/0130408 | A1 | 5/2017 | Zhang | |
| 2017/0174842 | A1 | 6/2017 | Wang et al. | |
| 2018/0002544 | A1 | 1/2018 | Gao et al. | |
| 2018/0178184 | A1 * | 6/2018 | Holland | B03C 1/288 |
| 2019/0017233 | A1 | 1/2019 | Coe | |
| 2019/0033189 | A1 | 1/2019 | Coe et al. | |
| 2019/0040258 | A1 | 2/2019 | Coe | |
| 2019/0055383 | A1 | 2/2019 | Coe | |
| 2019/0301105 | A1 | 10/2019 | Coe | |

FOREIGN PATENT DOCUMENTS

| | | |
|---|---|---|
| DE | 102009049909 | 4/2011 |
| JP | 05-148815 | 6/1993 |
| JP | 10-147766 | 6/1998 |
| JP | 2000-144629 | 5/2000 |
| JP | 2002-161509 | 6/2002 |
| JP | 2006-036962 | 2/2006 |
| KR | 10-20020078688 | 10/2002 |
| KR | 10-0599492 | 7/2006 |
| KR | 10-0697032 | 3/2007 |
| KR | 10-0821238 | 4/2008 |
| KR | 10-0993406 | 11/2010 |
| KR | 10-1253598 | 4/2013 |
| KR | 10-1254955 | 4/2013 |
| KR | 10-1254956 | 4/2013 |
| WO | WO 85/05388 | 12/1985 |
| WO | WO 14/151973 | 9/2014 |

* cited by examiner

APPARATUS AND METHOD FOR PREPARING ASPHALT AND AGGREGATE MIXTURE

INCORPORATION BY REFERENCE TO RELATED APPLICATIONS

Any and all priority claims identified in the Application Data Sheet, or any correction thereto, are hereby incorporated by reference under 37 CFR 1.57. This application is a continuation of U.S. application Ser. No. 16/435,132, filed Jun. 7, 2019, which is a continuation of PCT International Application No. PCT/US2018/018068, filed Feb. 13, 2018, which was published in English, which designates the United States of America, and which claims the benefit of U.S. Provisional Application No. 62/458,982, filed on Feb. 14, 2017; U.S. Provisional Application No. 62/462,819, filed on Feb. 23, 2017; U.S. Provisional Application No. 62/464,317, filed on Feb. 27, 2017; U.S. Provisional Application No. 62/468,892, filed on Mar. 8, 2017; U.S. Provisional Application No. 62/470,824, filed on Mar. 13, 2017; and U.S. Provisional Application No. 62/569,330, filed on Oct. 6, 2017. Each of the aforementioned applications is incorporated by reference herein in its entirety, and each is hereby expressly made a part of this specification.

FIELD OF THE INVENTION

An asphalt and aggregate mixture and methods for preparing and using same are provided which utilize solid phase auto regenerative cohesion and homogenization by liquid asphalt oligopolymerization technologies. The mixtures are suitable for use in installing asphalt/concrete pavement, repairing asphalt/concrete pavement, and providing overlays to existing asphalt/concrete pavement. The slurries can contain recycled asphalt/concrete pavement subject to treatment.

BACKGROUND OF THE INVENTION

Installation, repair and maintenance of the civil infrastructure, including roads and highways of the United States, present great technical and financial challenges. The American Association of State Highway Transportation Officials (AASHTO) issued a bottom line report in 2010 stating that $160 billion a year must be spent to maintain infrastructure; however, only about $80 billion is being spent. The result is a rapidly failing infrastructure. New methods of maintaining existing roads and new methods of constructing roads that would extend the useful life for the same budget dollar are needed to meet the challenges of addressing our failing infrastructure.

SUMMARY OF THE INVENTION

A method for installing, repairing, or overlaying asphalt/concrete (A/C) pavement, is desirable that is inexpensive when compared to conventional techniques, while yielding a paving surface having an equally long or longer useful life when compared to conventional asphalt/concrete pavement compositions and techniques. A composition for installation, repair, or overlay of pavement, that exhibits an improved lifespan when compared to conventional compositions is desirable. Such a composition can result in improved binding between the asphalt and rock, or between the composition and an adjacent surface. Such a composition can also impart improved resistance to mechanical stress and shearing (e.g., from rolling loads that operate at an angle of incidence), or faster time to use after installation. The compositions are configured to modulate the failure mechanisms of the pavement, so as to impart longer useful life, waterproofing, maintenance of microtexture, maintenance of macrotexture, resistance to embrittlement, resistance to delamination, and resistance to mechanical stress. These improved properties greatly extend the lifetime of the pavement beyond that which would be observed for a conventional new pavement or a conventional repair method on existing pavement. Also provided are emulsions, binders and elastomers substantially as described herein, an emitter apparatus substantially as described herein, a system for installing or repairing pavement substantially as described herein, and related methods.

In a generally applicable first aspect (i.e. independently combinable with any of the aspects or embodiments identified herein), an emitter system is provided for treating recycled asphalt/concrete pavement which has been mechanically removed from its originally installed location, the system comprising: a structural frame holding at least two emitter panels facing each other at an angle so as to form a tunnel, wherein each emitter panel is configured to emit a peak wavelength of radiation of from 1,000 to 10,000 nm; and a conveyor belt configured to pass through the tunnel while conveying the recycled asphalt/concrete pavement at a speed sufficient to achieve a flux of the asphalt in the recycled asphalt/concrete pavement by absorption of the radiation emitted by the emitter panels by the recycled asphalt/concrete pavement. The terms "flux" or "fluxing" as used herein are broad terms, and are to be given their ordinary and customary meaning to a person of ordinary skill in the art (and is not to be limited to a special or customized meaning), and refer without limitation to describe a fluid that is displaceable by application of minimal pressure against a body of the fluid. The irradiation raises the asphalt to a temperature in a range of 250° F. to 290° F. (121° C. to 143° C.) (independent of the stone temperature) by manipulation of process variables including: wavelength (e.g., wavelength differentials), watt density, dwell time (e.g., based on belt speed), and air void density, such that the asphalt coating on the stone surface, including pores, is elevated in temperature ahead of the stone medium. Under some circumstances, a temperature as low 190° F. (88° C.) is sufficient to induce flux. A temperature of 190° F. to 290° F. (88° C. to 143° C.), e.g., 250° F. to 290° F. (121° C. to 143° C.), is generally suitable for use to induce flux in the asphalt or binder. The variable differential between stone temperature and asphalt temperature associated with thermal expansion and fluxing of the asphalt results in a disintegration of the nesting of the stone gradations into their individual moieties, while the moieties remain fully coated with the asphalt element. In other words, the irradiation results in the asphalt being heated before the stone is heated. By heating the asphalt or binder on cold (or colder) stone or aggregate, a "popcorning" effect is observed due to expansion (or creation of educted thermohydraulic pressure) of the asphalt or binder, resulting in a degree of swelling in the mass of treated recycled asphalt/concrete pavement. In contrast, in conventional heating (e.g., in an oven), the stone and asphalt are heated at the same time. Uniform temperature between the asphalt and the stone is observed instead of the temperature differential of the irradiation method of the embodiments. The difference in heating effect results in a different product. In conventional heating (e.g., as in conventional hot mix preparation where the stone (or aggregate) and the asphalt are heated together at the same temperature), the nesting of the stone gradations is not disintegrated, making the resulting product undesirable for use in asphalt/concrete pavement in substantial amounts, e.g., >25% by weight, in that the resulting properties of the asphalt/concrete pavement are degraded.

Process variables suitable for use typically include a peak wavelength of from 10 nm to 20,000 nm. When wavelength differentials are employed, a first peak wavelength of from 10 nm to 20,000 nm, e.g., 15 nm to 20,000 nm, e.g., 3,000 nm to 15,000 nm, e.g., 3,000 nm, is employed in conjunction with a second peak wavelength of from 2 nm to 5,000 nm, e.g., 3,000 nm to 5,000 nm, e.g., 1,500 nm. In certain embodiments, a first wavelength of from 10,000 nm to 12,000 nm is employed in conjunction with a second wavelength of from 3,000 to 5,000 nm.

Watt density can be from 1 watts/in$^2$ (0.16 watts/cm$^2$) or less to 20 watts/in$^2$ (3.1 watts/cm$^2$) or more, e.g., from 2 watts/in$^2$ (0.31 watts/cm$^2$) to 17 watts/in$^2$ (02.6 watts/cm$^2$). Dwell times (or times of exposure to irradiation) are generally preferred to be from about 0.5 minutes or less to about 20 minutes or more, e.g., from about 1 minute to about 12 minutes. It is noted that the higher the watt density that is employed, the shorter the dwell time is that is necessary to achieve flux. Air void density in the recycled asphalt/concrete pavement to be treated is generally greater than or equal to 8% by volume, e.g., from 8% by volume to 35% by volume.

An emitter panel as described herein can emit a single wavelength when single wavelength irradiation is to be employed, e.g., using an emitter panel having one or more emitters (e.g., resistance elements, e.g., nicrome, nickel chrome 80/20 resistance wire, or serpentine wires, or other emitter forms as described herein) steadily emitting at the same wavelength. To apply a temperature differential, as in certain embodiments, the voltage to the emitter can be adjusted, such that the wavelength emitted by the emitter is changed. This can involve a repeating cycle of on/off states, wherein the on states result in emission of a different wavelength. For example, a first on state can cause the emitter to emit at a wavelength of 15 nm to 20,000 nm. The emitter is then turned off (off state), and then turned on again for a second on state that causes the emitter to emit at a wavelength of 2 nm to 4,000 nm. The emitter is then turned off and the cycle repeated. Wavelength from resistive element can be modulated by adjusting the voltage across the element. Alternatively, or in addition to voltage modulation, a birefringent material can be employed to adjust the wavelength. Mica types include biotite, glauconite, lepidolite, margarite, muscovite, and phlogopite. Phlogopite mica can advantageously be employed. The mica, e.g., phlogopite mica, can be provided with perforations. Radiation passing through the perforations from a single emitter will be at a different wavelength than radiation passing through the mica or other birefringent material. Steady emission of radiation is generally preferred, in that cycling on and off can cause premature wear of the emitter panel.

Alternatively, an emitter panel can be provided with two or more emitters (e.g., serpentine wires) that are independently adjusted to emit different wavelengths. For example, a first emitter of the emitter panel can emit at a wavelength of 15 nm to 20,000 nm, while a second emitter of the emitter panel can emit at a wavelength of 2 nm to 4,000 nm. The emitters in such a configuration can be adjacent to each other (e.g., in a same plane), or can be in a stacked configuration. An interdigitated configuration or an offset stacked configuration, wherein one or more of loops or bends of a first emitter are adjacent to but offset from one or more loops or bends of a second emitter. The emitter panel can employ as many emitters as desired, each emitting a same or different wavelength. The emitters in such a configuration can be cycled through on/off states; however, they can advantageously be configured to emit radiation simultaneously. An advantage of employing two different wavelengths simultaneously is that it results in substantial cancellation of elastic waves, which in turn results in a high degree of transmission of phononic energy by the emitter panel (e.g., approaching 100%). The energy typically penetrates into a mass of recycled asphalt/concrete pavement to be treated to a depth of 3 inches (7.6 cm), e.g., to a depth of 2 inches (5.1 cm), concentrating adsorbed energy and heating in this region. This is in contrast to microwave energy, which penetrates deeper and thus spreads the energy out over a greater mass (e.g., 100 mm wavelength radiation can penetrate 30 feet (9.1 meter) into a solid mass of pavement and underlying road bed).

Separating, mechanical wave guides between the plural, emitter element(s) located within the same emitter cavity and the outer emitter cavity surface that is parallel to the object A/C, will limit photon source interaction. When different wavelengths are employed, either by a single emitter cycling through variable wavelength states, or by two or more different emitters in an emitter panel, the rate of uptake of energy into the treated recycled asphalt/concrete pavement (or other irradiated mass) can be modulated to control the process of heating by adjusting the wavelength or combination of different wavelengths, e.g., by use of a transducer that changes voltage to a feedback loop, resulting in a change in emitted wavelength). A temperature sensor, or a sensor that detects reflected energy (reflectivity), can be employed in the feedback loop. It is desired to adjust conditions such that reflected energy is minimized. It is also desirable to adjust conditions to avoid production of smoke by overheating. However, in certain embodiments a degree of smoking may be tolerated. A system for monitoring temperature or reflectivity enables detection of patches or discontinuities in an asphalt/concrete pavement or in a mixture of asphalt and stone (e.g., in recycled asphalt/concrete pavement). This enables the emitted wavelengths to be adjusted to account for differences in composition and to ensure that flux is achieved despite the differences in composition.

In one embodiment, the emitter panel is provided with a copper shield with insulation adjacent to a top side and the emitter adjacent to a bottom side. The copper shield is provided with cone shaped voids on the side adjacent to the emitter. These cone shaped voids act as a waveguide to focus the radiation emitted by the emitter down from the copper shield, thereby improving efficiency.

In an embodiment of the first aspect, which is generally applicable (i.e., independently combinable with any of the aspects or embodiments identified herein), the system is sized so as to irradiate a windrow of recycled pavement atop the conveyor belt, the windrow having a height of 8 to 14 inches (20 to 36 cm) at the peak and a width of 20 to 40 inches (51 to 102 cm) at the base. Prior to irradiation the windrow is reduced to a horizontal configuration parallel to the emitter surface.

In an embodiment of the first aspect, which is generally applicable (i.e., independently combinable with any of the aspects or embodiments identified herein), the angle is in a range of 60 degrees to 120 degrees.

In an embodiment of the first aspect, which is generally applicable (i.e., independently combinable with any of the aspects or embodiments identified herein), the angle is 90 degrees.

In an embodiment of the first aspect, which is generally applicable (i.e., independently combinable with any of the aspects or embodiments identified herein), each emitter panel is in a shape of a square or a rectangle, and wherein the emitter panels are arranged in an array wherein each emitter panel abuts an adjacent emitter connected in parallel or in serial with one or more other emitter panels.

In an embodiment of the first aspect, which is generally applicable (i.e., independently combinable with any of the aspects or embodiments identified herein), each emitter panel has a length of at least 12 inches (36 cm) and a width of at least 12 inches (36 cm).

In an embodiment of the first aspect, which is generally applicable (i.e., independently combinable with any of the aspects or embodiments identified herein), the system further comprises a roller and a compression shoe at a loading point, wherein the roller and compression shoe are configured to compress the recycled asphalt/concrete pavement so as to reduce air void content.

In a generally applicable second aspect (i.e. independently combinable with any of the aspects or embodiments identified herein), a system for treating recycled asphalt/concrete pavement is provided, comprising: a structural frame holding at least one emitter panel, wherein each emitter panel is configured to emit a modulated adjustable peak wavelength of radiation of from 1,000 to 20,000 nm; and a conveyor belt configured to pass under the emitter panel while conveying a recycled asphalt/concrete pavement at a speed and a watt density sufficient to achieve a fluxing of the asphalt at a temperature of 250° F. to 290° F. (121° C. to 143° C.) in the recycled asphalt/concrete pavement by absorption of the radiation emitted by the emitter panels by the recycled asphalt/concrete pavement.

In an embodiment of the second aspect, which is generally applicable (i.e., independently combinable with any of the aspects or embodiments identified herein), the system comprises a roller and a compression shoe at a loading point, wherein the roller and compression shoe are configured to compress the recycled asphalt/concrete pavement into a flat sheet so as to reduce air void content prior to passing under the at least emitter panel.

In an embodiment of the second aspect, which is generally applicable (i.e., independently combinable with any of the aspects or embodiments identified herein), the system is sized so as to irradiate a flat sheet of compressed recycled pavement having a thickness of from 0.5 inches to 2 inches (1.3 cm to 5.2 cm).

In an embodiment of the second aspect, which is generally applicable (i.e., independently combinable with any of the aspects or embodiments identified herein), the system is sized so as to irradiate a flat sheet of compressed recycled pavement having a thickness of from 0.5 inches to 1 inch (1.3 cm to 2.5 cm).

In an embodiment of the second aspect, which is generally applicable (i.e., independently combinable with any of the aspects or embodiments identified herein), the flat sheet of compressed recycled pavement is sized such that a gap between a top surface and the at least one emitter panel is less than one inch.

In an embodiment of the second aspect, which is generally applicable (i.e., independently combinable with any of the aspects or embodiments identified herein), the flat sheet of compressed recycled pavement is sized such that a gap between a top surface and the at least one emitter panel is less than 0.25 inches (0.6 cm).

In an embodiment of the second aspect, which is generally applicable (i.e., independently combinable with any of the aspects or embodiments identified herein), at least one first structural panel and at least one second structural panel are situated in a parallel configuration on opposite sides of the at least one emitter panel, to form a tunnel through which the flat sheet of compressed recycled pavement passes.

In an embodiment of the second aspect, which is generally applicable (i.e., independently combinable with any of the aspects or embodiments identified herein), the flat sheet of compressed recycled pavement is sized such that a gap between a top surface of the flat sheet of compressed recycled pavement and the at least one emitter panel is less than one inch, and a gap between a first side surface of the flat sheet of compressed recycled pavement and the at least one first structural panel is less than one inch, and a gap between a second side surface of the flat sheet of compressed recycled pavement and the at least one second structural panel is less than one inch.

In an embodiment of the second aspect, which is generally applicable (i.e., independently combinable with any of the aspects or embodiments identified herein), the flat sheet of compressed recycled pavement is sized such that a gap between a top surface of the flat sheet of compressed recycled pavement and the at least one emitter panel is less than 0.25 inches (0.6 cm), and a gap between a first side surface of the flat sheet of compressed recycled pavement and the at least one first structural panel is less than 0.25 inches (0.6 cm), and a gap between a second side surface of the flat sheet of compressed recycled pavement and the at least one second structural panel is less than 0.25 inches (0.6 cm).

In an embodiment of the second aspect, which is generally applicable (i.e., independently combinable with any of the aspects or embodiments identified herein), each emitter panel is in a shape of a square or a rectangle, and wherein the emitter panels are arranged in an array wherein each emitter panel abuts an adjacent emitter connected in parallel or in serial with one or more other emitter panels.

In an embodiment of the second aspect, which is generally applicable (i.e., independently combinable with any of the aspects or embodiments identified herein), each emitter panel has a length of at least 12 inches (36 cm) and a width of at least 12 inches (36 cm).

In a generally applicable third aspect (i.e. independently combinable with any of the aspects or embodiments identified herein), a method for treating recycled asphalt/concrete pavement is provided, comprising: irradiating a recycled asphalt/concrete pavement with radiation having a peak wavelength of 1,000 to 10,000 nm so as to heat the recycled asphalt/concrete pavement to a temperature of 275° F. (135° C.), whereby aggregate-micro-shoreline-bound-asphalt and aggregate-pore-stored-asphalt of the recycled asphalt/concrete pavement is freed.

In an embodiment of the third aspect, which is generally applicable (i.e., independently combinable with any of the aspects or embodiments identified herein), the method further comprises: mixing the irradiated recycled asphalt/concrete pavement with an asphalt emulsion, whereby an asphalt and aggregate mixture is obtained.

In an embodiment of the third aspect, which is generally applicable (i.e., independently combinable with any of the aspects or embodiments identified herein), the asphalt and aggregate mixture is a hot mix asphalt, the method further comprising applying the hot mix asphalt onto a road base or onto an old road surface that has been prepared, and subjecting the applied hot mix asphalt to compaction.

In an embodiment of the third aspect, which is generally applicable (i.e., independently combinable with any of the aspects or embodiments identified herein), the recycled asphalt/concrete pavement is recovered in a hot in place recycle process, and wherein the treated recycled asphalt/concrete pavement is placed back onto an old road surface from which it has been removed.

In an embodiment of the third aspect, which is generally applicable (i.e., independently combinable with any of the aspects or embodiments identified herein), the irradiating comprises irradiating with the emitter system of the first or second aspects or their respective embodiments.

In an embodiment of the third aspect, which is generally applicable (i.e., independently combinable with any of the aspects or embodiments identified herein), the conveyor belt passes through the tunnel at a speed of from 8 feet per minute (2.4 meters per minute) to 12 feet per minute (3.7 meters per minute).

In an embodiment of the third aspect, which is generally applicable (i.e., independently combinable with any of the aspects or embodiments identified herein), the conveyor belt passes through the tunnel at a speed of from 5 feet per minute (1.5 meters per minute) to 20 feet per minute (6.1 meters per minute).

In a fourth aspect, a system is provided for treating recycled asphalt/concrete pavement, comprising: a first emitter configured to emit a peak wavelength of radiation of from 1,000 to 10,000 nm; a second emitter configured to emit a peak wavelength of radiation of from 1,000 to 10,000 nm; and a passage between the emitters configured to allow passage of recycled asphalt/concrete pavement there between, such that, in use, the recycled asphalt/concrete pavement absorbs the radiation emitted by the emitters.

In an embodiment of the fourth aspect, the first emitter is coaxial with the second emitter.

In an embodiment of the fourth aspect, the system further comprises a helicoid rotor having a hollow tubular axis, wherein the helicoid rotor is configured to convey the recycled asphalt/concrete pavement between the emitters.

In an embodiment of the fourth aspect, the first emitter is mounted on an outer shell, wherein the second emitter is mounted on a shaft, wherein the outer shell surrounds the helicoil rotor, and wherein the hollow tubular axis of the helicoid rotor surrounds the shaft supporting the second emitter.

In an embodiment of the fourth aspect, the system further comprises a drive hub assembly configured to rotate the helicoid rotor.

In an embodiment of the fourth aspect, the drive hub assembly is configured to operate the helicoil rotor at a variable speed, so as to achieve, upon exit from the tunnel, a temperature of 250° F. to 290° F. (121° C. to 143° C.) in the recycled asphalt/concrete pavement by absorption of the radiation emitted by the emitters.

In an embodiment of the fourth aspect, the outer tube comprises at least one port configured to meter a binder onto the recycled asphalt/concrete pavement.

In an embodiment of the fourth aspect, the first emitter and the second emitter are each supported by a structural frame that positions the emitters at an angle to each other in a range of 60 degrees to 120 degrees, the system further comprising a conveyor belt configured to convey the recycled asphalt/concrete pavement between the emitters at a speed sufficient to achieve, upon exit from the tunnel, a temperature of 250° F. to 290° F. (121° C. to 143° C.) in the recycled asphalt/concrete pavement by absorption of the radiation emitted by the emitters.

In an embodiment of the fourth aspect, the system is sized so as to irradiate a windrow of recycled pavement atop the conveyor belt, the windrow having a height of 8 to 14 inches (20 to 36 cm) at the peak and a width of 20 to 40 inches (51 to 102 cm) at the base.

In an embodiment of the fourth aspect, the first emitter and the second emitter are in a parallel configuration, the system further comprising: a roller and a compression shoe at a loading point, wherein the roller and compression shoe are configured to compress recycled asphalt/concrete pavement into a flat sheet so as to reduce air void content prior to passing between the at least two emitters; and a conveyor belt configured to pass between the emitters while conveying the flat sheet of compressed recycled asphalt/concrete pavement at a speed sufficient to achieve a temperature of 250° F. to 290° F. (121° C. to 143° C.) in the recycled asphalt/concrete pavement by absorption of the radiation emitted by the emitters by the recycled asphalt/concrete pavement.

In a fifth aspect, a method is provided for treating recycled asphalt/concrete pavement, comprising: providing the system of the fourth aspect or any of its embodiments; and irradiating a recycled asphalt/concrete pavement with radiation having a peak wavelength of 1,000 to 10,000 nm so as to heat the recycled asphalt/concrete pavement to a temperature of 250° F. to 290° F. (121° C. to 143° C.).

In an embodiment of the fifth aspect, the method further comprises mixing the irradiated recycled asphalt/concrete pavement with a binder, whereby a hot mix asphalt is obtained.

In an embodiment of the fifth aspect, the method further comprises mixing the irradiated recycled asphalt/concrete pavement with an asphalt emulsion, whereby a hot mix asphalt is obtained.

In an embodiment of the fifth aspect, the method further comprises applying the hot mix asphalt onto a road base or onto an existing road surface, and subjecting the applied hot mix asphalt to compaction.

In an embodiment of the fifth aspect, the recycled asphalt/concrete pavement is recovered in a hot in place recycle process, and wherein the mixture containing irradiated recycled asphalt/concrete pavement is placed back onto an old road surface from which it has been removed.

Any of the features of an embodiment of the first through fifth aspects is applicable to all aspects and embodiments identified herein. Moreover, any of the features of an embodiment of the first through fifth aspects is independently combinable, partly or wholly with other embodiments described herein in any way, e.g., one, two, or three or more embodiments may be combinable in whole or in part. Further, any of the features of an embodiment of the first through fifth aspects may be made optional to other aspects or embodiments. Any aspect or embodiment of a method can be performed by a system or apparatus of another aspect or embodiment, and any aspect or embodiment of a system can be configured to perform a method of another aspect or embodiment.

DESCRIPTION OF THE DRAWINGS

FIG. 5A is a single emitter 41 on a shield 40 (e.g.). FIG. 5B is an interdigitated emitter configuration with a first emitter 43 and a second emitter 42 on a shield 40. FIG. 5C is a stacked emitter configuration with a first emitter 44 situated in a plane above a second emitter 45, with both emitters on a shield 40.

DETAILED DESCRIPTION OF THE PREFERRED EMBODIMENT

Figure 1:
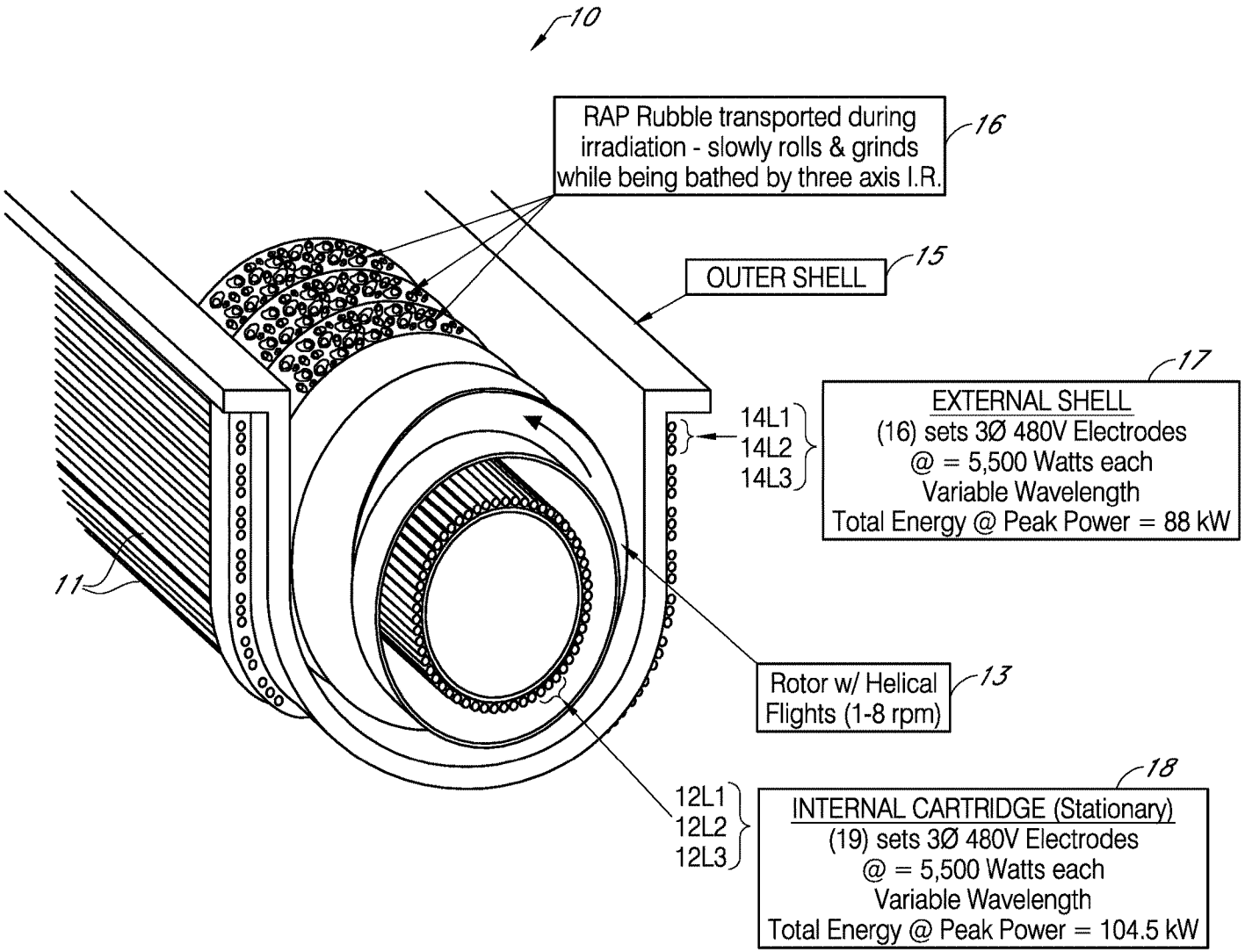
FIG. 1 depicts detail of an emitter structure of a mobile helicoid reactor assembly.

The following description and examples illustrate a preferred embodiment of the present invention in detail. Those of skill in the art will recognize that there are numerous variations and modifications of this invention that are encompassed by its scope. Accordingly, the description of a preferred embodiment should not be deemed to limit the scope of the present invention.

In the United States alone there are approximately 4.4 million center lane miles (7.1 million center lane kilometers) of asphalt concrete, with a center lane comprising a 24 foot (7.3 meters) wide pavement surface having a lane in each direction. Asphalt concrete paving surfaces are typically prepared by heating aggregate to 400° F. (204° C.), and applying liquid asphalt (e.g., by spraying into a pug mill or drum coating) to yield a mixture of 95% aggregate and 5% asphalt. If a temperature of approximately 350° F. (177° C.) is maintained for the mixture, it is considered hot mix asphalt and does not stick to itself as long as the temperature is maintained (e.g., a temperature in a range of from 350° F. to 400° F. (177° C. to 204° C.)). The hot mix asphalt is typically placed in a transfer truck, which hauls it to the job site, where it is placed on either a gravel road base or onto an old road surface that has been previously primed. A paving apparatus receives the hot mix asphalt from the transfer truck and spreads it out uniformly across the base surface, and as the material progressively cools below 250° F. (121° C.) degrees it is compacted with a roller (e.g., at a temperature in a range of from 150° F. (66° C.), 160° F. (71° C.), 170° F. (77° C.) or 180° F. (82° C.) up to 190° F. (88° C.), 200° F. (93° C.), 210° F. (99° C.), 220° F. (104° C.), 230° F. (110° C.), 240° F. (116° C.) or 250° F. (121° C.)). The hot mix asphalt is rolled to a uniform density, and after approximately one to three days of cooling and aging the surface can be opened to traffic.

After such asphalt/concrete pavement has been in place for several years, the pavement progressively ages. Water works its way into the pavement. It begins to lose its integrity on the surface, causing aggregate at the surface of the pavement to be lost. The pavement surface roughens as aggregate is lost, and cracks begin to form. Pavement repair techniques at this stage in the deterioration process include: pouring hot rubber asphalt into the cracks, using cold patch (a cold mix asphalt that can be applied to a damaged road surface, e.g., placed in a pothole, under ambient temperature conditions using hand tools). Another technique for repairing pavement exhibiting minimal damage involves application of a liquid asphalt emulsion to the pavement surface so as to provide a degree of waterproofing to slow the aging process, or, for surfaces exhibiting more deterioration, application of a thin layer of a mixture of aggregate and asphalt emulsion over the top of the pavement.

Preparing and installing hot asphalt/concrete pavement involves running aggregate through a heat tube (e.g., at a temperature of from 350° F. (177° C.) or 375° F. (191° C.) up to 400° F. (204° C.) or 425° F. (218° C.)) where moisture is driven off to prevent boil over when the rock contacts molten asphalt. The aggregate is added to asphalt, optionally containing a polymeric material, e.g., a rubber, styrene-butadiene-styrene copolymer, or other polymer. The aggregate is sent through a mill having high velocity tines that rolls the aggregate through a spray of asphalt. The resulting mixture of aggregate with baked-on asphalt typically comprises 95% aggregate and 5% asphalt (optionally with a rubber or other polymer). The mixture exits the mill at about 350° F. (177° C.) (e.g., at a temperature of from 350° F. (177° C.) or 375° F. (191° C.) up to 400° F. (204° C.) or 425° F. (218° C.)) and is transported into waiting trucks (e.g., a belly dump truck) which are driven to the job site. New pavement is laid down over an earthen base covered with gravel that has been graded and compacted. Typically, the new road is not laid in a single pass. Instead, a first 2-3 inch (5-8 cm) lift of loose hot asphalt is laid down and partially compacted, and then a second lift is laid over the first and compacted. The temperature of the asphalt concrete pavement when an additional lift is added is typically about 140° F. (60° C.) (e.g., ambient temperature up to 140° F. (60° C.), e.g., −20° F. (−29° C.), 0° F. (−18° C.), 20° F. (−7° C.), 40° F. (4° C.), 60° F. (16° C.), 70° F. (21° C.), 100° F. (38° C.), or 120° F. (49° C.) up to 140° F. (60° C.). Additional lifts can be added as desired, e.g., to a depth of approximately 6, 9, 12, 15, or 18 inches or more (15, 23, 30, 38, or 46 cm or more), depending upon the expected usage conditions for the road (heavy or light transportation, the velocity of traffic, desired lifetime). Primer or additional material is typically not put between layers of lift in new construction, as the fresh pavement exhibits good adherence to itself in new construction, however primer or additional material can be employed between lifts in certain embodiments.

After approximately fifteen years of exposure to the elements, it becomes cost prohibitive to attempt to maintain asphalt/concrete pavement via conventional cold patching, waterproofing, and slurry techniques. The approach at this stage in the deterioration of the pavement typically involves priming the damaged surface and applying a layer of hot mix asphalt. For pavement too deteriorated for application of priming and application of a layer of hot mix asphalt, a cold-in-place recycling process can be employed. In cold-in-place recycling, typically the topmost 2 to 5 inches (5 to 13 cm) of the damaged road surface is pulverized down to a specific aggregate size and mixed with an asphalt emulsion, and then re-installed to pave the same road from which the old paving material has been removed.

Existing pavement (asphalt or concrete) is typically repaired by use of an overlay, e.g., a mixture of aggregate and asphalt such as described above for new road construction. In the case of repaving over the top of rigid concrete, some type of primer is typically applied, e.g., as a spray resulting in application of approximately 10 gallons (38 liters) of primer per 1,000 square feet (93 square meters) of pavement. The primer can be an asphalt emulsion that provides a tacky surface for the new overlay. A single layer of overlay can be applied, or multiple layers, typically two or more.

Cracks and stresses in a repaired underlying road bed will quickly imprint themselves on new overlays of paving material, due to the malleability of the new asphalt under rolling loads. As the underlying road bed undergoes expansion and contraction under ambient condition, cracks can be telegraphed up through as much as three inches (8 cm) of overlying asphalt. A conventional method for achieving some resistance to the telegraphing of old defects in the underlying road bed is to put down a hot tack coat of asphalt, lay a polypropylene mat (similar in appearance to spun-bond polypropylene, typically 0.25-0.5 inches (0.64-1.27 cm) in thickness, and available as Petromat® from Nilex, Inc. of Centennial, Colo.) over the hot tack coat of asphalt, followed by a layer of new hot asphalt concrete which is then compacted over the existing surface. This inhibits the rate of telegraphing of cracks to a limited extent, such that instead of taking place from 6 months to 2 years after repair, the cracks do not telegraph for from to 1 year to 3 years after repair. This telegraphing phenomenon by the defects in an existing aged roadbed manifest surface defects in a new pavement overlay about three times sooner than is common to a fresh asphalt concrete pavement placed on a compacted earthen and gravel base; as is the practice in new construction.

Repair of shallow surface fissures and raveling uses various methods. Resaturants are materials that soften old asphalt. They are typically mixed with an emulsion and sprayed onto the surface of the old pavement. The material penetrates into the uppermost 20 or 30 mils (0.5 or 0.76 millimeters) of the pavement and softens the asphalt, imparting flexibility. Thermally fluidized hot asphalt can also be sprayed directly onto the surface, which hardens and provides waterproofing. A fog seal is typically sprayed on the surface, and can be provided with a sand blotter to improve the friction coefficient. In a chip seal, a rubberized emulsion can also be sprayed onto the aged pavement, and then stone is broadcast into the rubberized emulsion which then hardens, bonding the stone. Slurry seal employs a cold aggregate/asphalt mixture prepared in a pug mill and placed on the aged pavement surface, but is applied in a much thinner layer, e.g., 0.25-0.75 inches (0.64-1.9 cm). Once the pavement surface is repaired, any safety markings can be repainted.

Methods for repair of surface defects inclusive of rejuvenators and fog seals typically do not exhibit a desirable lifespan. The most durable conventional repair, a slurry seal or a chip seal, may last only 7 or 8 years.

Loss of waterproofing typically is a top down mechanism. The asphalt breaks down from exposure to heavy load and the sun, causing water to penetrate between the asphalt and rock. The asphalt can lose its hydrophobicity, with paraffinic components being broken down into more hydrophilic components, which in turn accelerate the process of water adsorption. Raveling occurs, resulting in a loss of macrotexture. Ultimately, the microtexture of the surface is lost due to abrasion of tires across the surface rubbing off the asphalt and polishing the rock surface, whereby the coefficient of friction drops to unacceptable levels. Typically, a brand new pavement will have a coefficient of friction of between 0.6 and 0.7. Over time, loss of microtexture and ultimately macrotexture results in the coefficient of friction dropping to below about 0.35, at which point the pavement becomes inherently unsafe in terms of steer resistance in the presence of water. Even if a pavement surface does not have raveling or cracking, it can still be unsafe to drive on due to loss of adequate surface texture. Microtexture and macrotexture mechanisms function at different speeds. Typically, up to about 45 mph (72 km/hr) the microtexture controls stopping distance. Between 45 mph (72 km/hr) and 50 mph (80 km/hr) the macrotexture begins to have a greater effect on stopping distance, and above 50 mph (80 km/hr) the macrotexture is the principal determining factor in stopping distance.

Accordingly, there are a variety of maintenance techniques that can be employed on damaged asphalt/concrete pavement, some of them more successful than others in preserving and extending the useful life of the pavement. It is known that for pavement that is timely and properly maintained, and repaired in the early stages of deterioration, the typical useful life can be extended out to 19 or 20 years. However, in the current economic environment, the conventional approach to road maintenance is to fix the most often travelled pavement first, and then repair, as budgets allow, progressively the better pavement, such that a useful life closer to 12 or 13 years is typically observed.

Solid phase auto-regenerative cohesion can be achieved within an asphalt through the use of functional bio-resin modified, conventional emulsions to achieve a robust fatigue life, including self-healing properties, for infrastructure elements such as roads and concrete structures. Homogenizing asphalt liquid oligomers involves use of a highly efficient, heavy industrial, mobile heating platform which is capable of emitting a broad bandwidth of energy between near infrared to near microwave. The technology for road construction and restoration has been developed to optimize adhesive qualities and curing processes which substantially attenuate well understood stress-strain relationships within the aggregate binder system; thereby extending fatigue life.

Aggregate

Recycled asphalt/concrete pavement subject to treatment can be employed as aggregate in the paving materials of the embodiments described herein. A hot mix paving material comprising treated recycled asphalt/concrete pavement can be employed to prepare new roads or to provide a new wearing surface to existing roads. Recycled asphalt/concrete pavement is a desirable aggregate material. It offers advantages in that in aggregate form it already includes an amount of asphalt binder. It also has the potential of being sourced on-site from the pavement to be provided with a new wearing surface, e.g., a cold-in-place recycling or hot mix process as described herein. The recycled asphalt/concrete pavement is subject to a radiation treatment. The treatment comprises irradiating with radiation having a peak wavelength of 1,000 to 10,000 nm to warm the pavement (e.g., to a temperature of about 275° F. (135° C.)) and to free aggregate-micro-shoreline-bound-asphalt and aggregate-pore-stored-asphalt.

Preparation

The initial stage in the paving methodology preferably involves a preparatory stage. For installation of a new road, this typically involves preparing a subgrade or subbase, preparing a base course, then installing pavement atop the base course. Preparation of the subgrade or subbase can involve grading, compacting, and stabilizing the ground upon which the pavement is to be installed. A base course is then provided. The base course can include an earth road surface, gravel, sand, or other aggregate that is applied to the subgrade or subbase and leveled and compacted. In some embodiments it can be desirable to treat the base course in some manner. Stability can be provided by applying asphalt, cement, or other binders. Waterproofing can be provided by using asphalt, bitumen, or other binders. The base course can comprise a single material applied in a single layer, or multiple materials applied in one or more layers, e.g., a sand-asphalt base, an aggregate-asphalt base, a soil-cement base, or a lime stabilized soil. The pavement is then applied atop the base course.

When the paving methodology is applied to an existing road, suitable preparations can be conducted. For an existing gravel road to be paved, the gravel can be graded, optionally augmented with additional gravel or other aggregate, and used as a base course, with or without applied binder. For a cement road to be provided with a new wearing surface, existing cracks, fissures, and holes exceeding a certain size (e.g., an average diameter of the aggregate to be used in the new paving surface) can be filled. For an aged asphalt/concrete pavement to be repaired, the rough surface and cracks (e.g., of alligatored pavement) can be cleaned to remove loose pieces of pavement, dirt and organic matter. In the case of a method involving recycling, a topmost layer of pavement can be removed to provide a base for installation of a new paving surface. The removed topmost layer can be processed as desired (e.g., removed from the site for use elsewhere, or pulverized to form an aggregate for use in repaving the same road or a different road).

The pavement surface is cleared of such debris, as well as pavement markers (road reflectors, raised pavement markers, temporary polyurethane markers, tactile pavement structures, and the like). It is generally preferred to remove pavement markers (road reflectors, raised pavement markers, temporary polyurethane markers, tactile pavement structures, thermoplastic imprinting, crosswalk markings, or other marking or safety devices) by mechanically removing, e.g., scraping off or combusting, prior to conducting further steps. An advantage of the methodology of various embodiments over conventional processes is that there is no need to clean the pavement beyond broom clean, e.g., by removing dirt and pavement markers, and there is also no need to remove any paint or other such markings on the pavement surface.

Debris removal is advantageously accomplished by applying a pressurized air-water mixture to the surface; however, other methods can be performed instead of or in conjunction with pressurized treatment. For example, the surface can be cleaned using pressurized air only, pressurized water only, a pressurized solvent, sweeping, vacuuming, or the like. In a preferred embodiment, debris removal is preferably accomplished using a low volume, high pressure water blasting system operating in the 100-500 psi (690-3400 kPa) range. A nozzle jet which delivers a conical pattern is particularly preferred because it leaves no spray 'shadow' as the washing device moves parallel to the surface of the pavement. A vacuum system positioned just ahead and just behind the high pressure washing system can minimize the possible negative environmental impact caused by dislodged material being transferred into the atmosphere and adjacent ditch line. For a Hot In-Place Recycle process, it may be acceptable to forego cleaning the pavement or removing debris or pavement markers, such that when the uppermost pavement cross-section (approximately the top 2 inches (5 cm) of pavement) is planed or scarified, the debris is simply rolled into the processed pavement, thereby becoming small defects to the final, recycled pavement finish.

Large cracks (e.g., cracks wider than average aggregate diameter or, e.g., one inch), potholes and divots are preferably filled with suitable cold or warm patch asphalt concrete material and compacted to a dense structure parallel to the elevation of the surrounding pavement surface. In some embodiments, deviations from a uniform surface plane (e.g., potholes, divots, cracks, grooves, compressions, ruts, and the like) in the pavement are filled and compacted with select gradations of dry aggregate, e.g., prior to application of a cold or warm patch asphalt, or an asphalt emulsion. Deviations from a uniform surface plane can penetrate deep into the surface of a rough pavement, typically to a depth of up to 3 or 4 inches (8 to 10 cm). The aggregate serves to infill lost volume to the structure and return the pavement surface to a uniform plane, with no divots, ruts, or other sizeable irregularities. The aggregate is also selected to exhibit the proper combination of micro and macro texture to ensure good traction for vehicles traveling over the road under ambient conditions. Typical aggregate size ranges from 0.25 inches (0.64 cm) in diameter or less to 0.375 inches (0.95 cm) in diameter; however, smaller or larger aggregate can be employed. Smaller size aggregate can include beach sand or sand excavated from a quarry. Larger aggregate can include pebbles or cobbles. Suitable aggregate includes coarse particulate material typically used in construction, such as sand, gravel, crushed stone, slag, recycled concrete pavement, recycled asphalt/concrete pavements, ground tire rubber, and geosynthetic aggregates. In paving applications, the aggregate serves as reinforcement to add strength to the overall composite material. Aggregates are also used as base material under roads. In other words, aggregates are used as a stable foundation or road/rail base with predictable, uniform properties (e.g. to help prevent differential settling under the road or building), or as a low-cost extender that binds with more expensive cement or asphalt to form concrete. The American Society for Testing and Materials publishes a listing of specifications for various construction aggregate products, which, by their individual design, are suitable for specific construction purposes. These products include specific types of coarse and fine aggregate designed for such uses as additives to asphalt and concrete mixes, as well as other construction uses. State transportation departments further refine aggregate material specifications in order to tailor aggregate use to the needs and available supply in their particular locations. Sources of aggregates can be grouped into three main categories: those derived from mining of mineral aggregate deposits, including sand, gravel, and stone; those derived from of waste slag from the manufacture of iron and steel; and those derived by recycling of concrete, which is itself chiefly manufactured from mineral aggregates, or other construction materials. The largest-volume of recycled material used as construction aggregate is blast furnace and steel furnace slag. Blast furnace slag is either air-cooled (slow cooling in the open) or granulated (formed by quenching molten slag in water to form sand-sized glass-like particles). If the granulated blast furnace slag accesses free lime during hydration, it develops strong hydraulic cementitious properties and can partly substitute for Portland cement in concrete. Steel furnace slag is also air-cooled. Glass aggregate, a mix of colors crushed to a small size, is substituted for many construction and utility projects in place of pea gravel or crushed rock. Aggregates themselves can be recycled as aggregates. Many polymer-based geosynthetic aggregates are also made from recycled materials. Any solid material exhibiting properties similar to those of the above-described aggregates may be employed as aggregate in the processes of various embodiments. Once the dry aggregate is placed in the damaged areas (potholes, large divots, large cracks, or compressions), it is preferably compacted, smoothed and leveled off.

Asphalt Emulsion

After the surface of the pavement is prepared, an asphalt emulsion or a treated recycled asphalt/concrete pavement composite mixture, e.g., a hot or cold mixture or slurry, is sprayed, poured, or otherwise applied onto the cleaned (and optionally hot patched asphalt concrete, cold patched asphalt concrete, and/or the dry aggregate-filled) surface. The asphalt emulsion and/or aggregate composite mixture thus applied quickly penetrates into small cracks and crevices in the aged pavement as well as dry aggregate-filled areas, providing a substantially fully saturated cross section to a surface of the plane of the road. Because of the high penetrating ability of the asphalt emulsion and aggregate composite mixture, only a small amount of binder is needed to form a strong bond with the aggregate—typically approximately 10% binder to 90% aggregate is employed. The reactive emulsion is preferably hot and typically applied in the form of a 20% to 40% solid emulsion in water. The water in the asphalt emulsion either flashes off during subsequent activities, or is absorbed by the aggregate or otherwise remains in the paving system. The binder upon curing bonds not only the aggregate (e.g. treated recycled asphalt/concrete pavement) together, but also the aggregate to old pavement, and old pavement together. Conventional emulsions and binders can be employed, or binders and emulsions as described herein can advantageously be employed in conjunction with treated recycled asphalt/concrete pavement.

The process methods utilize various combinations of elastomers and other components so as to achieve a road surface exhibiting an extremely good toughness, extremely good stretchability, good environmental resistance, and good adhesion. These elastomer compositions are waterborne, sprayable, and can be provided as a single package. A plurality of crosslinkable binder elements is employed in these compositions. In addition to binding new aggregate (e.g. treated recycled asphalt/concrete pavement) and aged pavement, the elastomer compositions may be configured for use as a primer/tack coat, a stress absorbing interlayer, or a texture restoring and waterproofing top coat.

The elastomer compositions exhibit viscosities suitable for processing using conventional paving techniques, and polymerize at a temperature compatible with conventional asphalt paving temperatures. Dissolving diluents and plasticizers are employed in conjunction with the elastomers such that the rubberized mixture of elastomer and asphalt is rendered into liquid form at room temperature, which yields tremendous advantages in terms of handleability and ease of installation in addition to long term performance of the resulting paving material. The elastomer compositions include butyl rubber, diene modified asphalt, and chemically fortified bioresins (bioresins that have been taken through a reactor cycle to enhance long term stability, sun resistance, and long term hydrolytic resistance), and contain negligible (<1%) to zero perflurocarbons (PFCs) and negligible (<1%) polyaromatic hydrocarbons (PAHs) as the volatile components.

Alternatively to and in conjunction with the placement of dry aggregate in voids as previously described, the elastomer compositions can be prepared as an ambient liquid that, at the job site, may be sprayed into a mixer with aggregate (e.g. treated recycled asphalt/concrete pavement). The composition coats the stone using similar techniques as in a hot mix plant, except that it is done at ambient temperature. The coated aggregate is laid on the ground and spread with conventional drag boxes or paving machines at a very thin coating. Depending upon the size of the aggregate, a thickness of 0.1 inch (2.5 mm) can be obtained (e.g., using spray coating or other deposition techniques); however, thicknesses of approximately 0.5 inches (1.3 cm) are typically employed with aggregate having a diameter of up to approximately 0.375 inches (0.95 cm).

The reactive emulsion is a waterborne emulsion of a polymer modified asphalt. The asphalt itself can be provided in emulsion form. Asphalt, also referred to as bitumen, is a sticky, black and highly viscous liquid or semi-solid that is present in most crude petroleums and in some natural deposits. Asphalt is used as a glue or binder mixed with aggregate particles to create asphalt/concrete pavement. The terms “asphalt” and “bitumen” are often used interchangeably to mean both natural and manufactured forms of the substance. Asphalt is the refined residue from the distillation process of selected crude oils and boils at 525° F. (274° C.). Naturally occurring asphalt is sometimes referred to as "crude bitumen." Asphalt is composed primarily of a mixture of highly condensed polycyclic aromatic hydrocarbons; it is most commonly modeled as a colloid.

A number of technologies allow asphalt to be mixed at temperatures much lower than its boiling point. These involve mixing the asphalt with petroleum solvents to form "cutbacks" with reduced melting point or mixtures with water to turn the asphalt into an emulsion. Asphalt emulsions contain up to 70% asphalt and typically less than 1.5% chemical additives. There are two main types of emulsions with different affinity for aggregates, cationic and anionic.

Asphalt can also be made from non-petroleum based renewable resources such as sugar, molasses, rice, corn, and potato starches, or from waste material by fractional distillation of used motor oils.

The asphalt can be modified by the addition of polymers, e.g., natural rubber or synthetic thermoplastic rubbers. Styrene butadiene styrene and styrene ethylenebutadiene styrene are thermoplastic rubbers. Ethylene Vinyl Acetate (EVA) is a thermoplastic polymer. The most common grade of EVA for asphalt modification in pavement is the classification 150/19 (a melt flow index of 150 and a vinyl acetate content of 19%). The polymer softens at high temp, and then solidifies upon cooling. Typically, approximately 5% by weight of the polymeric additive is added to the asphalt. Rubberized asphalt is particularly suited for use in certain embodiments.

Functionalized triglyceride bioresins can be employed as thermoset components in certain emulsion formulations. Thermosets harden at high temperature. When employed in combination with a thermoplastic component, the composition maintains its shape better on heating and under high temperature conditions. Suitable bioresins are derived from triglycerides—fatty acid triesters of the trihydroxy alcohol glycerol. Triglycerides are an abundant renewable resource primarily derived from natural plant or animal oils that contain esterified mono- to poly-unsaturated fatty acid side chains. They can be obtained from a variety of plant sources, e.g., linseed oil, castor oil, soybean oil. Linseed oil comprises an average of 53% linolenic acid, 18% oleic acid, 15% linoleic acid, 6% palmitic acid, and 6% stearic acid. Crosslinking occurs at points of unsaturation on the fatty acid side chains. The triglycerides can be modified to contain epoxy and/or hydroxy groups by methods known in the art to improve cross-linking and to allow the triglyceride to be cross-linked using conventional urethane crosslinking chemistries.

Suitable binder crosslink components include resins that are multifunctional and react with active hydrogens, e.g., in carboxylic or carbonyl, or hydroxyl. These resins can include polyurethanes, isocyanates, bisphenol A-based liquid epoxy resins, and aliphatic glycol epoxy resins as marketed by The Dow Chemical Company. The binder crosslink component is water dispersible but will stay buffered from going into a crosslink in the presence of water. Upon evaporation of the water, it will self-cross within 24 hours just from UV initiation. As long as water is present in the mix, the components can remain in proximity without cross-linking (e.g., yielding a single component formulation).

Suitable suspension components include pre-crosslinked bioresin suspension gels. They react with both the crosslink component and catalyst to yield a tough, water resistant, shear resistant plastic. The suspension component is preferably relatively inexpensive, has tremendous robustness, and is not hydrophobic.

Suitable catalysts include multi-functional pre-dispersed initiators (MFXI). Multifunctional initiators are those that possess more than one functional group capable of providing a site for chain growth. The catalyst assists in improving growth of molecular weight, and when compounded into the polymer imparts robustness. The catalyst can be activated by either ultraviolet radiation (e.g., sunlight) or heat. Suitable multifunctional catalysts can include one or more sulfates and a reactive metal that is an electron scavenger, which can cause crosslinking between a hydrogen-seeking crosslinking agent and other functional groups in the presence of water.

The components of the reactive emulsion composition can undergo a thermotropic conversion, resulting in entanglement and/or bridging at functional groups such that the resulting reaction product comprises both thermoplastic and thermoset elements. The resulting composition exhibits a superior suspension (the "yield") against the settling of the much denser inorganic element (fine to coarse aggregate) by the formation of a "clathrate" or "cage-like" medium. This fully integrated, interlocking connectivity between the three polymeric components maintains the aggregate in place and better protected from the elements than in conventional formulations.

The thermoplastic component and the thermoset/suspending components possess chain-terminating functional groups that are hindered mostly by water but will selectively react to form a crosslink, upon water evaporation, to the thermoplastic functionality rather than to the functionality of sister thermoset molecules, thereby forming a true thermotrope rather than a less precise molecularly entanglement which exhibits more amorphous (and less useful) physical properties. The composition can be provided as a single package, which is activated/cross-linked upon removal of the water. The chain chemistry is such that thermoplastic moieties are coupled to thermoset moieties. When heated, it will act like a thermoplastic but it will have substantial resistance to thermal distortion because of the thermoset components. The relative amounts of thermoplastic and thermoset components will determine the resistance. For example, a small amount of thermoplastic moieties with a large amount of thermoset moieties will exhibit little plasticity upon heating. The resulting cross-linked material can be considered to be a thermotrope that will behave like both a thermoset and a thermoplastic at different temperatures.

The thermoplastic component in the water-borne compositions of selected embodiments is a preferably a polymer modified asphalt emulsion, with the polymer typically a styrene, ethylene, butadiene styrene, or a styrene butadiene styrene polymer. The midblock, e.g., butadiene and/or ethylene butadiene, can be linear or radial. Polyethylene glycols, such as those available from Kraton and Asahi, are water-soluble nonionic oxygen-containing high-molecular ethylene oxide polymers having two terminal hydroxyl groups. They are available in a broad range of molecular weight grades, and include crystalline thermoplastic polymers (MW>2000) suitable for use in certain compositions of the various embodiments. An additional broad range of properties is available by integrating polyisobutylene rubber (e.g., Oppanol® manufactured by BASF of Ludwigshafen am Rhein, Germany). The Oppanol® polyisobutylenes are of medium and high molecular weight, ranging from 10,000 MW up to 5,000,000 MW. TABLE 1 lists properties of commercially, available Oppanol® polyisobutylenes that are suitable for use in elastomer compositions of various embodiments.

TABLE 1

| Oppanol ® | Viscosity in solution (isooctane, 20° C.) Concentration [g/cm3] | Staudinger Index (J0) [cm3/g] | Average molecular weight, viscosity average (Mv) [g/mol] | Stabilized [with BHT] |
|---|---|---|---|---|
| medium-molecular-weight Oppanol ® | | | | |
| B 10 SFN | 0.01 | 27.5-31.2 | 40 000 | No |
| B 10 N | 0.01 | 27.5-31.2 | 40 000 | Yes |
| B 11 SFN | 0.01 | 32.5-36.0 | 49 000 | No |
| B 12 SFN | 0.01 | 34.5-39.0 | 55 000 | No |
| B 12 N | 0.01 | 34.5-39.0 | 55 000 | Yes |
| B 13 SFN | 0.01 | 39.0-43.0 | 65 000 | No |
| B 14 SFN | 0.01 | 42.5-46.4 | 73 000 | No |
| B 14 N | 0.01 | 42.5-46.4 | 73 000 | Yes |
| B 15 SFN | 0.01 | 45.9-51.6 | 85 000 | No |
| B 15 N | 0.01 | 45.9-51.6 | 85 000 | Yes |
| high-molecular-weight Oppanol ® | | | | |
| B 30 SF | 0.005 | 76.5-93.5 | 200 000 | No |
| B 50 | 0.002 | 113-143 | 400 000 | Yes |
| B 50 SF | 0.002 | 113-143 | 400 000 | No |
| B 80 | 0.002 | 178-236 | 800 000 | Yes |
| B 100 | 0.002 | 241-294 | 1 110 000 | Yes |
| B 150 | 0.001 | 416-479 | 2 600 000 | Yes |
| B 200 | 0.001 | 551-661 | 4 000 000 | Yes |

The reactive emulsion and/or treated recycled asphalt/concrete pavement aggregate mixture can be sprayed or poured on a prepared or unprepared pavement surface to be repaired. Upon contact with hot rock or pavement, the water present evaporates and the composition sets. Once set, the composition may be treated with electromagnetic radiation and then compacted by a vibrating roller while at or above 150° F. (66° C.) (or above 175° F. (79° C.), or above 200° F. (93° C.)) but below the 'blue smoke' threshold (typically >300° F. (149° C.)), preferably below 275° F. (135° C.), most preferably about 250° F. (121° C.). The resulting surface has a very low void density, a high resistance to heating and softening, and it has anchor points with a wearing core essentially that is bound into it that will not move if new pavement is placed on top. The compositions of various embodiments enable the densification (or reduction in voids percentage) to be dramatically improved, e.g., a pavement having 6-8% voids can be densified to a pavement having 5% or less voids, or even 4% or less voids, e.g., 2% to 2.5%, 3%, or 3.5% voids. A void percentage reduction of 1%, 2%, 3%, 4%, or 5% or more (e.g., a void percentage reduction of 1% would correspond to a densification of a pavement having 6% voids to one having 5% voids) is desirable; however, smaller reductions can also be advantageous. The life of the pavement is increased substantially upon improvement in densification.

Although dry, untreated aggregate (e.g. treated recycled asphalt/concrete pavement) can optionally be employed in the preparatory stage, and later combined with the reactive emulsion to yield a reactive emulsion and aggregate mixture, it can be advantageous to combine the reactive emulsion and aggregate (e.g. treated recycled asphalt/concrete pavement) into a mixture before applying to the aged (e.g., alligatored) pavement. In certain embodiments it can be desirable to pretreat the aggregate surface to form "anchor points" by coating with a water dispersible thermoset resin that has, in addition to the functional groups which selectively couple with the thermoplastic functionality discussed above, an independent, mid-morphology, pendulous functionality which bonds with a sufficiently improved strength to the specific rock chemistry being used in the final composition. Foremost, this dramatically improves binder adhesion to the stone binder interface, thereby reducing moisture susceptibility. It also assures that the film stays in place and does not prematurely slip laterally. A benefit in an application such as an interlayer primer is much higher compaction and thus a lower void density, i.e., improved resistance to oxidative, hydrocarbon embrittlement and ultimately a noticeably longer useful.

The emulsions, which can be reactive, exhibit superior properties when compared to conventional formulations. The superior properties can be in the areas of handling, storability, hazmat, curing characteristics, environmental considerations, chemical resistance, moisture susceptibility, sun resistance, tensile and flexural quanta, and anti-strip quanta. The compositions can be handled, stored and installed using conventional equipment. They can exhibit reduced hot mix asphalt (HMA) concrete void density. They can provide a novel way to restore microtexture to a pavement surface. They can exhibit improved water resistance and/or sun resistance. The compositions can provide the highest mechanical properties versus unit of cost, and are sustainable. The compositions reform and stabilize a broad range of weakness in asphalt and result in a substantially lower life cycle cost of pavement maintenance.

Figure 2A:
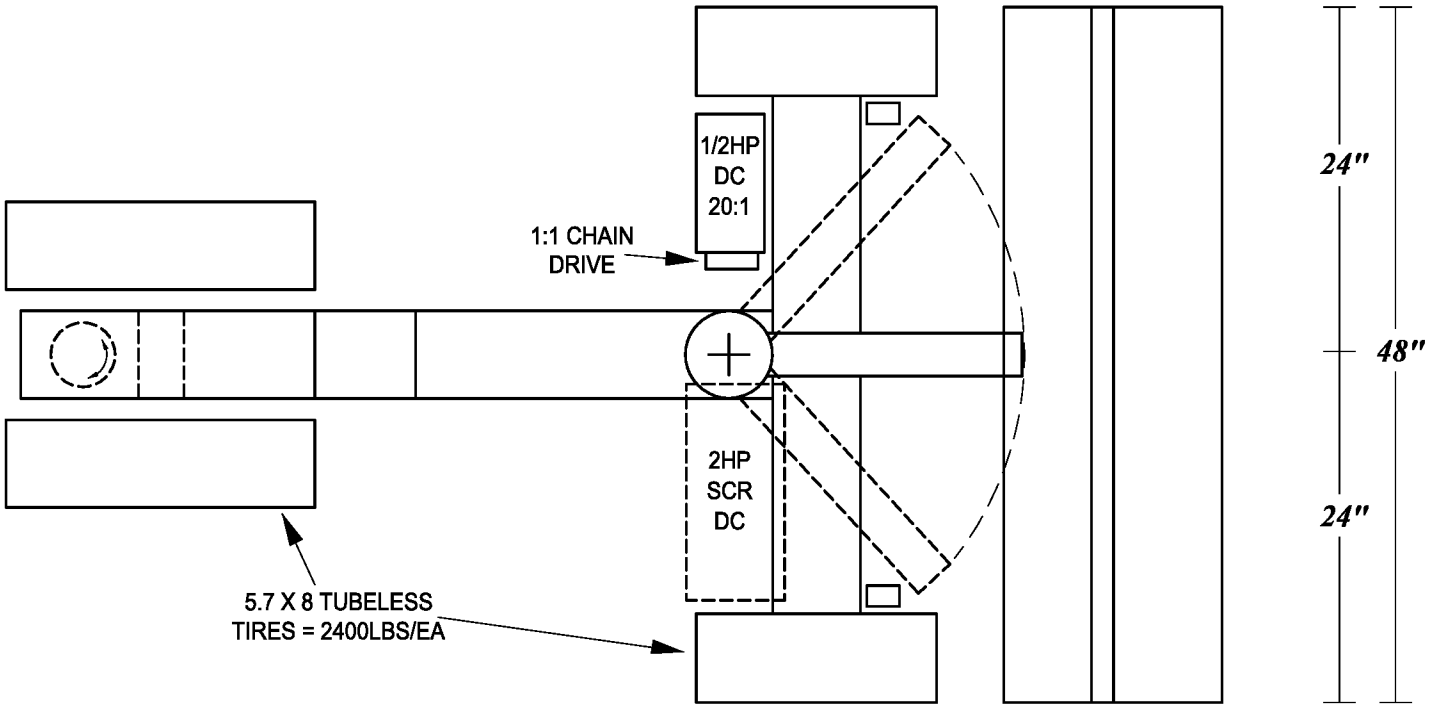
FIG. 2A (PRIOR ART)
FIG. 2A (not to scale) provides a top view of a prior art apparatus for applying aggregate and reactive emulsion to install a paving surface.
Figure 2B:
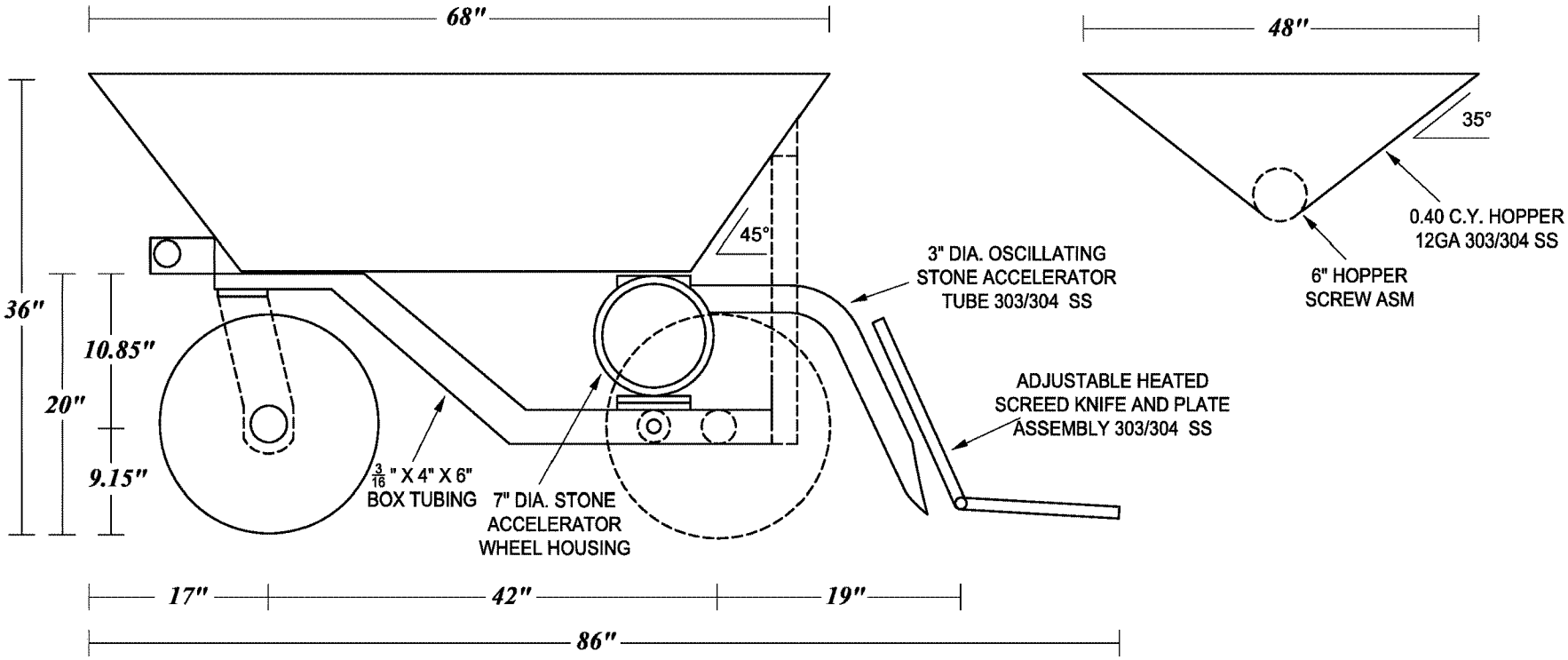
FIG. 2B (PRIOR ART)
FIG. 2B (not to scale) provides a side and front view of the prior art apparatus of FIG. 2A. An air pot adhesive tank is not depicted. Electric power and compressed air can be provided to the apparatus by a support unit, not depicted. The hopper is loaded with a heated aggregate, and the apparatus is configured to move at a speed of 20 feet per minute (6.1 meters per minute), with a maximum speed of delivery of aggregate of 75 feet per second (23 meters per second).
Figure 3:
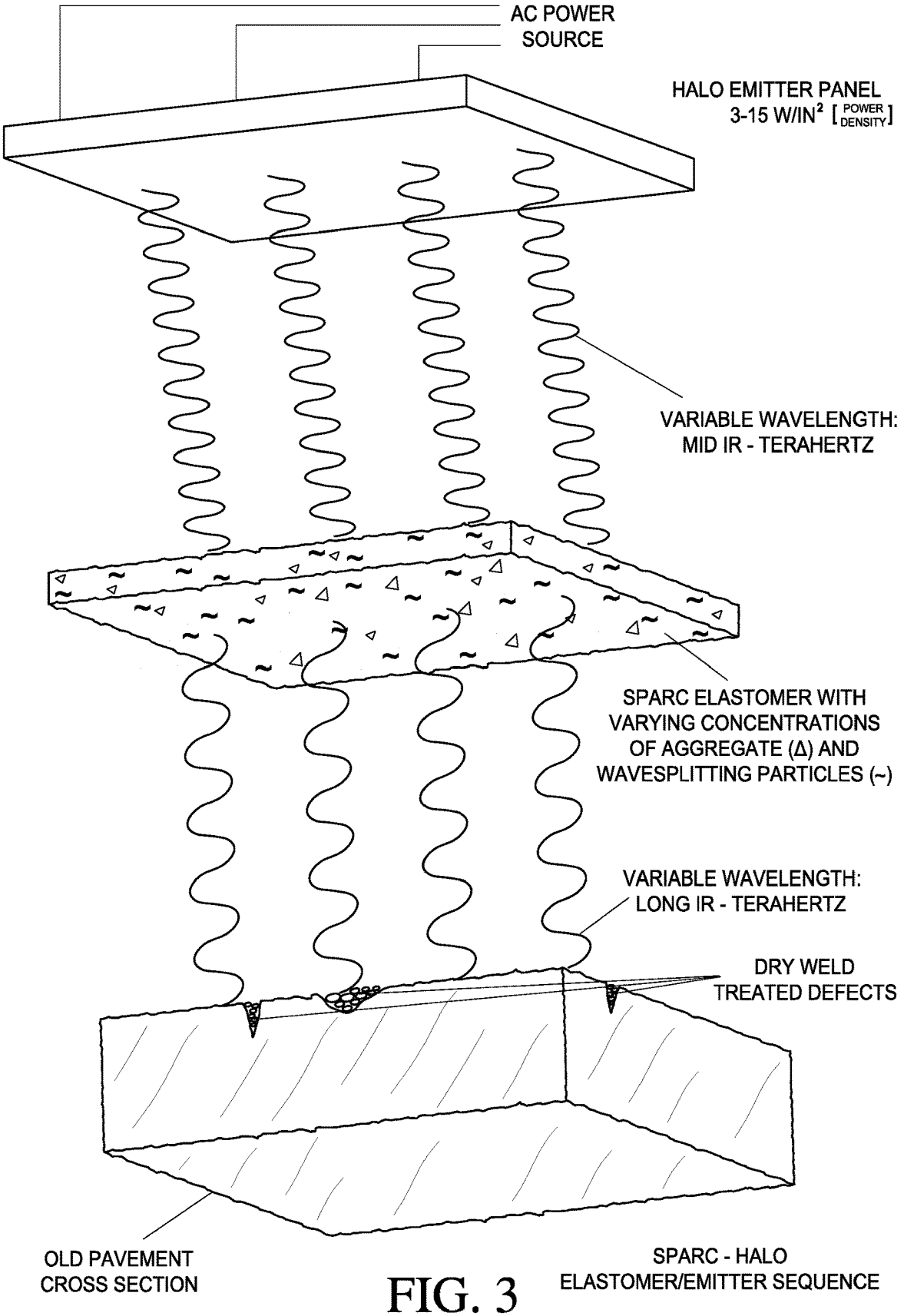
FIG. 3 (PRIOR ART)
FIG. 3 (not to scale) provides a schematic view of a prior art emitter of one embodiment employed in a system to cure a polymer modified asphalt emulsion and stone composite mixture over a damaged pavement.

FIG. 2A provides a top view of an apparatus for applying aggregate (e.g. treated recycled asphalt/concrete pavement) and reactive emulsion to paving surface to be repaired. FIG. 2B provides a side and front view of the apparatus of FIG. 2A. An air pot adhesive tank is not depicted. Electric power and compressed air can be provided to the apparatus by a support unit, not depicted. The hopper is loaded with a heated aggregate, and the apparatus is configured to move at a speed of 20 feet per minute (6.1 meters per minute), with a maximum speed of delivery of aggregate of 75 feet per second (23 meters per second).

Elastomer Coated Aggregate

In certain embodiments, after the aggregate has been placed and the reactive emulsion has been applied, optionally a thin layer (from about 0.125 inches (0.32 cm) or less to about 1 inches (2.5 cm) or more) of elastomer coated aggregate can optionally be either sprayed or spread across the surface of the pavement so as to provide a uniform surface and to fill in any other depressions that were not aggregate filled during the dry aggregate preparation stage.

Recycled Asphalt/Concrete Pavement Mixture

As set forth in the technical specifications of the International Slurry Surfacing Association (ISSA), there are three classes of slurry: Type I, Type II and Type III. Each type is directed to particular stone gradations, and each limits the minimum and maximum spread rates expressed as pounds per square yard. An aggregate mixture (e.g., in a form of a slurry or in a form of a mass of coated stone) can be mixed in a truck on-site and are prepared using an aggregate (conventionally, a pre-graded, virgin stone acquired from a rock quarry) and an asphalt emulsion supplied in a ready-to-use form from an emulsion producer. The aggregate is typically placed in a truck-mounted bulk-hopper, which is emptied at a regulated mass per-unit-of-time by a variable speed augur or belt into a pug mill. Simultaneously, a metered amount of asphalt or asphalt emulsion is sprayed into the pug mill and potable or nonpotable water is metered as well, whereupon the pug mill mixes the three ingredients to yield a predetermined texture. The compounded material exits the pug mill by gravity feed into a screw conveyor, which dumps it into a spreader box that is dragged behind the truck at a fixed speed. An on-board operator sits at the rear of the truck and makes adjustments to the mix to maintain adherence to a short list of handleability criteria; however, the aggregate to emulsion ratio is pre-calibrated for the physical properties of the stone and emulsion.

Type I slurry is typically 8-9 lbs/square yard (4.3-4.9 kg/m$^3$) with a (wet) asphalt content of approximately 18-20% by weight and a cured surface thickness of 0.125 inches (0.32 cm). Type II slurry is typically 12-16 lbs/square yard (6.5-8.7 kg/m$^3$) with an asphalt emulsion content of approximately 11-13% by weight and a cured surface thickness of 0.25 inches (0.63 cm). Type III slurry is typically 18-25 lbs/square yard (9.8-13.6 kg/m$^3$) with asphalt emulation content at approximately 10% by weight and a cured surface thickness of from 0.375 inches (0.95 cm) to 0.5 inches (1.27 cm). The emulsions typically have a residue content of 59-64% by weight and employ a slow set (SS), medium set (MS) or quick setting (QS) emulsifier (e.g., anionic slow set (ASS), cationic slow set (CSS), anionic medium set (AMS), cationic medium set (CMS), anionic quick set (AQS), or cationic quick set (CQS). The final compounded slurry typically has a solids content of 70-78% by weight, which requires the evaporation of substantial amounts of water before the slurry becomes drivable. Emulsion droplet suspension mostly depends upon the repelling forces of a common charge in the fluid (continuous phase) and on the surface of the suspended phase. Anionic (electronegative charge) is observed in a pH range of 9.0-12.0 using sodium hydroxide (NaOH) as a basifying agent and cationic (electropositive charge) is observed in a pH range of 1.5-3.0 using hydrochloric acid (HCl) as an acidifying agent. Other bases (e.g., alkali metal hydroxides or alkaline earth metal hydroxides such as LiOH, KOH, RbOH, CsOH, $Ca(OH)_2$, $Sr(OH)_2$, and $Ba(OH)_2$) and acids (such as mineral acids including HI, HBr, $HClO_4$, $H_2SO_4$, and $HNO_3$) can also be employed. Cationic versions are generally preferred on the basis of compatibility with common types of stone, curing environment, and availability. Some emulsion specifications require rubber latex to be added to the emulsion to improve adhesion and flexibility.

Conventional slurries typically employ virgin stone as the sole aggregate. As an alternative, recycled asphalt/concrete pavement (RAP) can be used as an aggregate. The term recycled asphalt/concrete pavement is used to describe the asphalt-containing rubble obtained from a pavement that has been recycled by taking up the pavement or paving material and comminuting it into a suitable aggregate size, e.g., by milling, grinding, or the like. The RAP typically comprises an asphalt and an aggregate. The aggregate can be rock, stone, cement, sand, or other solids, or can itself contain asphalt, e.g., it can be a previously recycled RAP rubble that has been reused as aggregate in an asphalt pavement. The asphalt is typically aged asphalt, e.g., when RAP is derived from an existing pavement that has been in use. In some instances, the asphalt can be fresh or virgin asphalt, e.g., unused hot mix or cold patch left over from another paving project that is later recycled for reuse. When recycled asphalt/concrete pavement is employed in conventional slurries, it is typically present at no more than 15% by weight of the aggregate mass (the remaining mass comprising virgin stone). Aggregate comprising recycled asphalt/concrete pavement is prepared by processing agglomerated road grindings through an impact crusher, then screening in the crushed grindings into gradations between #4 (collected on standard US #4 mesh having an opening of 0.157 inches (0.40 cm)), #8 (collected on standard US #8 mesh having an opening of 0.093 inches (0.24 cm)), #16 (collected on standard US #16 mesh having an opening of 0.0469 inches (0.119 cm)), #30 (collected on standard US #30 mesh having an opening of 0.0234 inches (0.594 cm)), #50 (collected on standard US #50 mesh having an opening of 0.0117 inches (0.297 cm)), #100 (collected on standard US #100 mesh having an opening of 0.0059 inches (0.0150 cm)) and 'pan' (remainder collected on pan after having passed through all meshes). Rock fines typically do not de-bond from the agglomerated road grindings, such that not much product is generated from RAP having a size below #16.

When aggregate comprising recycled asphalt/concrete pavement is blended with virgin stone, it results in weak points in the cured surface related to poor interlocking. The shear value of the old asphalt bond line is no more than 10% of the shear value of virgin aggregate, so the coating is further weakened under tire loads which can easily crush the recycled asphalt/concrete pavement clusters to friability. The adhesion of the fresh emulsion to the dusty, oxidized cleavage points on the recycled asphalt/concrete pavement are compromised as compared to virgin stone, leaving them vulnerable to failure under mechanical and moisture challenges. To minimize weakening, the amount of recycled asphalt/concrete pavement employed in conventional slurries is minimized (to no more than 15% by weight of the aggregate mass). Slurry or mixtures containing recycled asphalt/concrete pavement exhibits a slightly blacker color, and holds its color a few weeks longer than does slurry made solely from virgin stone. The principal value of using recycled asphalt/concrete pavement, however, is in the federal and state grants and tax credits given to the public agencies for using a recycled material.

To make recycled asphalt/concrete pavement a viable aggregate for use in slurry or other mixtures, it is subjected to a process of homogenization by liquid asphalt oligopolymerization by application of radiation having a preselected wavelength. Different application methods are contemplated. For example, stationary recycled asphalt/concrete pavement can be treated by a stationary emitter or a moving emitter. Alternatively, moving recycled asphalt/concrete pavement can be treated by a stationary or moving emitter. Stationary recycled asphalt/concrete pavement treated by a stationary emitter can be employed for batch treatment of recycled asphalt/concrete pavement spread over a suitable surface, e.g., a shallow pan. The treated contents of the pan can be tipped onto a conveyor belt, into a hopper, or into a storage pile. Alternatively, a moving emitter can pass over recycled asphalt/concrete pavement to be treated, e.g., spread over a shallow pan. A moving emitter and moving recycled asphalt/concrete pavement may be employed, e.g., in a towable apparatus for treating recycled asphalt/concrete pavement immediately after removal from an aged road or other asphalt/concrete pavement surface. For treating stockpiled recycled asphalt/concrete pavement, it is generally desirable to convey the pavement from the stockpile and through a stationary emitter array. The treated recycled asphalt/concrete pavement can then be restockpiled or further processed into asphalt slurry or other mixtures.

Recycled asphalt/concrete pavement agglomerates can range in size from #200 sieve (dust) up to 6, 7, 8, 9, 10 or more inches (15, 18, 20, 23, or 25 cm) in diameter. Recycled asphalt/concrete pavement in unscreened form (e.g., particle sizes from approximately 10 inches (25 cm) or more where the source pavement is in complete failure down to agglomerated particles having a size of approximately 0.125 inches (0.32 cm) along with asphalt dust and dirt from the source road installation) is typically obtained by a cold milling process. In the cold milling process, water can be employed on the grinding head as a cooling fluid and to minimize construction site air contamination.

A frame, pipe, tunnel or other structure is provided which incorporates one or more emitter panels as described herein. In one embodiment, a belt conveying a layer of recycled asphalt/concrete pavement, e.g., 1-4 inches (2.5-10 cm) or 2-3 inches (5-8 cm) thick, with a width determined by the width of the belt and the width of the emitter array (e.g., 1 foot (30 cm), 2 feet (61 cm), or 3-6 feet (91-183 cm) or more) passes beneath a planar emitter array. In certain embodiments, an emitter can be provided below the conveyor belt, or both above or below the conveyor belt. The conveyor belt is preferably fabricated (either by construction or by material) as to be transmissive to most of the radiation generated by emitter. The speed at which the recycled asphalt/concrete pavement passes by the emitter is selected such that sufficient radiation is transmitted to the recycled asphalt/concrete pavement so as to achieve freeing of aggregate-micro-shoreline-bound-asphalt and aggregate-pore-stored-asphalt. A slow passage rate can be employed when one emitter is used, or higher throughput can be obtained by positioning two or more emitters in series.

In another embodiment, two or more emitters are arranged facing each other in an angled configuration (e.g., 90 degrees, or in a range of 60 degrees to 120 degrees) that can accommodate passage there through of a windrow of recycled asphalt/concrete pavement feedstock (e.g., 12 inches (30 cm) high at the peak (or from 6 to 18 inches (15 to 46 cm) or 8 to 14 inches (20 to 36 cm) high at the peak) by 30 inches (76 cm) wide at the base (or from 15 to 45 inches (38 to 114 cm) or 20 to 40 inches (51 to 102 cm) wide at the base)). The windrow can be made directly behind the cold milling equipment or can be hauled from the milled asphalt/concrete pavement site and placed in a stock pile from which it is fed by a belt to the emitter tunnel. An advantage of the tunnel configuration is that radiant energy from the emitters can be contained or sealed from air crosscurrents. In a tunnel configuration, less than approximately 50% of the same modulated waveforms at the same watt density are needed to saturate the recycled asphalt pavement rubble and to raise the binder temperature to 270° F. (132° C.) when compared to an open system (e.g., one or more emitter panels placed over the recycled asphalt/concrete pavement in a horizontal configuration with open sides).

A windrow having the above-referenced dimensions contains approximately 0.06 cubic yards (0.046 $m^3$) of recycled asphalt/concrete pavement per lineal foot (30 lineal cm). When a moving emitter tunnel passing over a stationary windrow, or a belt-fed windrow passing through a stationary emitter tunnel, is operated at 10 feet per minute (3 yards per minute), the tunnel will process about 33 tons (30000 kg) of recycled asphalt/concrete pavement per hour, which is the equivalent of one lane mile (1.6 lane km) of old asphalt/concrete pavement by one inch (2.5 cm) in depth over a ten hour shift.

Using a 10 feet per minute (3 yards per minute) process speed as a baseline, the ambient temperature (e.g., 75° F. (24° C.)) of the recycled asphalt/concrete pavement undergoes thermal eduction with a mass temperature rise of approximately 200° F. (93° C.), reaching a final temperature of approximately 250-290° F. (121° C.-143° C.) (e.g., 275° F. (135° C.)). This is achieved with a 50 foot long tunnel, utilizing a 500 kW, Tier 4 generator at (38 gallons diesel/hour) or power from a utility grid. The direct cost per hour is $3.50-4.50/ton.

In another configuration, one horizontal emitter is paired with two vertical emitters (or two vertical panels or other structures to provide walls one on each side), to form an inverted "U" shape tunnel. This tunnel configuration is advantageous for irradiation of a substantially flat layer of recycled asphalt/concrete pavement.

Figure 12:
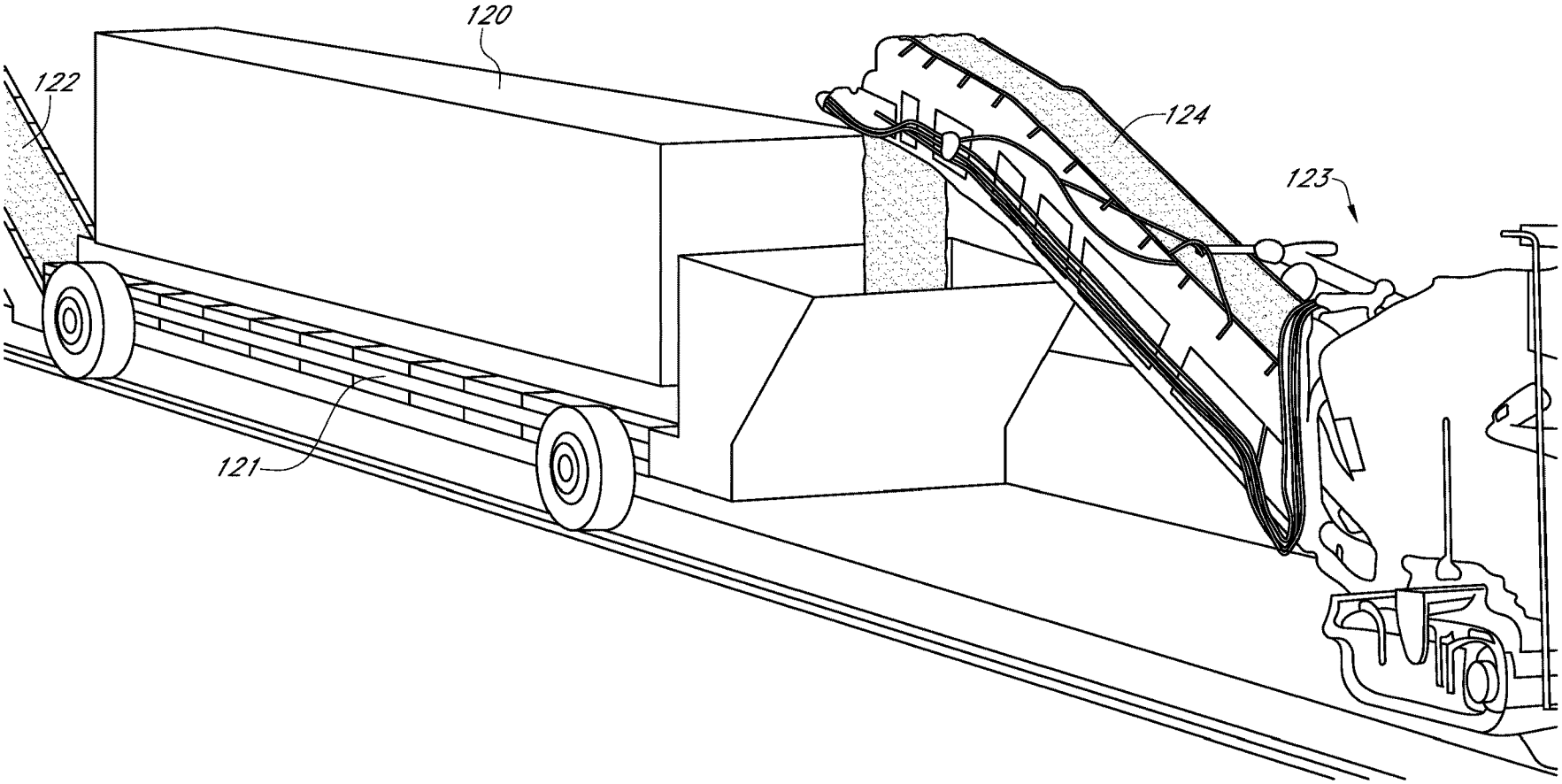
FIG. 12 is a schematic of a unit 120 utilized in preparing a one pass, cold milled 100% RAP bonded driving surface from cold milled RAP 124 obtained using a cold milling machine 123.

In another configuration, the recycled asphalt/concrete pavement is treated by application of radiation of four independently modulated wavelengths arranged to present a pulsed crossfire, which provides a sustained phonic momentum at the stone shoreline. Shown in FIG. 12 is a schematic of the Quadra, Pulse-Wave Electronics utilized in a mobile Wave~Bond tunnel (e.g., a 1,000 kW unit producing 130 tons/hr (120000 kg/hr) of treated recycled asphalt/concrete pavement) of this configuration. In this processing tunnel configurations, emitter panels are situated in a parallel configuration over and under a flow of recycled asphalt/concrete pavement rubble. The parallel emitter panels are preferably configured to be in close proximity to the feed of recycled asphalt/concrete pavement. For example, the emitter panels can be paired with minimal clearance from the feed, e.g., one panel directly under the belt carrying the feed (e.g., with less than one inch, less than 0.5 inches (1.27 cm), or less than 0.25 inches (0.63 cm) of clearance from the belt), and one panel directly over the feed (e.g., with less than one inch, less than 0.5 inches (1.27 cm), or less than 0.25 inches (0.63 cm) of clearance from the feed). The belt is preferably constructed of a material that is substantially transparent to the radiation, e.g., woven wire or other belts or conveying devices as are known in the paving industry. The emitter panels can be provided with suitable shielding or protection to prevent damage to the emitters as the feed passes between them, e.g., a protective metal mesh or screen. In one embodiment, a belt conveying a layer of recycled asphalt/concrete pavement, e.g., 1-4 inches (2.5-10 cm) or 2-3 inches (5-8 cm) thick, with a width determined by the width of the belt and the width of the emitter array (e.g., 1 foot (30 cm), 2 feet (61 cm), or 3-6 feet (91-183 cm) or more) passes beneath a planar emitter array. Each emitter panel is provided with two separate elements capable of emitting radiation of significantly different bandwidths, e.g., a first wavelength of from 5,000 nm to 50,000 nm (e.g., 10,000 nm to 12,000 nm) is emitted by one element in conjunction with a second wavelength of from 1,000 nm to 5,000 nm (e.g., 3,000 nm to 5,000 nm) emitted by another element. For pulsed radiation, the time between pulses can be selected based on band gap dissipation; however, a range of from 0.001 seconds to 0.30 seconds range can advantageously be employed; however, continuous radiation or intermittent radiation is also contemplated. In a pair of opposing emitter panels in a top over bottom configuration (parallel configuration), the pulses from a first panel can alternate or mimic in a delayed sequence to the opposing emitter panel; however, opposing emitter panels can also be configured to pulse radiation at the same time. The emitter is pulsed to keep the phonetic wave moving in a synchronous manner through the stone into the asphalt in such a manner so as to maintain a smooth phononic-to-acoustic transition at the asphalt-stone interphase. This minimizes the tendency for inverted waveform 'leakage' to occur back into the crystalline rock structure, which may partially disrupt the harmonics momentum associated with 'band gap' phononic transmission and ultimately the balanced energy-use-efficiencies of the device. The tunnel efficiently yields treated recycled asphalt/concrete pavement in an efficient manner, such that it can be employed as aggregate in a new, 1.5 inch (3.8 cm) thick rubberized road wearing surface having a lifetime of 20 years or more at similar cost as a conventional 0.375 (0.95 cm) thick slurry coating, which is a commonly employed pavement preservation system that lasts about 5 years with no structural relief from cracks and bumps.

A cost comparison can be made between a 40 mm thick rubberized hot mix asphalt pavement (Option 1) versus a conventional slurry coating (thin seal coat or slurry chip seal) (Option 2). Option 1, comprising a 40 mm new rubberized hot mix asphalt (HMA) surface, offers advantages of public safety, flow of commerce, vehicle preservation, and community well being (e.g., economic competitiveness, private property values and perception of quality of life) that are much superior to those offered by Option 2. Option 1, when prepared according to conventional methods, is substantially more expensive than Option 2. However, when prepared using the Wave~Bond pulse-wave electronics as described herein in conjunction with RAP, Option 1 can be implemented at about the same installed cost as conventional Option 2. Accordingly, the systems, methods, and materials described herein can offer a new, smooth, safe "perpetual" road (road lasting 40 years or more) having similar performance as conventional HMA road, but at the cost of a conventional thin seal coat or slurry chip seal.

Figure 13:
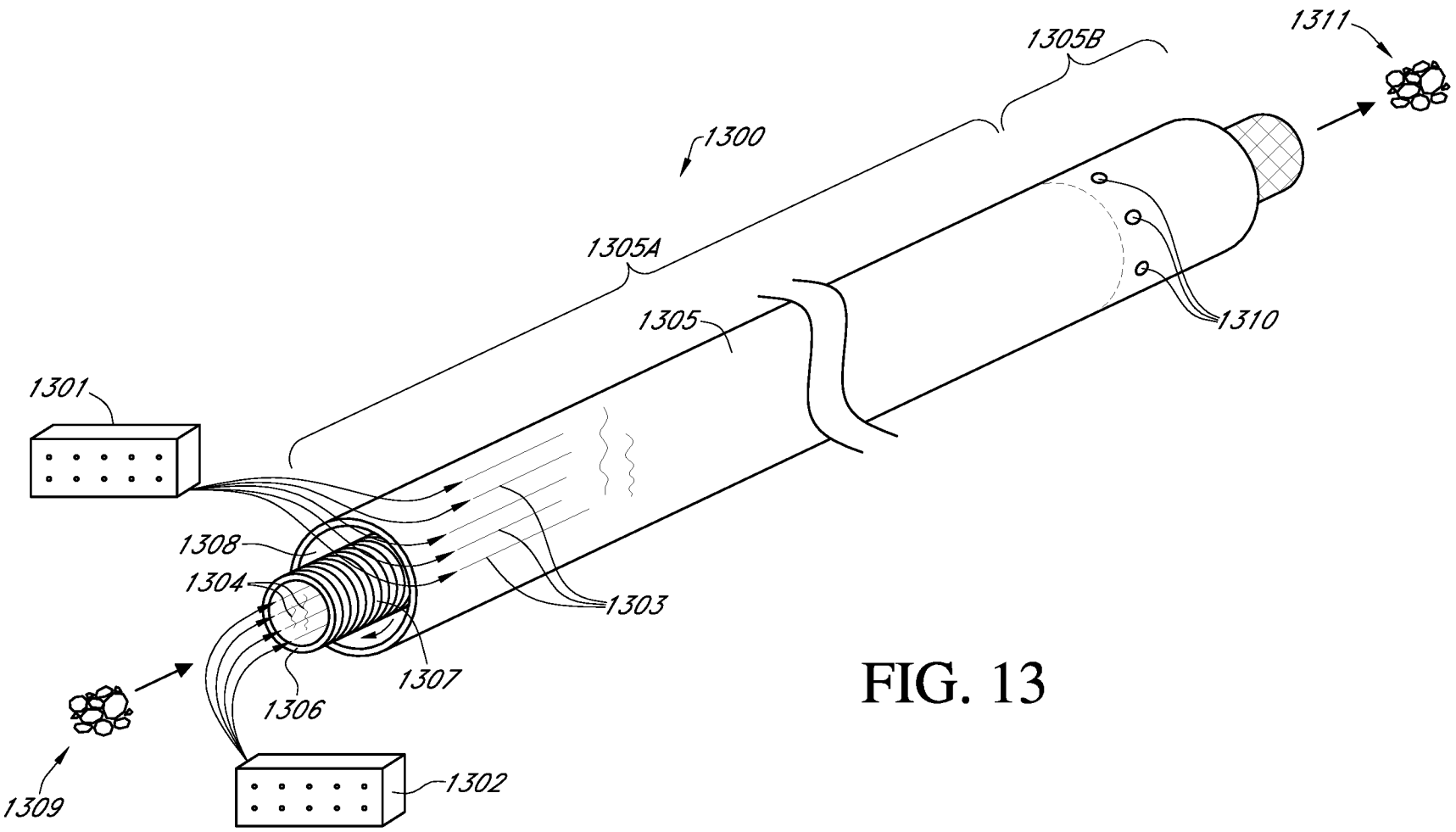
FIG. 13 depicts a tunnel configuration unit 1300 comprising concentric annular emitter panels.

In another configuration, two emitters are provided that are arranged in a concentric or coaxial configuration, as shown in FIG. 13. FIG. 13 depicts a tunnel configuration unit 1300 comprising concentric annular emitter panels. The tunnel has a modular configuration and is suitable for use in a central hot mix plant, a portable hot mix plant, or a mobile process plant. The annular RAP cavity volume holds approx. 2000 lbs (900 kg) RAP rubble compressed to approximately 18-25% air void density. The production rate is 5-22 tons/hr (4500-20000 kg/hr) at a 200° F. (93° C.) temperature rise. The components of the system include a variable controller (3ϕ, approx. 100 kW) for the outer ring of emitter elements 1303 and a variable controller (3ϕ, approx. 50 kW) for the inner ring of emitter elements 1303. The outer ring emitter elements 1303 are hard mounted to a steel barrel surface 1305 and the inner ring emitter elements 1304 are mounted in the interior of the rotor 1306 the rotor-auger unit. The emitter elements can be mounted laterally, longitudinally, concentrically, spirally, or any other suitable configuration relative to the axis of the barrel 1305 or the rotor 1307. The inner ring emitter elements 1304 are mounted on a fixed frame (not depicted) independent of the auger-rotor, but can be hard mounted on the interior of the rotor 1307 as well, with power transmitted through a slipring assembly to provide photonic-phonic and/or photonic-phononic coupling. The auger 1307 of the rotor-auger unit transports incoming cold RAP rubble 1309 into the RAP transport annular cavity 1308 (having a distance from the inner surface of the steel barrel 103 of approx. 3 inches (7.6 cm). The rotor-auger unit has a six inch diameter and a wetted area of approximately 6840 $in^2$ (44000 $cm^2$). It provides a full sweep feed/press to agitate flights of RAP rubble at variable speed through the annular cavity 1308. The annular cavity 1308 is defined on one side by the barrel 1305. The steel barrel has a first section 1305A of approximately 25 feet (7.6 meters) in length that provides pulse wave effusion, thermal pressure gradients, and RAP segregation. The barrel 1305 has a second section 1305B of approximately 5 feet (1.5 meters) in length that includes injection/mixing ports 1310, e.g., for a Solid Phase Auto Regenerative Cohesion (SPARC) binder, a polymer or mixture of polymers, other binders, asphalt, water, solvents, carrier fluids, or other materials. The injection system situated intermediate between the emitters of the major portions of sections 1305A and 1305B offers advantages in that it permits blending a pre-determined amount and/or type of fresh binder onto the activated but dipole blended old stone coating before it is allowed to re-normalize within the pores and rock shoreline. Otherwise, if irradiation were not provided in section 1305B, the stone would resist re-fluxing and blending with adhesive added thereafter. The barrel 1305 is fixed and has an approx. 12 inch (30 cm) diameter with a wetted area of approx. 13680 $in^2$ (88000 $cm^2$). The auger can include uniform flights; however, it advantageously can include separate segments that can be operated independently, so as to provide different rates of mixing and/or transportation of RAP through the cavity 1308. Advantageously, the auger in or adjacent to section 1305 includes at least one separate segment of mixing flights driving at a higher RPM where the finished RAP-hot polymerized mix 1311 ready for installation is discharged from the unit 1300.

Radiation is emitted into the annular space between the emitters, and an auger or helicoid rotor drives recycled asphalt/concrete pavement rubble through the annular space. In one embodiment, the emitter elements are hard mounted to a cylinder surface, e.g., a hollow cylinder or a solid cylinder, e.g., a barrel, pipe, or rotor, or bar, and can be fabricated from any suitable material (e.g., steel, another metal or alloy, a polymer, a ceramic, etc.). The emitter elements can be mounted laterally to the axis of the cylinder, longitudinally to the axis of the cylinder, or any other suitable configuration (e.g., spiral). Such configurations can provide substantially continuous photonic coupling. In the tunnel of FIG. 13, the tunnel is comprised of a fixed steel barrel having a 12 inch (30 cm) diameter and a 'wetted' surface area (area exposed to recycled asphalt/concrete pavement to be treated) of 13,680 $in^2$ (88000 $cm^2$). Emitter elements are mounted to the outside of the barrel, and emit radiation into the interior of the barrel. The fixed steel barrel comprises one emitter. In a concentric arrangement inside of the fixed steel barrel is a rotor/auger. The auger is 6 inches (16 cm) in diameter and has a hollow center. Emitter elements are mounted on the interior surface of the rotor/auger, or can be mounted on a fixed frame independent of the rotor/auger, e.g., in an inner void of the rotor/auger and not supported by the rotor/auger. When mounted to the rotor/auger directly, power can be transmitted through a slip ring assembly to provide photonic-phononic and/or phononic-phononic coupling. The rotor auger with emitter elements comprises another emitter panel. The rotor/auger has a 'wetted' surface area (area exposed to recycled asphalt/concrete pavement to be treated) of 6,840 $in^2$ (44000 $cm^2$). The auger can be configured with segments having different characteristics or operated at different speeds (e.g., higher revolutions per minute at the end wherein fresh binder is mixed with the recycled asphalt/concrete pavement rubble, and lower revolutions per minute where the rubble enters the tunnel), so as to mix flights. The recycled asphalt/concrete pavement is transported through the annular cavity between the fixed steel barrel and the rotor/auger. The annular cavity is approximately 3 inches (7.6 cm) across (distance from rotor auger exterior surface to interior surface of fixed steel barrel). Recycled asphalt/concrete pavement rubble is provided to the auger/rotor 'cold', e.g., at room temperature with no prior heating step applied; however, in certain embodiments it may be desirable to preheat the rubble. A full sweep of feed is pressed/agitated through the annular cavity by the rotor/auger, which can operate at a fixed speed or a variable speed. Each of the emitter panels (fixed steel barrel and rotor/auger) are provided with fixed or variable controllers. Variable controllers are preferably coupled to provide a pulse wave, as described elsewhere herein. The controller can be operated at 100 kW, to provide a watt density of 3 watts/in$^2$ (0.47 watts/cm$^2$) to the fixed steel barrel emitter panel, and at 50 kW, to provide a watt density of 3 watts/in$^2$ (0.47 watts/cm$^2$) to the rotor/auger. The fixed steel barrel has a length of 30 feet (9 meters). The first 25 feet (7.6 meters) of the fixed steel barrel emitter provide pulse-wave effusion to the recycled asphalt/concrete pavement rubble, resulting in thermal pressure gradients and segregation of particles within the rubble. Injectors are provided at a distance of 25 feet (7.6 meters) from the end into which recycled asphalt/concrete pavement rubble is fed. These injectors provide a binder or adhesive (e.g., an asphalt rubber binder, such as described elsewhere herein). In the final 5 foot (1.5 meters) section, the heated recycled/asphalt pavement rubble is mixed with the binder. Blending a predetermined amount of fresh binder onto the activated (treated) recycled asphalt/concrete pavement rubble while in the emitter tunnel and before it re-normalizes within the pores and shoreline of the rock in the rubble overcomes resistance to re-fluxing and blending with adhesive thereafter; however, in certain embodiments it may be acceptable to apply fresh binder before the recycled asphalt/concrete pavement rubble enters the annular cavity, or after it exits the annular cavity (e.g., before or after treatment). The mixture exiting the fixed steel barrel is ready for installation, e.g., as pavement. The design is useful in a central hot mix plant, a portable hot mix plant, in a mobile process plant, or in other such applications. The production rate for the design of FIG. 13 is approximately 15-22 tons/hour (14000-20000 kg/hour) at a 200° F. (93° C.) temperature rise. The annular cavity volume is such that it can hold approximately 2,000 lb. (907 kg) of recycled asphalt/concrete pavement rubble, where the rubble is treated (e.g., compressed) to an air void density of approximately 18-25%. A single emitter tunnel of this design is advantageously employed. The emitter tunnel may be sized up or down (e.g., 1.1, 1.2, 1.25, 1.3, 1.4, 1.5, 1.6, 1.7, 1.8, 1.9 or 2 or more times larger or smaller in one or more dimensions, e.g., length and/or width). The controllers can be resized as well, to provide energy of the desired watt density. Depending upon the amount of recycled asphalt/concrete pavement rubble to be treated, it can be advantageous to run multiple emitter tunnels in parallel, e.g., 2, 3, 4, 5, 6, 7, 8, 9, or 10 emitter tunnels or more. Emitters may also be run in serial configuration.

Figure 14:
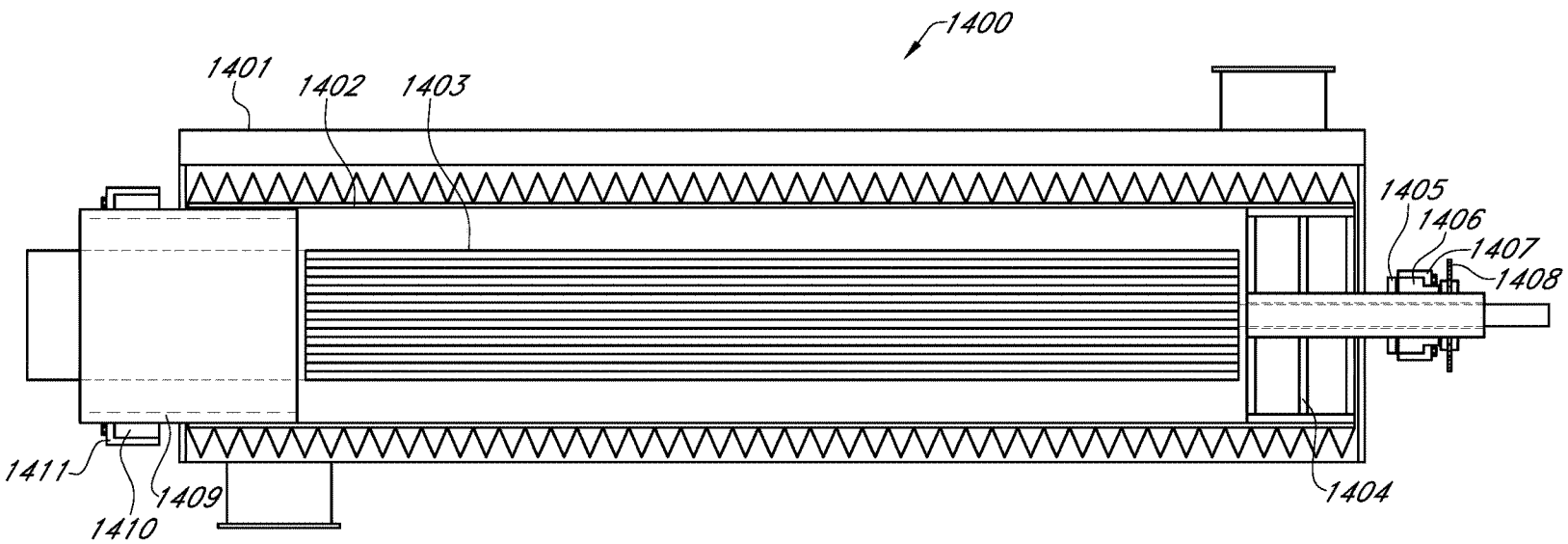
FIG. 14 depicts a helicoid reactor assembly.
Figure 15:
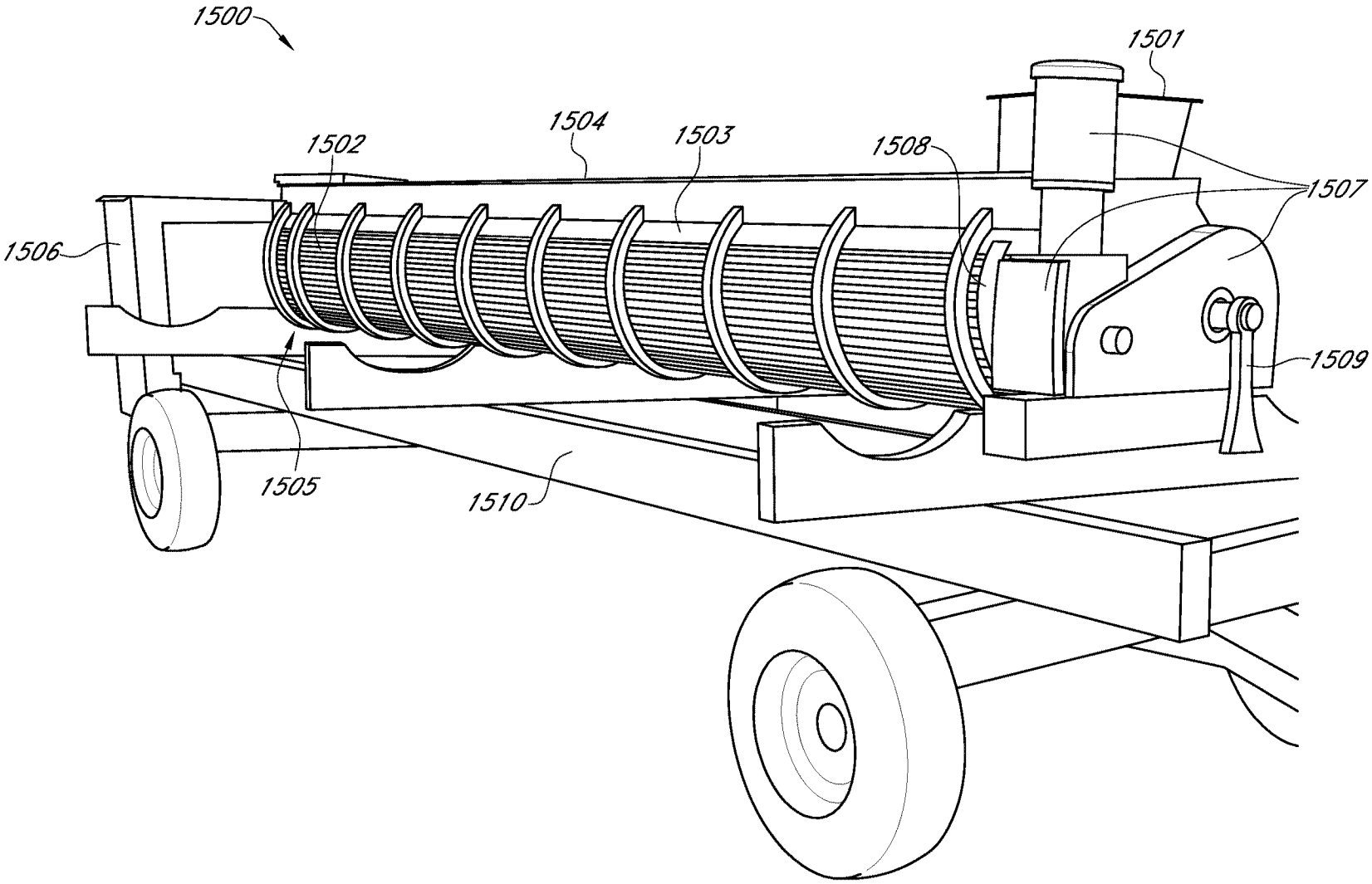
FIG. 15 depicts a mobile helicoid reactor assembly (including RAP Tunnel).
Figure 16:
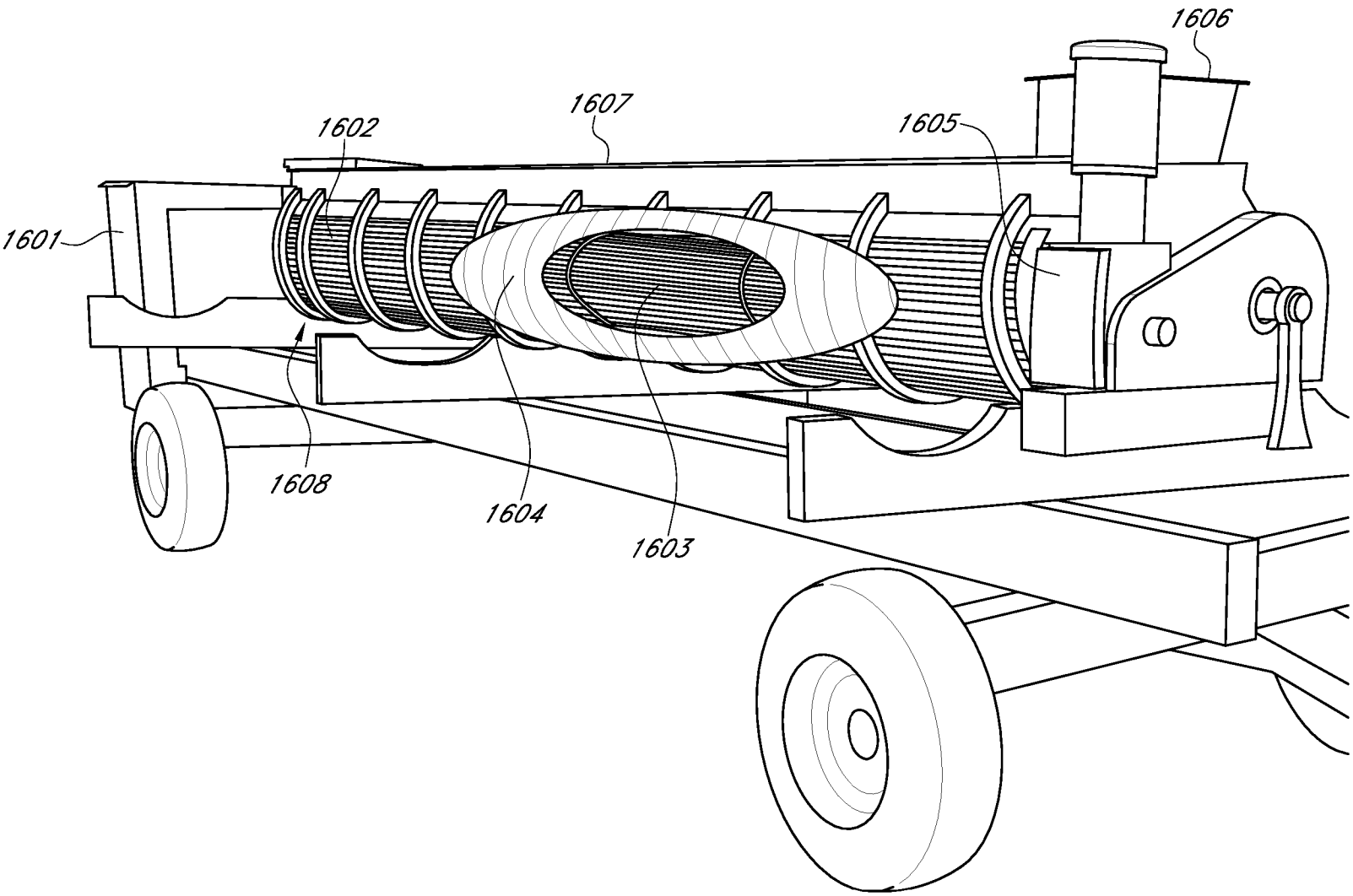
FIG. 16 provides a cut-away depiction of the mobile helicoid reactor assembly of FIG. 15.
Figure 17:
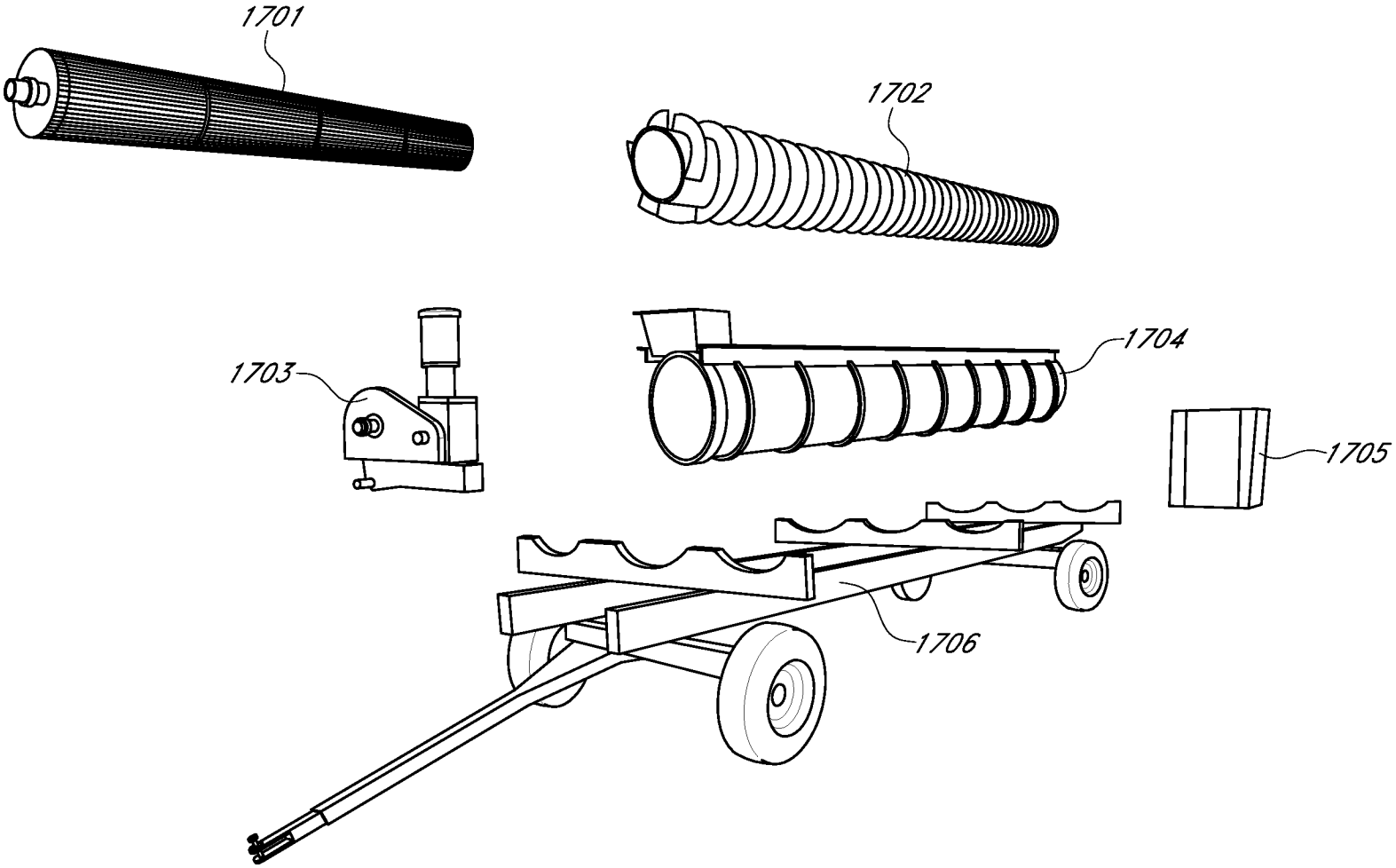
FIG. 17 provides a depiction of components of the mobile helicoid reactor assembly of FIG. 15.

FIG. 14 provides detail of an embodiment of a helicoil reactor 1400 (referred to herein as a "RAP tunnel"). The components include a 24 foot main reactor tunnel 1401 with pulse-wave electronics; a 20 inch (51 cm) helicoil rotor 1402; a coaxial cartridge core with pulse-wave electronics 1403; a drive hub assembly 1404; a shaft thrust collar/spacer 1405; a bronze oilite bearing 1406; a bearing housing/pillow block 1407; a sprocket/hub assembly 1408; an idler hub sleeve 1409; a bronze 932 bearing 1410; and a bearing housing 1411. The reactor can be incorporated into a mobile system 1500 as depicted in FIG. 15. The mobile reactor system 1500 includes an intake/feed chute 1501; external pulse-wave electronics 1502; a 24 foot (7.3 m) reactor tunnel 1503; a sampling port 1504; an outlet/discharge chute 1505; power and control electronics 1506; a 3 horsepower (2240 watts) drive with 124:1 gearbox 1507; an electronics junction box 1508; a coaxial cartridge support 1509; and a 15 ton (14000 kg) mobile platform with three reactor tunnel capacity 1510. FIG. 16 depicts a cutaway view of the mobile system of FIG. 15. The system is set-up for operation by programming power and control electronics 1601 for optimal throughput; bringing external tunnel electrodes 1602 and internal cartridge electrodes 1603 to resonant output; and activating the variable speed helicoid rotor drive 1605 to drive the rotor 1604. In operation, cold (i.e., ambient temperature) RAP rubble is fed through the intake chute 1606 and onto the helicoid rotor 1604 at a fixed rate; sample can be pulled through the sampling port 1607 to determine adequate thermal disintegration and fluxing progress has been obtained, adjusting the electronics and feed rate as necessary to achieve this, if needed; completely segregated and heated RAP is offloaded through the outlet chute 1608. Further processing can be performed, including and pugmill and SPARC or other adhesive or binder metering application (not depicted). The tunnel depicted in FIG. 16 has a dimension of 24 feet (7.3 meters) by 8 feet (2.4 meters) by 7 feet (2.1 meters) (length by width by height), a weight of 7500 lbs (3400 kg), a rotor volume of 2000 lbs. (907 kg), a maximum energy output of 162 kW, and a production rate of 16 tons/hr (14500 kg/hr). FIG. 17 depicts selected components of the system of FIG. 15, including the coaxial cartridge core with pulse-wave electronics 1701, the 20 inch (51 cm) helicoid rotor 1702, the 3 horsepower (2240 watts) drive with 125:1 gearbox 1703, the reactor tunnel with pulse-wave electronics 1704, power and feed control 1705, and the 15 ton (14000 kg) mobile platform with three rap reactor tunnel capacity 1706. The RAP tunnel can be employed to irradiate RAP rubble in any desired location and under any desired circumstances, e.g., treatment of a stockpile of RAP in a plant, treatment of RAP near a location to be paved, as part of a hot in-place recycling continuous train operation, or the like. In some embodiments, a planar emitter array (e.g., as depicted in FIG. 1) as described herein can additionally be passed over the freshly laid RAP-containing pavement as an optional step.

Figure 18:
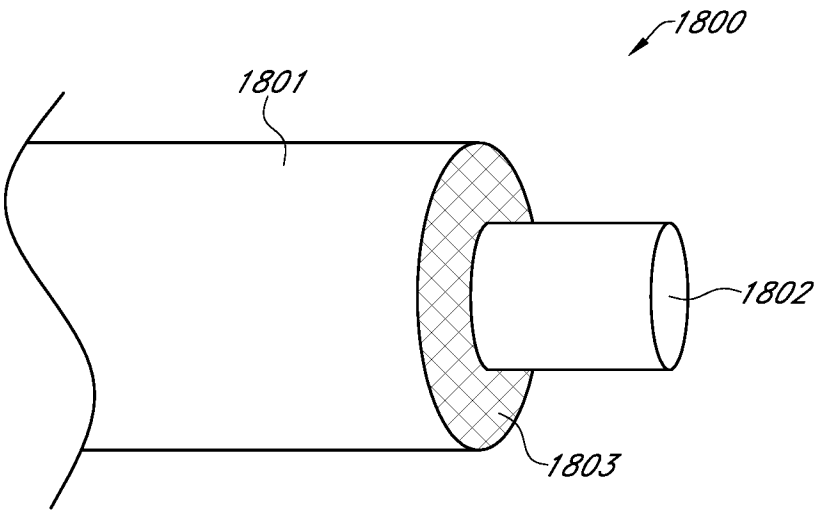
FIG. 18 depicts a cutaway view of an emitter electrode, including an 80/20 Chromolox resistance element, an MgO insulating filler, and an 840 Incoloy sheath of the emitter structure of FIG. 1.
Figure 19:
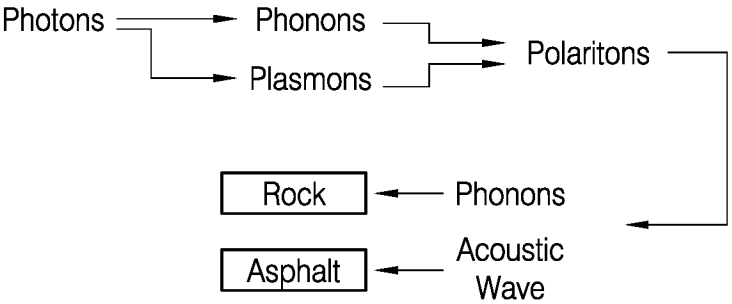
FIG. 19 schematically depicts the energy transfer wave dynamics observed for the RAP tunnel of FIG. 15.
Figure 20:
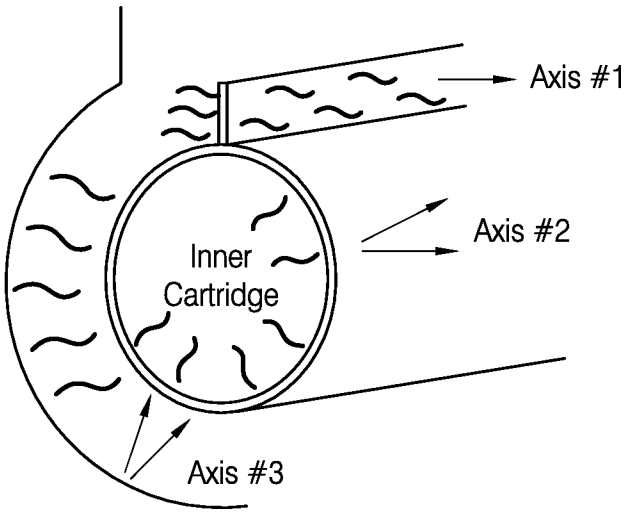
FIG. 20 depicts three axis radiation of RAP rubble from the electrodes of the outer shell (Axis #3), the inner cartridge (Axis 2), and from the helical flights (Axis #1).

The RAP tunnel of the mobile system of FIGS. 15-17 employs an emitter ("electrode") structure 10 as depicted in FIG. 1. A rotor 13 with helical flights rotates at 1-8 RPM, transporting RAP rubble 16 during irradiation. The RAP rubble is slowly rolled and grinded while being bathed by three axis irradiation. An outer shell 15 provides containment for the RAP rubble, while an external surface 17 of the shell supports electrodes that serve as emit radiation ("emitter"). In the embodiment of FIG. 1, the external surface 17 of the shell 17 supports sixteen sets of 3ϕ 480V electrodes that typically operate at 5500 Watts each to emit a variable wavelength. Three of the supported electrodes, 14L1, 14L2, 14L3 are specifically identified in the figure. The total energy (or irradiation) emitted at peak power is 88 kW. Each of the electrodes (including electrodes 14L1, 14L2, 14L3) on the external shell depicted in FIG. 1 is 18 feet (5.5 meters) long and is in a linear configuration. Other configurations for the electrode are contemplated, e.g., serpentine, curved, coiled, dots, mesh, grid, or other shapes, and can be fabricated from wire, strips, screen printed shapes, or other shapes. The outer shell can be configured with a ∪-shaped configuration along a cross-section perpendicular to the axis as in FIG. 1 (e.g., an open configuration with a portion curved and one or two portions flat), or a partial cylindrical configuration along a cross-section perpendicular to the axis (e.g., a ∪-shaped configuration or other partial cylindrical configuration with a longitudinal portion removed), or an O-shaped configuration along a cross-section perpendicular to the axis (i.e., fully enclosed cylindrical). The configuration can be uniform along the length of the outer shell, or can be varied. For example, an enclosed configuration can be provided along much of the length of the outer shell, with a portion of the outer shell provided with a ∪-shaped or ∪-shaped configuration to permit sampling of the RAP as it passes through the unit. These or any other suitable configurations can be employed that maintain the RAP rubble within a space between the rotor and the external shell. Situated within the hollow core of the rotor is a stationary internal cartridge 18. The internal cartridge supports nineteen sets of 3ϕ 480V electrodes that typically operate at 5500 Watts each to emit a variable wavelength. Three of the supported electrodes, 12L1, 12L2, 12L3 are specifically identified in the figure. The total energy (or irradiation) emitted at peak power is 104.5 kW. As depicted in FIG. 18, the electrodes 1800 (emitters) comprise an 80/20 Chromolox (nickel/chromium) resistance element 1802 as a core surrounded by an MgO (magnesium oxide) electrical insulating, thermally conductive filler 1803 covered by an 840 Incoloy (a high temperature corrosion alloy steel) sheath 1801. Other materials are contemplated for the resistance element, as are known in the art, e.g., platinum, molybdenum disilicide, silicon carbide, and iron-chromium-aluminum alloys, and the like, as are insulating materials (e.g., ceramics, glass, etc.) and sheaths (typically steel, titanium, or other metal alloys). FIG. 19 schematically depicts the energy transfer wave dynamics involved in heating RAP, as depicted in detail in FIG. 11. The three axis energy provided to the RAP by the RAP tunnel is observed to be 5 times more efficient at processing RAP than flat panel technology (an emitter emitting radiation in only one direction). The three axis irradiation generated in the RAP tunnel is depicted schematically in FIG. 20.

Recycled asphalt/concrete pavement can comprise as much as 35% by volume air void content. By compressing the recycled asphalt/concrete pavement prior to treating, e.g., using a roller and compression shoe at the loading point, air void content can be reduced by a significant amount, e.g., to about 15% of the volume, in the compressed mass of recycled asphalt/concrete pavement. This results in enhanced phononic activity, which in turn results in a more complete disintegration per unit energy consumed/absorbed by the recycled asphalt/concrete pavement. An added benefit of compression is to smooth the surface topography, enabling the emitter to be placed closer to the compressed mass of recycled asphalt/concrete pavement, to even further enhance phononic activity. The compressed mass of recycled asphalt/concrete pavement can be in the form of a loaf, a sheet, or a ribbon. The dimensions (length, width, height) of the compressed mass can be selected to form a close fit between the compressed mass and the emitter surface, e.g., a spacing of <1 inches (<2.5 cm), or <0.5 inches (<1.3 cm), or <0.25 inches (<0.64 cm) between a surface of the compressed mass and an adjacent emitter surface so as to enhance phononic transmission and minimize loss of energy via reflectance and/or refraction by the compressed mass surface.

Figure 21:
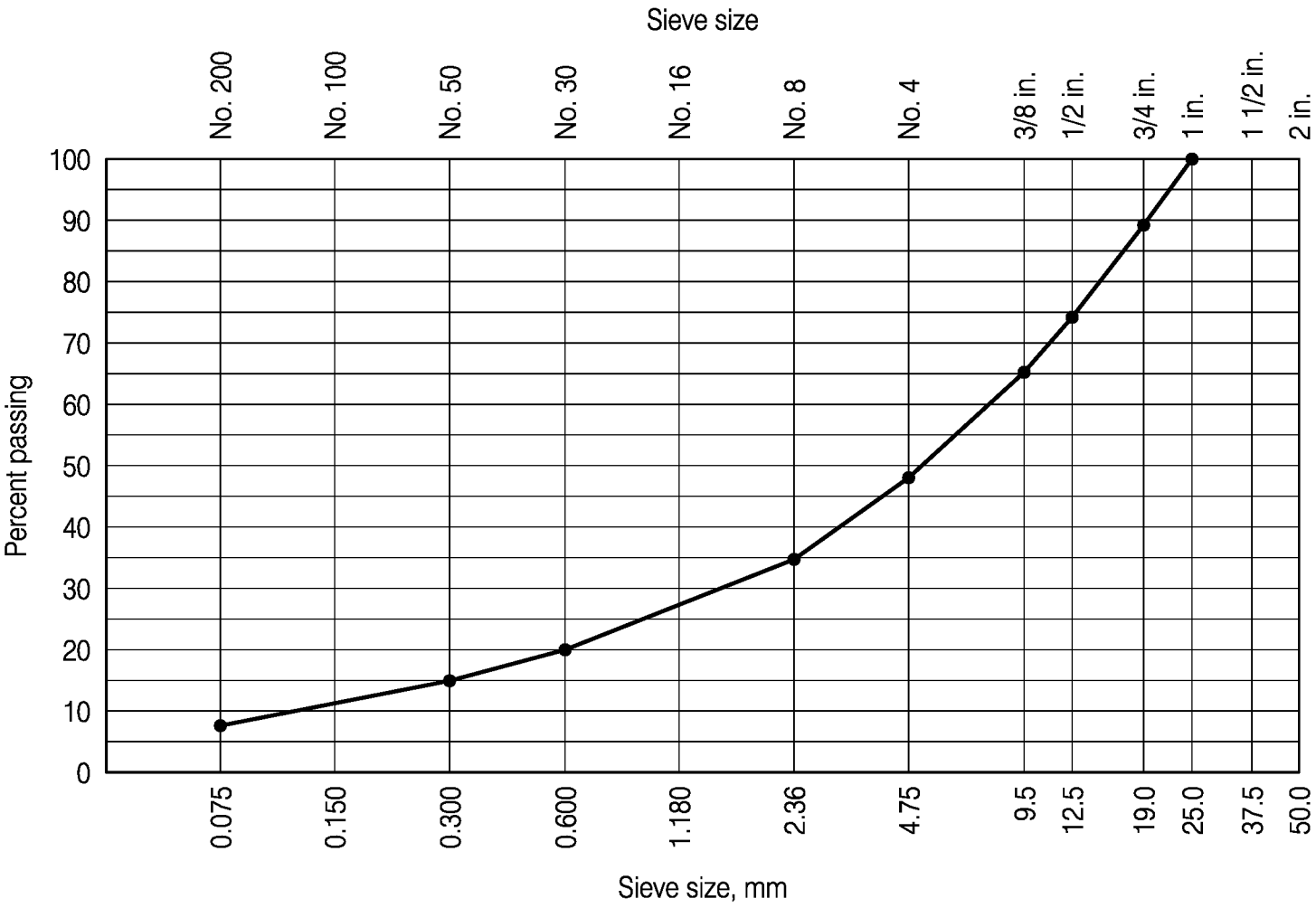
FIG. 21 is a graph depicting gradations of particulate matter, with percent passing of particles as a function of sieve size.

Most dense graded asphalt concrete pavement includes nine gradations at a relative mass that falls along a 45° curve (see FIG. 21). After treatment and at a binder temperature of approximately 250-290° F. (121° C.-143° C.), the nested clusters of the irradiated recycled asphalt/concrete pavement are easily shaken or wire segregated into greater than 95% individual moieties—similar to that observed for the corresponding virgin aggregate. By virtue of the modulated emitter bandwidth the asphalt is heated ahead of the aggregate, thereby undergoing dipole mixing as well as stone pore eduction during expansion. This "popcorn-effect" causes the recycled asphalt/concrete pavement to completely de-agglomerate and, upon cooling, will remain so such that as it need not be processed through a crusher but only a vibratory screen. Recycled asphalt/concrete pavement feedstock from dense-graded Hot Mix Asphalt (HMA) installations yields stone-mass gradations very similar to that prescribed by Federal Highway Administration under the 0.45 Power Gradation Curve standard. At this point, an aggregate containing 100% of recycled asphalt/concrete pavement can be utilized within an ISSA gradation standard.

TABLE 2

Fine- and Coarse-Graded Definitions for Dense-Graded HMA

| Mixture Nominal Maximum Aggregate Size | Coarse-Graded Mix | Fine-Graded Mix |
|---|---|---|
| 37.5 mm (1.5 inches) | <35% passing the 4.75 mm (No. 4 Sieve) | >35% passing the 4.75 mm (No. 4 Sieve) |
| 25.0 mm (1.0 inch) | <40% passing the 4.75 mm (No. 4 Sieve) | >40% passing the 4.75 mm (No. 4 Sieve) |
| 19.0 mm (0.75 inches) | <35% passing the 2.36 mm (No. 8 Sieve) | >35% passing the 2.36 mm (No. 8 Sieve) |
| 12.5 mm (0.5 inches) | <40% passing the 2.36 mm (No. 8 Sieve) | 40% passing the 2.36 mm (No. 8 Sieve) |
| 9.5 mm (0.375 inches) | <45% passing the 2.36 mm (No. 8 Sieve) | >45% passing the 2.36 mm (No. 8 Sieve) |

When recycled asphalt/concrete pavement is heated in an oven at ambient temperatures of approximately 400° F. (204° C.), deagglomeration as for recycled asphalt/concrete pavement treated with irradiation according to the embodiments is not observed, even after as much as 30 minutes at similar watt density. Nearly all energy in an oven is radiant and very broad in wavelength, leading to slow uptake and predictable energy absorption by both the stone and the binder. Little, if any, binder expansion occurs ahead of stone heating in an oven, in comparison to irradiation by the methods of the embodiments. Predominantly photonic (radiant) energy ("two spin states", two axis) transmission at the surface of the recycled asphalt/concrete pavement in an oven deprives the tightly bound clusters of a phononic ("three spin states", three axis) elastic wave, which, together with a focused peak wavelength, serves to flux the otherwise sterically hindered binder from the aggregate shoreline (microtexture). The aggregate shoreline (surface area) may range from a few square feet to over one hundred square feet/gram of stone mass.

By employing homogenization by liquid asphalt oligopolymerization treatment on recycled asphalt/concrete pavement, all of the disadvantages to employing recycled asphalt/concrete pavement directly from a cold milling process into a mixture are avoided. Hot mix plant applied asphalt characteristically provides a superior bond to virgin aggregate than an ambient cured emulsified asphalt. However, the homogenized asphalt on the recycled asphalt/concrete pavement subjected to treatment provides a far superior bond to the stone than is achieved in a conventional hot mix production. Accordingly, treated recycled asphalt/concrete pavement provides a basis for even better performance of a paving mixture than could otherwise be achieved using virgin stone/asphalt.

Prior to adding a polymer to the aged asphalt coating of the treated recycled asphalt/concrete pavement, which has been thermally educted by dipole agitation from the approximately 100 μm thick layer and rock pores of the aggregate, near deagglomeration is achieved to avoid leaving weak spots in the new installation due to poor nesting (honeycombing disuniformity), weak adhesive occlusions, or too high of an air void content. An elastomeric binder can be selected to provide desired Strategic Highway Research Program (SHRP) grading requirements, cure rate set time, project economics, incipient design anomalies (open graded friction course, overloaded road, ponding-freezing-shoving), and the point of processing. An elastomeric binder can be selected from waterborne forms, cutback with volatile organic compounds, or 100% solids reactive binders.

Binder of treated recycled asphalt/concrete pavement, when subjected to Dynamic Shear Rheometer (DHR) testing shows one or two grades lower, indicating improved ductility as compared to binder of an untreated recycled asphalt/concrete pavement (testing performed pursuant to the recycled asphalt/concrete pavement with binder first being solvent extracted). Poor-fluxing to no-fluxing of the recycled asphalt/concrete pavement binder when untreated by irradiation substantially limits the sliding lubricity of the thermoplastic and retains an unacceptably high air void content due to high surface friction between the coated stone surface due to quasi-viscous nature of asphalt. Macrotexture bound binder has a limited quality to roll during vibratory compaction. Limited flooding effect is associated with irradiation for thermal eduction from pores and asymmetrical expansion versus cold stone expansion require more binder to partially relieve sliding resistance. Moreover, too much binder to implement better lubricity can result in deformable and more expensive final design mix. Elastomer binder-augmented aged but homogenized asphalt (as in treated recycled asphalt/concrete pavement) has improved mixture potential, leading to better water resistance and anti-stripping properties during service life.

The treated recycled asphalt/concrete pavement is fully coated and ready for use in a slurry or other mix. Accordingly, asphalt emulsion need only be added to coat any virgin stone which has been added to augment the International Slurry Surfacing Association (ISSA) gradation specification. At this point in production, a binder additive as described herein can be integrated into the waterborne asphalt emulsion, which will activate the treated recycled asphalt's solid surface coating, thereby providing a cured, homogenous, interpenetrating adhesive bundling within the hybrid surfacing.

Material cost savings of more than 50% can be expected from a treated recycled asphalt/concrete pavement mixture or other mixture as compared to a conventional slurry design mix.

Testing protocols, such as the Wet Track Abrasion Test (WTAT) and the Cold Temperature Bending Test, as prescribed under the ISSA Standard, demonstrate that slurry coatings produced using the treated recycled asphalt/concrete pavements of the embodiments outperform the best previous conventional design mixes. The formulations of the embodiments described herein meet industry standards, e.g., as set forth in ISSA TB-106 (Measurement of Slurry Seal Consistency) and ASTM D3910 (Standard Practices for Design, Testing, and Construction of Slurry Seal). The following specifications as set forth by the ISSA are met, as provided in TABLE 3.

TABLE 3

ISSA Slurry Specifications

| TEST | ISSA TB NO. | SPECIFICATION |
|---|---|---|
| Mix Time @ 77° F. (25° C.) | TB 113 | Controllable to 180 Seconds Minimum |
| Slurry Seal Consistency | TB 106 | 0.79-1.18 inches (2.0-3.0 cm) |
| Wet Cohesion @ 30 Minutes Minimum (Set) @ 60 Minutes Minimum (Traffic) | TB 139 (For quick-traffic systems) | 12 kg-cm Minimum 20 kg-cm or Near Spin Minimum |
| Wet Stripping | TB 114 | Pass (90% Minimum) |
| Wet-Track Abrasion Loss One-hour Soak | TB 100 | 75 g/ft$^2$ (807 g/m$^2$) Maximum |
| Excess Asphalt by LWT Sand Adhesion | TB 109 (Critical in heavy-traffic areas) | 50 g/ft$^2$ (538 g/m$^2$) Maximum |

An additional benefit of using the treated recycled asphalt/concrete pavement of the embodiments is that the corresponding slurry or other mix can be applied with less water, e.g., 10% by volume to 70% by volume less water, e.g., 20% by volume, 30% by volume, or 40% by volume to 50% by volume or 60% by volume. Such reduced water mixtures containing treated recycled asphalt/concrete pavement fully cure to rain and turning traffic readiness in under one hour under standard application conditions with no proclivity to high temperature scuffing, in contrast to 24 hours for conventional slurry mixes. In certain embodiments, the treated recycled asphalt/concrete pavement slurries or other mixtures can optionally be installed at pavement temperatures down to freezing (0° C. or lower, e.g., −5° C., −10° C., −15° C., −20° C., −25° C., or −30° C. or lower) and be optionally forced cured with a emitter array, as described herein, to traffic-ready in minutes, thus extending the application window to nearly year round.

The methods of the embodiment for treating recycled asphalt/concrete pavement as described herein provide thermal-eduction to prepare recycled asphalt/concrete pavement for full use as a certifiably 'fresh', coated aggregate for all phases of road construction and maintenance. Conventional oven heating methods at ~400° F. (~204° C.) do not free either the aggregate-micro-shoreline-bound-asphalt or the aggregate-pore-stored-asphalt of the recycled asphalt/concrete pavement for integration into a re-vitalized surface binder. In contrast, the methods as described herein are capable of freeing this bound or stored asphalt, yielding a coated aggregate suitable for use in slurries or any other application that employs virgin aggregate.

Heating

In certain embodiments, it can be desired to heat an asphalt surface, such as a slurry or other mixture containing treated recycled asphalt/concrete pavement as described herein. Heating can be accomplished by conventional techniques, or techniques as described herein. In certain embodiments wherein an asphalt emulsion is applied to a pavement surface to be subjected to exposure to terahertz electromagnetic radiation, it can be desirable to heat the pavement surface prior to and/or after application of the asphalt emulsion, but before any subsequent application of terahertz electromagnetic radiation (e.g., to induce crosslinking). The emitters described herein can also be employed for treating the recycled asphalt/concrete pavement.

In the heating stage, electromagnetic radiation of a preselected peak wavelength is applied to the recycled asphalt/concrete pavement, or a pavement surface prior to and/or after application of an asphalt emulsion in order to heat the asphalt. The heating radiation can be generated using conventional techniques as described herein, or by modifying an emitter as in various embodiments to emit a desired wavelength. The wavelength of the electromagnetic radiation used for heating is selected based upon the aggregate and/or asphalt present. Preferred peak wavelengths for common materials are provided below. For example, granite rock is advantageously heated by applying electromagnetic radiation with a peak wavelength of from 3000-5000 nm. Sand, depending upon the composition, is advantageously heated by applying electromagnetic radiation with a peak wavelength of 3000 nm or from 5000-8000 nm. Limestone is advantageously heated by applying electromagnetic radiation with a peak wavelength of from 3000-4000 nm. Maltene asphalt is advantageously heated by applying electromagnetic radiation with a peak wavelength of from 1000-8000 nm. Asphaltene asphalt is advantageously heated by applying electromagnetic radiation with a peak wavelength of from 1000-3000 nm.

TABLE 4

| Peak Wavelength (nm) | Granite Rock | Sand | Limestone | Maltene Asphalt | Asphaltene Asphalt |
|---|---|---|---|---|---|
| 1000 | | | | X | X |
| 2000 | | | | X | X |
| 3000 | X | X | X | X | X |
| 4000 | X | | X | X | |
| 5000 | X | X | | X | |
| 6000 | | X | | X | |
| 7000 | | X | | X | |
| 8000 | | X | | X | |
| 9000 | | | | X | |
| 10000 | | | | X | |

In operation, the preselected wavelength is achieved primarily by the regulation of the surface temperature of the emitter element (the wavelength produced by the heat source is dependent upon the source temperature). This is achieved by adjusting the source(s) by which the surface temperature is achieved, and thus the peak wavelength, to match the spectral absorption rate of the material to be heated. This principle applies regardless of the construction of the heat source. By way of example, an Incoloy tubular heater, the resistance wire of a quartz heater, an FP Flat Panel heater or a Black Body Ceramic Infrared heater operating at 850° F. (454° C.) would all have the same peak energy wavelength of 4,000 nm (4 microns).

Two common methods of temperature control in infrared processes include varying the voltage input to the element and adjusting the amount of on-time versus off-time of the elements. A closed loop control system includes infrared sensors or thermocouples attached or integral to the energy source. These sensors or thermocouples monitor the temperature of the process and signal a control which, in turn, signals an output device to deliver current to (or turn of current from) the heat source.

With an established, preselected absorption rate strategy, the watt density, process time cycle and distance to pavement surface can be determined.

Figure 4A:
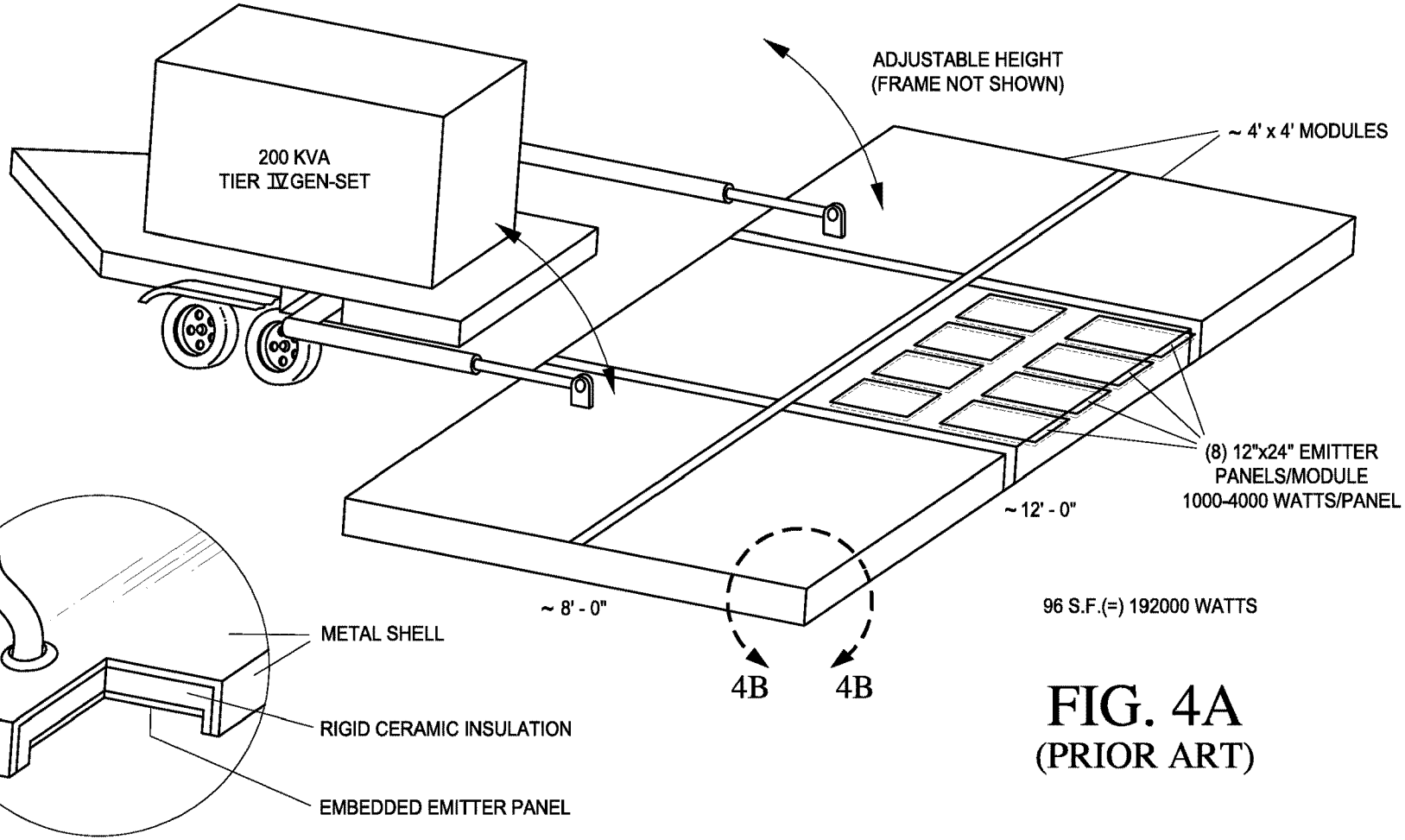
FIG. 4A (PRIOR ART)
FIG. 4A and FIG. 4B (not to scale) provide a schematic view of a prior art portable emitter device.
Figure 4B:
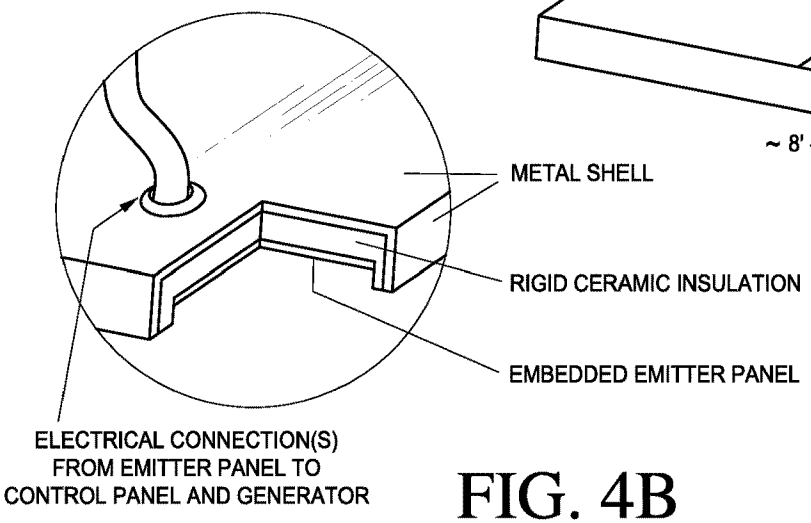
FIG. 4B (PRIOR ART)
Figure 5B:
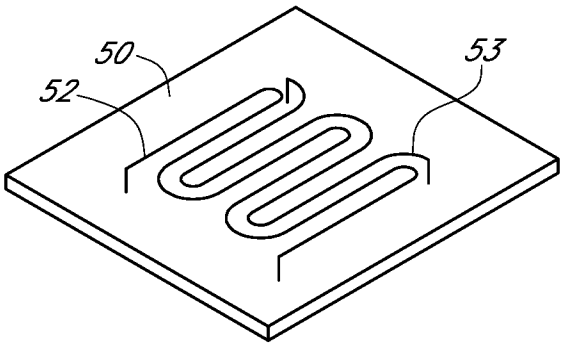
FIGS. 5A-5C (not to scale) depict various emitter panel configurations.
Figure 5A:
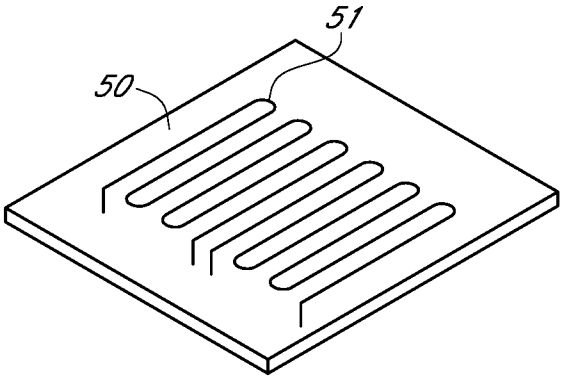
Figure 5C:
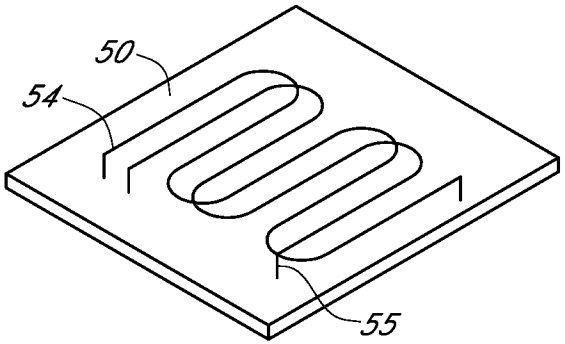
Figure 6:
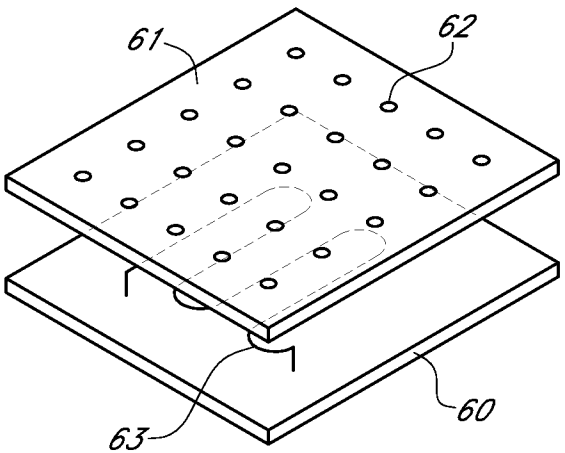
FIG. 6 (not to scale) depicts an emitter configuration including an emitter 63 on a shield 50 with a mica sheet 61 above, the mica sheet 61 being provided with a plurality of holes 52. Radiation passing through the material of the mica sheet 61 has a different wavelength than that passing through a hole 62 of the mica sheet 61.
Figure 7B:
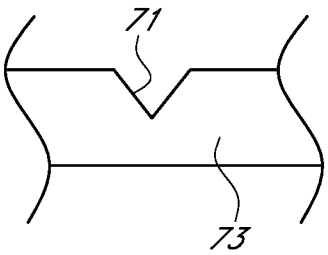
FIG. 7B depicts a cross section 63 of a void 61 of the shield of FIG. 7A.
Figure 7A:
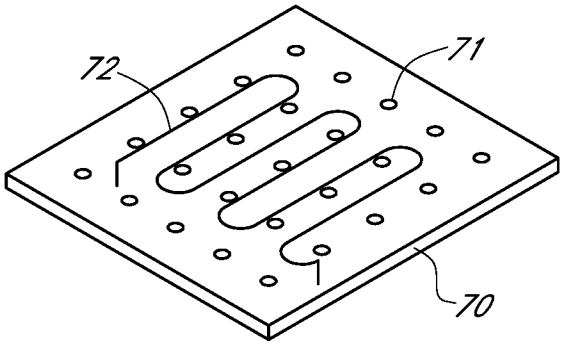
FIG. 7A (not to scale, perspective view) depicts a copper shield 60 provided with cone shaped voids 61 on the side adjacent to the emitter 62.

The heating electromagnetic radiation can be generated using emitter systems as described herein. In a preferred embodiment, an emitter system as depicted in FIG. 4A and FIG. 4B is modified to emit a suitable wavelength for heating. In this system, a series of easily removable emitter cartridges are mounted within a towable stainless steel frame. Surface temperature modulation can be achieved by one or more of: an AC power, waveform controller; cartridge design; voltage regulation; and an on-off power schedule. For example, IR heating cartridges can be swapped for terahertz emitting cartridges as desired.

As employed herein, "optimal pre-thermalization" (OPT) is defined as applying electromagnetic radiation of a preselected peak wavelength to a particular pavement cross-section, wherein the greatest temperature rise per unit of pavement mass is obtained for the lowest expended unit of energy during any time sequence when both parameters are being correlated. Pavement pounds/degree Fahrenheit rise/kilowatt hours expended (Pp/delta F/kwh) is the unit of measure of OPT.

Each cross-section of pavement has its own unique material and topographic characteristics. Tailoring the system to take advantage of these differences can be achieved by adjusting the bandwidth and the power density of the electromagnetic radiation so as to maximize radiation absorption for a given set of conditions.

As a first step, this is done by reference to tables which have been empirically developed by field experiments to classify absorbed wavelength quanta as it relates to: 1) stone petrography, 2) asphaltene/maltene content of the binder and 3) categories of average crack width×depth topography. This tool is referred to as an OPT Chart. See, e.g., TABLE 4. Most asphalt concrete pavement comprises about 95% stone and 5% binder by mass. Cracks in pavement can include those referred to in the industry as 'micro fissures', which are as narrow as approximately 0.004 inches (0.01 cm), to larger cracks up to approximately 3 inches (7.6 cm) in width. Below the dimensional range for micro fissures, the cracks are not easy to visibly detect without magnification. Above the dimensional range for larger cracks over 3 inches (7.6 cm), such cracks are typically beaten into potholes by wheel traffic. The systems of various embodiments are preferably employed for repairing pavement with cracks of about 3 inches (7.6 cm) in width, or less, e.g., 0.004 inches (0.01 cm) to 3 inches (7.6 cm), or 0.004 inches (0.01 cm) to 2 inches (5.1 cm), or 0.004 inches (0.01 cm) to 1 inches (2.5 cm), or 0.004 inches (0.01 cm)" to 0.5 inches (1.3 cm), or 0.004 inches (0.01 cm) to 0.05 inches (0.13 cm), or to any range between.

The emitter emits electromagnetic waves with a combination of horizontal, vertical and circular polarization. As a 'rule of thumb', the width of a waveguide is of the same order of magnitude as the wavelength of the guided wave. The cracks are potential waveguide structures. Since the cracks may act as dielectric waveguides, choosing a wavelength that is near the average maximum absorption quanta of the stone and binder, but which may also effectively carry the selected wavelength's zigzag progression deep into a large portion of the cracks without energy loss, is an effective strategy to achieve OPT.

Prior to beginning the repair of a specific section of pavement, a small-scale, easily configurable emitter can be deployed at the job site. This test assembly is pre-configured to emit a specific IR wavelength at a given watt density pursuant to the OPT Chart. Select locations within the field of repair, which are representative of the average field conditions, are then heated to determine the actual Pp/delta F/kwh. Once the effectiveness of the pre-selected IR bandwidth and watt density have been measured through the use of the small scale emitter, additional adjustments may be made to the emitter frequency by cartridge construction, voltage, power density and/or on-off power schedule to tune the system, as necessary, to achieve OPT during project scale-up.

In operation, after the aged and alligatored pavement has been cleaned of debris, the surface of the pavement is heated to attain a temperature of about 240° F. (116° C.) or 250° F. (121° C.), e.g., from about 150-350° F. (66-177° C.), or from about 175-325° F. (79-163° C.), or from about 200-300° F. (93-149° C.), or from about 225-275° F. (107-135° C.), or from about 230-250° F. (110-121° C.), or any range between. The heating is advantageously accomplished using an emitter array as described herein (e.g., as depicted in FIG. 4A); however, any alternative heating system can also be employed, as discussed herein. The peak wavelength is selected based on the pavement to be heated, e.g., by use of an OPT table or by exploratory testing conducted on representative portions of the surface using a small scale emitter. After the cleaned aged and alligatored pavement has been heated, the asphalt emulsion is applied as described herein. Electromagnetic radiation is then applied to the emulsion to attain a temperature sufficient to achieve curing, as described herein, e.g., of about 240° F. (116° C.) or 250° F. (121° C.), e.g., from about 150-350° F. (66-177° C.), or from about 175-325° F. (79-163° C.), or from about 200-300° F. (93-149° C.), or from about 225-275° F. (107-135° C.), or from about 230-250° F. (110-121° C.), or any range between.

After the steps of pavement preparation and application of the asphalt emulsion, the pavement can be considered a "wet" system that, if left to slow cure, would eventually provide some degree of quality as to the driving surface. However, the heating steps subsequently employed in systems of certain embodiments result in a dramatically superior driving surface.

The heating element applies electromagnetic radiation that penetrates deep into the pavement and/or emulsion. When applied to the emulsion, it softens and crosslinks the upper portions of new material, yielding a material that after compression into a dense structure will exhibit properties well exceeding those of conventional asphalt/concrete pavement in terms of toughness, resilience, flexibility, and/or resistance to cracks. In the lower, old pavement portions beneath the new portions the heating and rolling process compresses and pushes together the warmed old asphalt and the preparation of the nearly volatile-free emulsion or the binder emulsion, eliminating voids, to create a tougher and more durable transition region between the old pavement substrate and the new overlay. The transition region is a continuum, and at depths of from 2½ to 3 inches or more, past which the preparation of binder emulsion and/or the electromagnetic energy do not penetrate. The material is essentially old asphalt paving that has been remelted and pushed together. Because it does not contain elastomer, the properties will be similar to those of conventional asphalt; however, cracks and fissures will have been eliminated by the process and thus will not telegraph to the surface.

Accordingly, after application of the reactive emulsion (and optionally the thin layer of elastomer coated aggregate) over the aggregate filled pavement surface, a heat shuttle including a heating element is passed over the pavement surface. The heat shuttle can be of any suitable dimension, e.g., as large as or larger than 32 feet (9.6 meters) wide by 32 feet (9.6 meters) long, or smaller, e.g., 8 feet wide (2.4 meters) by 8 feet (2.4 meters) long, or 4 feet (1.2 meters) wide by 4 feet (1.2 meters) long. In a particular preferred embodiment, the shuttle is sufficiently wide so as to cover an entire width of a standard road or highway traffic lane including associated shoulder, or a full width of a typical two lane road. The heat shuttle is pulled across the top of the prepared surface. As the heat shuttle passes over the surface, a heating element delivers electromagnetic radiation of the preselected peak wavelength, e.g., energy in the near microwave (e.g., terahertz) to the mid-infrared range, that penetrates through the layer of elastomer coated aggregate, and down into the aggregate-filled new portions as well as the undisturbed old portions of the pavement being repaired. The microwave-infrared energy penetrates down to a depth of 3 or more inches (7.6 or more cm), heating the entire penetrated mass of repaired pavement to a temperature of at least about 240° F. (116° C.), but preferably not more than 275-300° F. (135° C.-149° C.), yielding a softened heated mass comprising the topmost 1, 2, or even 3 inches (2.5, 5.1, or even 7.6 cm) of the pavement surface. An advantage of the systems of certain embodiments is that the old pavement is not disrupted as part of the repair process, such that there is minimal oxidation of the old pavement upon application of heat, such that minimal smoke is generated by the process.

Heat shuttles can be employed to heat pavement. Heat shuttles can incorporate various different types of heating elements. One conventional type of emitter comprises a stainless steel tube wherein natural gas or liquid propane gas are mixed with air and ignited, generating heat (infrared energy) that is released through the stainless steel tube. Although other types of alloys can also be employed for the tube, stainless steel is generally preferred for its slow deterioration and for the bandwidth of energy that radiates from the outside of that tube typically in the medium to far infrared which exhibits good penetration into asphalt/concrete pavement systems. Other types of emitters include those incorporating a rigid ceramic element where the combustion takes place in micropores in the ceramic element. Bandwidth for such emitters is also in the medium to far infrared. Another type of emitter incorporates a flexible cloth-like ceramic medium having several layers, or layers of stainless steel cloth together with ceramic cloth. The cloth traps the combustion gases so that no flame is present on the surface of the element while generating infrared emissions. Any suitable device capable of generating infrared radiation that penetrates to a depth of 2, 3, 4 or more inches (5, 8, 10 or more cm) into the pavement surface can be employed to heat pavement.

A particularly preferred heat shuttle incorporates a ceramic structure in a form of thin sheets of cloth-like material that can operate at much higher temperatures (e.g., 2000° C.) than conventional ceramics (e.g., 1500° C.). In this structure, a higher combustion temperature can be obtained by catalyzing combustion of an air/liquefied petroleum gas (LPG) mixture or air/nitric gas mixture. The infrared energy generated is typically of shorter wavelength than the previously described systems, and can more quickly and efficiently heat the pavement than these conventional systems. The system also avoids creation of an open flame, with the resulting generation of smoke and other carbon emissions from the heated pavement. Any combustible mixture that adjusts the combustion reaction, if necessary, to generate electromagnetic radiation of the desired peak wavelength, can be employed to generate penetrating energy suitable for heating the asphalt/aggregate mixture to be treated.

In certain embodiments, it can be desired to apply longer wavelength radiation of the pavement. Combustible mixtures that slow down the combustion reaction such that longer wavelengths are produced, e.g., liquefied petroleum gas (LPG), can be employed to generate such penetrating energy.

Conventional combustion systems typically generate energy with a wavelength of from 1-5 nm. Instead, it is generally preferred that energy of longer wavelengths, e.g., of from 2-5 mm (terahertz range) be generated, e.g., to initiate crosslinking. Heating (as opposed to crosslinking) the asphalt/aggregate mixture to be treated can advantageously be accomplished, e.g., using energy with a shorter wavelength of from 1000-10000 nm.

In certain embodiments, simplified electronics and software can be employed in connection with a device that employs a simple emitter, so as to avoid high capital expenditures. The emitter is designed to produce radiation at a wavelength or range of wavelengths that will penetrate the pavement while at the same time minimizing excess heating in an upper region of the pavement, such that substantially uniform heating throughout the asphalt medium down to a depth of at least 1, 2 or 3 inches (2.5, 5, or 8 cm) is obtained. In some embodiments, substantially uniform heating includes a temperature differential throughout a preselected depth, e.g., 2 inches, of no more than 50° F. (27° C.). In other words, the temperature of any portion of the upper region is no more than 50° F. (27° C.) higher than any portion of the lowest region. However, in certain embodiments, larger temperature differentials may be acceptable, e.g., up to 100° F. (54° C.) or more, provided that damage to the cured surface is avoided.

To attain the desired temperature profile, radiation in the infrared region is applied. The radiated energy applied to the surface is selected so as to control a depth of penetration and a rate of penetration to avoid heating or activating the asphalt too quickly, which may damage the pavement. The devices of various embodiments can be manufactured to minimize cost and are suitable for use in the field. Field use can be achieved by powering the device using a portable generator, e.g., a Tier 4 diesel engine, which qualifies under current emission standards. In one embodiment, the generator is electrically connected to a series of emitter panels situated within a metal frame. The device can be insulated with a high-density ceramic, and the panels can be nested within the ceramic liner of a frame points to point downward towards the pavement. One example of an emitter panel is provided in FIG. 2.

An array of panels can be assembled together, as in an array of 2×1 panels, or any other desired configuration, e.g., 2×2, 2×3, 2×4, 2×5, 2×6, 2×7, 2×8, 2×9, 2×10, 2×11, 2×12, 2×13, 2×14, 2×15, 2×16, 2×17, 2×18, 2×19, 2×20, 2×(more than 20), 3×3, 3×4, 3×5, 3×6, 3×7, 3×8, 3×9, 3×10, 3×11, 3×12, 3×13, 3×14, 3×15, 3×16, 3×17, 3×18, 3×19, 3×20, 3×(more than 20), 4×4, 4×5, 4×6, 4×7, 4×8, 4×9, 4×10, 4×11, 4×12, 4×13, 4×14, 4×15, 4×16, 4×17, 4×18, 4×19, 4×20, 4×(more than 20), 5×5, 5×6, 5×7, 5×8, 5×9, 5×10, 5×11, 5×12, 5×13, 5×14, 5×15, 5×16, 5×17, 5×18, 5×19, 5×20, 5×(more than 20), 6×6, 6×7, 6×8, 6×9, 6×10, 6×11, 6×12, 6×13, 6×14, 6×15, 6×16, 6×17, 6×18, 6×19, 6×20, 6×(more than 20), 7×7, 7×8, 7×9, 7×10, 7×11, 7×12, 7×13, 7×14, 7×15, 7×16, 7×17, 7×18, 7×19, 7×20, 7×(more than 20), 8×8, 8×9, 8×10, 8×11, 8×12, 8×13, 8×14, 8×15, 8×16, 8×17, 8×18, 8×19, 8×20, 8×(more than 20), 9×9, 9×10, 9×11, 9×12, 9×13, 9×14, 9×15, 9×16, 9×17, 9×18, 9×19, 9×20, 9×(more than 20), 10×10, 10×11, 10×12, 10×13, 10×14, 10×15, 10×16, 10×17, 10×18, 10×19, 10×20, 10×(more than 20), 11×11, 11×12, 11×13, 11×14, 11×15, 11×16, 11×17, 11×18, 11×19, 11×20, 11×(more than 20), 12×12, 12×13, 12×14, 12×15, 12×16, 12×17, 12×18, 12×19, 12×20, 12×(more than 20), 13×13, 13×14, 13×15, 13×16, 13×17, 13×18, 13×19, 13×20, 13×(more than 20), 14×14, 14×15, 14×16, 14×17, 14×18, 14×19, 14×20, 14×(more than 20), 15×15, 15×16, 15×17, 15×18, 15×19, 15×20, 15×(more than 20), 16×16, 16×17, 16×18, 16×19, 16×20, 16×(more than 20), 17×17, 17×18, 17×19, 17×20, 17×(more than 20), 18×18, 18×19, 18×20, 18×(more than 20), 19×19, 19×20, 19×(more than 20), 20×20, 20×(more than 20), or (more than 20)×(more than 20). The panels can be of any suitable size, e.g., 1×1 inches (2.5×2.5 cm) or smaller, 3×3 inches (7.6×7.6 cm), 6×6 inches (15×15 cm), 12×12 inches (30×30 cm), 18×18 inches (46×46 cm), or 24×24 inches (61×61 cm) or larger. The panels can be one or more of square, rectangular, triangular, hexagonal, or other shape. Preferably, each panel abuts an adjacent panel so as to minimize non-emitting space; however, in certain embodiments some degree of spacing between panels may be acceptable, such that, e.g., circular emitters can be employed, or, e.g., square emitters can be spaced apart. One example of a suitable array is a 2×12 array of one foot square (961 $cm^2$) panels.

While in certain embodiments an elongated (e.g., coiled, straight, tubular, or other structures in a waveguide pattern) semiconductor (e.g., silicon carbide, non-oriented carbon fiber, doped boron nitride) or resistance conductors (e.g., iron-nickel) can be employed in the emitter, in a particularly preferred embodiment the panels include a serpentine wire as an emitter. An advantage of the serpentine configuration is that it does not have the high resistance exhibited by spaced apart coils. Accordingly, more of the energy is emitted as radiation of the desired wavelength. The coils are spaced apart to minimize the resistance, and a radiant energy is emitted within a "sandwiched" space bounded on the upper side of by the high-density ceramic that has a very low permittivity and essentially redirects the reflected energy from the serpentine wire downward.

On the lower side of the wires, which can advantageously be embedded in a support or be self-supporting, is a thin micaceous panel. The mica group of sheet silicate (phyllosilicate) minerals includes several closely related materials having close to perfect basal cleavage. All are monoclinic, with a tendency towards pseudohexagonal crystals, and are similar in chemical composition. The nearly perfect cleavage, which is the most prominent characteristic of mica, is explained by the hexagonal sheet-like arrangement of its atoms. Mica or other materials exhibiting micaceous properties can include a large number of layers that create birefringence or trirefringence (biaxial birefringence). Birefringence is the optical property of a material having a refractive index that depends on the polarization and propagation direction of light. These optically anisotropic materials are said to be birefringent. The birefringence is often quantified by the maximum difference in refractive index within the material. Birefringence is also often used as a synonym for double refraction, the decomposition of a ray of light into two rays when it passes through a birefringent material. Crystals with anisotropic crystal structures are often birefringent, as well as plastics under mechanical stress. Biaxial birefringence describes an anisotropic material that has more than one axis of anisotropy. For such a material, the refractive index tensor n, will in general have three distinct eigenvalues that can be labeled $n_\alpha$, $n_\beta$ and $n_\gamma$. Both radiant and conductive energy from the serpentine wire is transmitted to the micaceous element. The birefringent characteristics of the micaceous material can be employed to transmit a subset of wavelengths generated by the serpentine wire while filtering out other wavelengths. The emitter of certain embodiment employs a sheath of stainless steel that protects the micaceous material from being damaged. This conductive sheath transfers energy with no significant wavelength translation. By employing this combination of components (e.g., serpentine wire, micaceous material, stainless steel sheath), energy generated by the serpentine wire with a peak wavelength of about 2 micrometers can have the peak wavelength be taken to about 20 micrometers. A wavelength of 10 micrometers or less to 100 micrometers or more, e.g., about 20 micrometers, can advantageously be used in connection with asphalt applications to improve the characteristics of the asphalt. The thickness or other characteristics of the micaceous material can be adjusted to provide a targeted wavelength or range of wavelengths to the surface.

In a particularly preferred embodiment, the device has a 2-foot wide by 12-foot long intercavity dimension, configured similar to a hood, in which a ceramic insulation is mounted. The emitter elements are advantageously 1 foot by 1 foot (30 cm by 30 cm). E.g., a 2 foot (61 cm) wide device can be configured to be 2 elements wide by 12 elements long, for a total of 24 elements. Such elements can have a Watt density of roughly 14 Watts per square inch (2.2 watts per $cm^2$), at full energy, capable of being powered by, e.g., a generator that can deliver 250 kW. An example of a portable device suitable for use in repairing asphalt/concrete pavement is depicted in FIG. 4A and FIG. 4B.

In some embodiments, an emitter assembly may comprise a structural frame, a power source, a power interrupting mechanism, an electromagnetic radiation emitter, and a positioning system. The emitter assembly may be several feet wide, several feet long, and several feet high. In some embodiments, the emitter assembly is approximately 12 feet (3.7 meters) wide, 8 feet (2.4 meters) long, and approximately 2 feet (0.6 meters) high. The emitter assembly may be other sizes as well and the scope of the invention is not limited by the size of the emitter assembly. The frame may support one or more of the other components.

The frame may comprise structurally adequate members such as metal supports, beams, rails, or other such structures. The frame may be configured to prevent significant deformation when in use or in transport. The frame may be designed to support at least part of the weight of the various components. In some embodiments, the frame comprises one or more beams. The beams may comprise a metal, wood, or other material that can adequately support the weight of the components. The beams may comprise aluminum or steel, and in some embodiments it may be advantageous to use a material that is both lightweight and strong. One or more beams may be disposed on either side of the frame and on either end of the frame. The beams on the side may be connected vertically through brackets, plates, or other attachment mechanisms. The pieces may be welded together, or bolts may be utilized to connect the pieces. One or more beams may traverse the frame from one side to the other side, or from front to back, and may be configured to provide support or an attachment mechanism to other components. One or more beams that traverse the frame may be disposed near the bottom of the frame, such that one or more of the electromagnetic radiation emitters may be attachable to the beams. The frame may attach to one or more wheels, directly or indirectly, which may assist the frame in being transported.

In some embodiments the frame may be configured to prevent bending, sagging, or twisting even while traversing uneven terrain. The frame may provide a robust structure that supports one or more components of the assembly. Because the assembly may be used in a variety of environments, it may be advantageous for the frame and assembly to be resistant to deformation and deterioration when in transport and in use. For instance, the assembly may be used on roadways that are uneven. It may be advantageous for the frame to withstand transport over an uneven surface. As another example, the frame and assembly may be used in the outdoors in remote locations. It may be advantageous for the frame and assembly to not only be resistant to damage during the transport to the remote location, but also for the frame and assembly to be resistant to the effects of weather while at that location. Even during adverse conditions and extensive travel and transport, it may be advantageous for the bottom surface of the frame to remain a generally consistent distance from a road or other surface over which the assembly may be placed. Therefore, the frame may be sufficiently robust and resistant to deformation or damage in a variety of conditions.

In order to transport the assembly, the frame may comprise an attachment mechanism that may allow the assembly to be pulled. In some embodiments, the frame comprises rings or hitches that are connectable to a vehicle. The vehicle may be configured to pull the assembly over short distances over the roadway, or longer distances to transport the assembly to the work site.

A power source may be connected or connectable to at least part of the emitter assembly. The power source may comprise a generator and may comprise a diesel generator or other power source. The power source may be disposed on the emitter assembly or maybe connectable to the assembly. The power source may be part of a second assembly positionable adjacent the emitter assembly. The function of the power source may be to provide power or electricity to a power distribution device that may be located on the emitter assembly or on the frame. In some embodiments, a diesel powered electric generator may be disposed on a platform or movable trailer that may be connectable to the emitter assembly.

The power distribution device may be disposed on at least part of the emitter assembly and may sit on at least part of the frame. The power distribution device may comprise one or more circuit breakers or other power interrupting mechanisms. The power distribution device may be configured such that it receives power from the power source and distributes it to one or more electromagnetic radiation emitter panels. In some embodiments, the power distribution device comprises a metal box and circuit breakers, which may be similar to those found in commercial or residential building units. The power distribution device may be temporarily or permanently connected to the frame, and in some embodiments, may be bolted to a surface of the frame.

The frame may support one or more electromagnetic radiation emitters. The emitters may be approximately 12 inches (30 cm) by 24 inches (61 cm), and more than one emitter may be disposed on an emitter module. One or more modules may be disposed on the emitter assembly. In some embodiments, the assembly comprises six modules, with each module measuring approximately 4 feet (122 cm) by 4 feet (122 cm). In some embodiments, each module comprises multiple emitter panels. The emitters may be generally flat, and may be disposed adjacent one or more other emitters. Each emitter panel may or may not abut a second emitter panel. Each emitter panel may be directly or indirectly electrically connected to the power interrupting mechanism, and may be electrically connected in parallel or in series with other emitter panels.

The emitter modules may comprise a top plate, and the top plate may be disposed on the top and side surfaces. The modules may further comprise a ceramic layer generally disposed underneath the top plate. An emitter panel may be generally disposed beneath the ceramic layer. An electrical connection from the emitter panel to the power interrupting mechanism may travel through the ceramic layer and through the metal shell. The module may be configured to emit electromagnetic radiation in a generally downward direction, and may be configured to prevent substantial electromagnetic radiation from being emitted in an upward direction. The module may also limit the amount of electromagnetic radiation emitted to the side. It may be advantageous to at least partially limit the emissions of electromagnetic radiation in some directions in order to prevent injury to persons located nearby. Further, it may be advantageous to generally direct the electromagnetic radiation in a downward direction, so that the radiation is received by the surface below the emitter assembly. During use the emitter assembly may be positioned over a road or other surface, and the electromagnetic radiation being emitted from the emitter panels may be directed at the road or other surface.

In some embodiments, the panels and/or modules may be independently separable from the emitter assembly. It may be advantageous to be able to disconnect one or more emitter panels or modules from the rest of the assembly in order to replace or repair the panels or modules. There may be other advantages as well to being able to separate portions of the assembly. The panels or modules may attach to one or more beams of the frame using bolts or other various attachment mechanisms. In some embodiments, the panels are bolted to a beam that traverses the frame from front to back. The beams define openings, through which one may access a bolt or other attachment device. Other methods of attaching the panels to the frame or assembly may be possible and the scope of the invention is not limited by the method of attaching the panels.

The emitter assembly may comprise a positioning system which may comprise parts of the frame and wheels. The positioning system may also comprise attachments from which the emitter assembly may be connected to a supporting structure, such that the emitter assembly may at least partially suspend from the structure. In some embodiments, the emitter assembly comprises four wheels, with each wheel generally disposed at the corners of the frame. More wheels, such as six or eight or other number, may be advantageous depending on the size of the emitter assembly. Each wheel may be connected to a wheel support and each wheel support may be configured to allow the height of the wheel, relative to the frame, to be independently adjusted. Independently adjusting the height of the wheel may allow the emitter assembly to be more accurately positioned above a road or other surface. By being able to more accurately position the emitter assembly above the surface, the distance between the emitter assembly and the road or surface may be more uniform, and in some embodiments the emitter assembly may be more effective and consistent in transmitting the electromagnetic radiation from the emitter panels to the road or surface.

The positioning system, including wheels, may allow the assembly to be positioned in various locations, and may be configured to allow the emitter assembly to be transported between different locations. In some embodiments, the positioning system may allow the emitter assembly to be translated above the surface, before, during, or after use, either continuously or discreetly, depending on user preference. For instance, the assembly may be moved continuously along the surface while electromagnetic radiation is being emitted from the emitting panels. Or, the assembly may emit electromagnetic radiation at a first location, then the assembly is moved to a second location, and then additional electromagnetic radiation is emitted. The positioning system may allow the emitter assembly to be translated in a forward and back direction, in a side to side direction, or be rotated about an axis. The frame or other part of the emitter assembly, including the positioning system, may be configured to allow at least part of the frame to be connected to a vehicle such that the emitter assembly can be transported between locations. In some embodiments, the assembly may be configured to be loaded onto a transporting device, such as a trailer, that may be configured to transport the assembly from a first location to a second location.

A net frame is preferably attached to wheels on the outside of the device, to permit adjustment of the emitter within the cavity itself, or to permit adjustment of the height of the emitter over the pavement. In a preferred embodiment, the emitter is provided in a cavity approximately 6 inches (15 cm) deep, and a height of the emitter surface over the pavement surface can be varied from as low as a quarter of an inch or as high as an inch or more. The emitter is preferably placed as close to the surface of the pavement as is practical (e.g., <1 inches (<2.5 cm), or <0.5 inches (<1.3 cm), or <0.25 inches (<0.64 cm)) so as to minimize loss of energy via reflectance and/or refraction by the pavement surface. However, if the spacing is too close, imperfections in the pavement surface, or smoke or dislodged gummy residue, may cause damage to the emitter.

In various embodiments for pavement repair applications, an emitter design can be employed wherein multiple units (e.g., 1, 2, 3, 4, 5, 6, 7, 8, 9, or 10 or more) are grouped together. For example, four units, each including a 3×3 emitter array, will provide 36 square feet of emitter. Four units, each including a 4×6 emitter array, will provide 96 square feet of emitter. It is generally preferred to employ a square footage of emitter that can be supported by a desired generator. 250 kW generators are generally preferred, as providing a good balance of power and cost, but in certain embodiments larger generators can be employed, e.g., a 300 kW generator. Instead of a larger generator, two or more smaller generators can be employed to provide adequate power for a preferred array size. In a preferred embodiment, a 250 kw generator can be employed to power a 100 square foot (9.3 $m^2$) emitter array that puts out 14 watts per square inch (2.2 watts $cm^2$). Two such generators can be provided on the same tug to power 250 square feet (23 $m^2$) of emitter. In most paving applications, the width of the road to be repaired is approximately 12 feet (3.6 meters), so emitter arrays or groups of emitter arrays having a width of 12 feet (3.6 meters) and a sufficient length to provide an appropriate amount of energy to the surface are desirable.

In operation, circuits and sensors can be employed to identify obstacles underneath the emitter unit, e.g., by sensing reflected energy or heat buildup, and can adjust the power to the emitter or the distance of the emitter from the pavement surface. Other sensors can detect the presence of combusted organics, e.g., a laser that can detect a certain amount of smoke passing through its beam. If high temperature is detected, the emitter can be distanced from the pavement, power can be reduced, or the speed at which the emitter passes over the surface can be decreased. Similarly, if the temperature detected is too low, the power of the emitter can be increased, it can be distanced from the surface, or the speed at which the emitter passes over the surface can be increased.

In certain embodiment, the heat shuttle passes over the pavement, flashing off non-VOC components and bringing moisture in the pavement to the surface, warming the mass of pavement. The pavement is then allowed to cool down to a preferred temperature for compression, at which time a vibrating roller is passed over the surface. An advantage of the system is that virtually no smoke is produced while operating the system. The resulting pavement has a density similar to new pavement, but incorporates durable elastomers imparting superior performance properties.

Another advantage of the system is that the elastomer composition can be formulated to include a resealing adhesive that does not lose its internal cohesion (stickiness) over time. A road repaired using the system that begins to show signs of wear (microfissures or cracks) can be readily repaired simply by passing the heat shuttle across the surface (for, e.g., 30 seconds to 2 or 3 minutes), then passing a compaction roller over surface, which repairs and reseals the cracks. Should a crack appear in the pavement that is beginning to show signs of wear, one simply passes the heat shuttle across the surface. A quick pass of the device of 30 seconds, followed by a roller pass, can result in a robust crack repair. Preferably, such a heating/rolling treatment is employed approximately every three to five years so as to maintain the pavement in good condition for 20 years or more.

Upon exposure to a temperature of approximately 250° F. (121° C.), the elastomer of the reactive emulsion crosslinks, generating a bond (between new aggregate, between new aggregate and old pavement, or between portions of old pavement) of sufficient strength such that a conventional road vibratory roller can be applied over the top of the pavement surface to provide a new driving surface. During rolling, the vibratory compaction redensifies all the defects in the old road bed.

In some embodiments, additional elastomer can be applied prior to vibratory compaction. The elastomer is preferably applied as a spray that penetrates into the old road surface, filling cracks and crevices such that when vibratory rolling takes place it further bonds the old pavement together as well as regions between the new material and the old material.

Rubber, e.g., ground tire filler, is a material commonly employed in asphalt/concrete pavements. It is a high energy-absorbing material. If it absorbs too much energy too quickly, it will become a source of combustion and can damage the emitter unit or emit fumes into the atmosphere. Accordingly, in some embodiments it is desirable to include a feedback loop on each emitter panel (e.g., a 1 foot square (0.3 meters square) panel) in an array, so as to continuously monitor the power density at the emitter's particular setting and its effect on the pavement. Each emitter panel can be independently operated so as to provide an appropriate amount of energy to the surface beneath. Because rubberized coating is commonly employed as crack sealer on old roads, it can be desirable to have such control over each emitter panel.

To provide satisfactory pavement repair, the presence of irregularities and defects on the surface, such as cracks, fissures, low areas, and the like, must be addressed. It is typically preferred to sweep off any thick cross-sections of dirt, to remove vegetation and to remove any reflectors that are on the road. The presence of road paint, e.g., paint used for lane markers, generally does not present any issues as to operation of the emitter, provided it is thin and does not contain substances that may prevent uniform heating. The paint employed in crosswalks may contain substances that prevent uniform heating. In such situations, the crosswalk markings can be removed, the emitter can be operated so as not to move over the markings, or the emitter is shut off when it goes over crosswalk markings (e.g., manually shut off, or automatically shut off when markings are detected). Crosswalks that comprise a thick thermal plastic strip placed on the pavement can inhibit management of the delivery of energy into the deep pavement, and are desirably removed and reinstalled prior to pavement renovation, or such areas are avoided during renovation.

Irregularities and defects on the surface of the pavement can vary. The systems of various embodiments are particularly suited to the repair of alligatored pavement. However, in some instances, it may be suitable for repairing other damage. For example, the aged asphalt the surface can have a boney, or rough look and texture, where large rocks have essentially become islands rising above the lower sections of the pavement due to fine rock being dislodged. In some instances, fissures or potholes that are in each up to two inches or more deep may be present. Severe irregularities and defects can be advantageously repaired using a combination of stone and a formulated elastomer that glues the stone together once it's cured. The elastomer is applied to the surface and then cured using the emitter device. In certain embodiments, the coating can be as thin as one gallon (3.8 liters) or less per hundred square feet (9.2 $m^2$) of stone and elastomer spread over the surface, e.g., a coating as thin as a few thousandths of an inch. In certain embodiments, a mixture of elastomer and aggregate can be blended to form a cold slurry or other mixture that is spread over the surface to replace volume on a damaged or deteriorated road and then cured using the emitter device. In such embodiments, an initial application of heat prior to the emitter can be applied, e.g., open flame or other heating unit as described elsewhere herein, that causes an initial flashing of volatile materials from the cold slurry or other mixture. This initiates some degree of curing, to prevent adhesion of the slurry or other mixture to the tires of the tow rig pulling the emitter. Alternatively, the tires, the driving unit and the emitter device, are configured so as to straddle the strip of pavement that is being repaired.

In the case of large and very long runs on highways, use of the system can minimize closure time, even under conditions wherein material is placed and compacted, due to the rapid curing observed. In such embodiments, an uncured surface of various stone sizes and elastomer recipes can be spread across the surface and then the emitter device is pulled over it, simultaneously drying out and heating the adhesive on the surface while also, at a different wavelength, pushing energy deep into the pavement so that, based upon the prescription for the repair, simultaneous curing of the material on the top is achieved, along with and warming and stirring to a homogenized state the interstitial asphalt of the pavement from the surface down to a depth of 1, 2, or 3 inches (2.5, 5.1, or 7.6 cm) or more.

Following behind the emitter unit, a compactor can be employed once the pavement cools. Typical temperatures after emitter treatment are about 250° F. (121° C.). Once heat dissipates such that the temperature is 180-190° F. (82-88° C.), a compacting roller can be applied. A single or 2-drum roller with vibrating capabilities can be run across the surface to compact the voids that are in the old pavement, basically reducing it to a density that is similar to that of virgin pavement, and further compacting the new material down into voids and irregular surfaces of the pavement where the binder emulsion, elastomer or other repair material had been placed. Multiple passes of a roller can be applied, e.g., two, three, four, or more passes. Three or four passes will provide the density and the uniform fusion between the particles that results in a long-lasting pavement cross-section.

An elastomer (also referred to herein as binder, emulsion, or the like) of certain embodiments, e.g., a SPARC binder, typically comprises four components, and is a very robust emulsion that can contain asphalts of various softening points. The elastomer can also include butyl rubber, a styrene-butadiene-styrene (SBS) polymer, and a bioresin. The type of bioresins, the concentration of the SBS polymer, and the molecular weight of the butyl rubber employed, along with other components of the mixture, can be balanced to achieve a desired set of properties of the adhesive system in its cured form. The elastomer may, in certain embodiments, be employed as a mask to protect the underlying pavement as it goes through this heating cycle from oxidation at the surface, because the temperature is higher at the surface than it is deep down when the emitter system is applied to the pavement. In order to have a sufficient amount of energy penetrating to depth so as to fluidize the asphalt, and to minimize hot spots, the elastomer can act as a mask to avoid oxidation of the asphalt where hot spots are present.

Depending upon the nature of the materials present in the elastomer, a wavelength separating effect can occur in the elastomer as in the micaceous material, such that certain wavelengths are preferentially transmitted. The elastomer does not have to be a pure organic material; it can have materials like silicon dioxide or other materials that have a desired permittivity to a particular wavelength, or birefringent or trirefringent properties. In some embodiments, these components are present in a volume as high as 50% in the elastomer composition; however, in certain embodiments lower amounts can be desirably employed, e.g., from 1-10% by volume, or from 10-50% by volume.

The relative permittivity of a material under given conditions reflects the extent to which it concentrates electrostatic lines of flux. In technical terms, relative permittivity is the ratio of the amount of electrical energy stored in a material by an applied voltage relative to that stored in a vacuum. For example, the power source can be the emitter, the transmitting device can be the medium through which the emitter's energy is passing, and the load is what actually happens when the molecular structure of the various substances adsorbs the energy. The movement of energy from the emitter device through the pavement medium can be described in terms of the relative permittivity of the pavement. For methodologies for creating a wavelength of energy, typically resistance wires are used for heating, e.g., wires comprising iron, aluminum, titanium, platinum, etc., and a variety of other materials that create design resistance. The resistance of the flow of electric current creates radiant energy that falls in the bandwidth from a millimeter long down a few micrometers—the infrared (IR) microwave boundary. Materials are heated depending upon the absorbent qualities of polar materials, like water, that they contain. There are certain bandwidths in the IR region that are highly condensed or captured within the structure of, e.g., water, and quick energy absorption is observed (e.g., a quick rise in terms of temperature as a result of that absorbed energy). The IR microwave boundary can be considered that region between far infrared and what can be considered extremely short microwaves (e.g., 1 millimeter). In various embodiments, it is desirable for the emitter to provide a substantial amount of energy in this region, e.g., 1, 5, 10, 15, or 20 nm up to 1, 2 or more millimeters, preferably from about 1000 nm to about 10000 nm, depending upon the asphalt/aggregate to be heated, or from 2 microns to 1 millimeter. Many materials are substantially transparent to microwaves having a bandwidth that is down in the megahertz and kilohertz range, which are very long bandwidths compared to IR heating. These microwaves penetrate materials readily that do not have a high hydroelectric constant or a high relative permittivity. The microwave transmissivity of common materials such as are used in the paving industry or other industries are well known or readily ascertained by one of skill in the art. The refraction and reflection that takes place between the emitter surface and the surface of the emulsion when it is placed on the top of the pavement can likewise be ascertained, so as to achieve a desired temperature profile in the pavement.

In an asphalt/concrete pavement surface contacted with energy having a peak wavelength of from about 1000 nm to about 10000 nm, or up to 20 micrometers or more against the surface, the presence or absence of the emulsion on the surface can have a profound affect in terms of how much energy is refracted, reflected and, transmitted below the surface to the interstices of the asphalt at, e.g., three inches in depth. Refraction is the change in direction of a wave due to a change in its medium. It is essentially a surface phenomenon. Refraction is mainly in governance of the law of conservation of energy. Momentum due to the change of medium results in the phase of the wave being changed, but its frequency remains constant. As energy moves from the emitter to the surface of the pavement, the rate of movement remains the same, and the wavelength remains the same; however, the incident wave is partially refracted and partially reflected when it hits the surface. Snell's Law, also referred to as the Law of Refraction, is a formula that is used to describe the relationship between the angles of incidence and refraction. Refraction that takes place at interface, e.g., a boundary between air and a solid, can exhibit a phenomenon referred to as an evanescent wave, wherein the wavelengths on one side of the boundary are partially reflected and partially refracted. At the boundary, reflected energy or wavelengths can come back from the substance, creating a chaotic collision of electromagnetic energy that is generally one-third of the wavelength. For either a narrow energy source such as a laser or a broad infrared radiant energy source coming to the surface of a solid, one is able to measure this perturbance and predict with a degree of accuracy how much energy is returned and how much is transmitted, which impacts the amount of energy transmitted into the pavement. An advantage of the emulsion on the pavement surface is that it disrupts the organized formation of a wave bouncing back out of the pavement, such that more energy can be transmitted into the pavement. Knowing the wavelength that is presented to the pavement, the evanescence wave that is created, and the permittivity of the material enables one to predict and control the heating characteristics of the pavement. The relative permittivity is an absolute number for stone, for water, for the atmosphere of the voids in the pavement, for the asphalt that is in the interstices. When considered together, one can analyze what the effect of a particular wavelength on its rate of movement through the pavement, e.g., through the use of conventional probes for determining energy levels and bandwidth changes. This permits the emitter and the materials employed in the emulsion to be selected such that the peak wavelength can be manipulated to maximize energy absorption by the pavement or aggregate or asphalt emulsion/asphalt emulsion while minimizing consumption of energy in generating the electromagnetic radiation. For example, the wavelength can be manipulated to about a millimeter, which is in the terawatt range. In this range, the depth of penetration for the amount of energy that is used from the generator is profoundly improved, such that energy consumption is reduced.

For an emitter temperature that is at 750° F. (399° C.), and for an immediate surface temperature, e.g., ⅓ of the wavelength below the emulsion layer that is 55° F. (13° C.), within a few seconds, because it is time-dependent, a temperature at just below the surface, e.g., a millimeter below the surface, is 75° F. (24° C.). Moving down progressively in increments of ½ inch to one inch, the emitter temperature versus the surface temperature versus the temperature at various depths can be analyzed. This power depth loss of the energy as it enters the pavement from the irradiated surface can be compensated for by manipulating the surface energy, the Watt density, the wavelength, the effects of evanescence wave paths, and the wavelength of energy passing through the pavement so as to increase the uniformity of heating from the surface to a desired depth (e.g., 3 inches). As top temperature threshold, it is desirable to avoid the formation of organic gases, which indicates that the material has gone past the threshold of maintaining its original molecular structure. If gas formation is not apparent, as indicated by the absence of smoke, the power can be increased; however, that is not the only factor that should be considered. The other factor is a desire to minimize the amount of power that it takes to get the energy as deep as it needs to be (e.g., as can be determined by characterizing how deep the voids are that are part of the flaws in the pavement so that it can be determined how long the unit has to stay over a certain spot with a particular configuration to reach that depth). One must also achieve a temperature such that when a roller is applied to the heated pavement, it is fluidized and will compress to eliminate voids, whereby increased densification and homogenization of the repaired pavement is achieved.

In terms of relative permittivity, that of water, for instance, is 80 times higher than that of rock, which is 7. Asphalt's relative permittivity is similar to that of water—60-70 times higher than that of rock. Rock can be considered substantially microwave transparent. This means 95% of the pavement cross-section is essentially transparent to millimeter wavelengths. Referring back to Snell's Law, the more oblique the angle of the radiation coming to the surface from its boundary zone (critical angle incidence), the higher the refraction and the higher the reflection. The angle of incidence of the radiation can therefore be manipulated to adjust the amount of energy transmitted. The far IR—near microwave wavelength is going to interface a solid surface at a much more direct angle, such that for a microwave transparent material like stone, some IR energy that is quickly absorbed by the aggregate in the interstices can be desirable for heating (see, e.g., TABLE 2).

In various embodiments, it is desired to move energy from the emitter surface to 1, 2, or 3 inches (2.5, 5.1, or 7.6 cm) deep in the pavement, in the shortest amount of time without destroying or otherwise significantly damaging the materials in the upper region. The emitter system can enable this to be achieved. In contrast, heating with gas-fired, open-flamed propane that generates primarily IR radiation, e.g., with an uncontrolled peak wavelength, results in excess surface heating—smoke coming off the pavement, indicating destruction of organic pavement constituents such as rubber or asphalt. The components' molecular weights can be negatively impacted, causing the damaged portions to lose water resistance, adhesiveness, and other desirable properties. The emitter system also results in reduced fuel costs, compared to conventional combustion systems, which are impractical to tune for peak wavelength by adjusting, e.g., air/fuel mixtures, and are extremely inefficient in terms of power consumption per unit of energy transmitted to the pavement.

The composite structure of the pavement is 95% aggregate that exhibits microwave transparency, whereas 75-78% of the remaining 5% is in the form of polar molecules that are affected dramatically by contact with far IR—near microwave radiation. In use, the emitter is turned on and drawn across the pavement. The entire continuum of the wavelengths and how energy is moving through the pavement is in a state of flux, meaning that some water molecules will be lost from the system. This changes the potential for an evanescence wave, as the polar structures that are in the emulsion are removed by evaporation, thus affecting the transmission of energy. In addition, energy is stored within the rock and the interstices of the asphalt, which also changes the way that the energy moves through the substrate. It is therefore desirable to have a system configured to monitor such conditions, and that can also utilize feedback on how different Watt densities, different emitters, and changes in the components that are employed in the emulsion can maximize the use of the energy while minimizing potential damage to the pavement during homogenization of the interstices down to 1, 2, or 3 inches (2.5, 5.1, or 7.6 cm) in depth and while minimizing energy consumption.

By analyzing data from experiments with different paving materials and different emulsion compositions, emitters can be constructed that work well with conventional asphalt concrete pavements, and that consume less than 20% of the power of heaters in conventional use for heating pavement, or even less energy (e.g., 5%). Such conventional methods include burning liquid propane gas using a ceramic blanket, or the more sophisticated open flame or catalyzed gas systems.

In one embodiment, the emulsion includes a birefringent or trirefringent material, and is provided in the form of a pre-manufactured film. The film is rolled over the surface of the pavement, e.g., from a spool, and then the emitter system is run over the top, yielding a sealed surface. It is desirable to avoid driving too much energy into isolated spots in the pavement where the energy is absorbed quickly, e.g., due to the higher permittivity of asphalt, water or other organic material such as rubberized asphalt. This can negatively impact the molecular structure of the elastomer. The elastomer begins to melt and flow over the surface of the asphalt, such that blowing off of water or other volatiles is avoided. This results in a zero (defined by EPA as less than 1%) volatile organic carbon (VOC) repair process.

The emitter systems typically generate about 0.1% VOC, which is highly desirable from an environmental standpoint and superior to many conventional processes which generate smoke and release large amounts of VOC.

Rock or very fine aggregate can be coated with elastomer and the elastomer can be pre-cured. The rock, which serves as a carrier of the elastomer, can then be placed due to its dry, free-flowing nature. By pre-firing the elastomer on a stone, e.g., in a plant, one can minimize the amount of energy one has to use in the field. Such a mixture would offer advantages over cold-mix asphalt in terms of ease of handling in the field. The material is pre-dried, taken to a jobsite, spread out, and then heated using the emitter system to yield a quality asphalt concrete pavement surface.

Oligopolymerization

In some embodiments, the radiation emitted by the emitter can optionally be modulated to emit at least some radiation in the far IR—near microwave region, in addition to the 1000-10000 nm peak wavelength radiation employed in heating the pavement or aggregate (e.g., recycled asphalt/concrete pavement) or asphalt emulsion. This focuses heat on the asphalt between aggregate instead of the aggregate itself, essentially preheating the asphalt. This efficiently warms and disturbs the polar molecules of asphalt in the voids and interstices in the pavement without dehydrogenation of the asphalt. The approximately 100 μm ductile asphalt coating on the rock surface becomes turbulent and is thus mixed with the more brittle and short chain molecules occupying a volume beyond 100 μm from the stone surface. The process can also be employed to polymerize oligomers (approximately 2-150 repeating units) and other broken polymer chains in the aged asphalt, causing them to link into longer chains whereby ductility is improved. This process can be referred to as oligopolymerization, and can be utilized in a process of homogenization by liquid asphalt oligopolymerization. Core tests indicate that pavement thus treated is as much as 95% equivalent (or even more in certain circumstances) to the virgin asphalt binder originally found in the pavement in terms of: compressive strength, flexural compressive strength, and shear strength, compared to mere heating without oligopolymerization. Infrared radiation transitions to the microwave frequency at a wavelength of about 1 millimeter. When the wavelength gets shorter than 1 millimeter, the radiation is considered far infrared. Terahertz radiation, also called submillimeter radiation, terahertz waves, or THz, is electromagnetic radiation with frequencies between the high-frequency edge of the millimeter wave band, 300 gigahertz ($3\times10^{11}$ Hz), and the low frequency edge of the far-infrared light band, 3000 GHz ($3\times10^{12}$ Hz). Corresponding wavelengths of radiation in this band range from 1 mm to 0.1 mm (or 100 μm). Because terahertz radiation begins at a wavelength of one millimeter and proceeds into shorter wavelengths, it is sometimes known as the submillimeter band, and its radiation as submillimeter waves, especially in astronomy. Terahertz radiation occupies a middle ground between microwaves and infrared light waves. For inducing oligopolymerization it is preferred to employ radiation wavelengths of from 10,000 nm, 15,000, 50,000, 100,000 nm, or 500,000 nm to 1,000 μm or more, e.g., from 15,000 nm to 1.1 mm, 1.2 mm, 1.3 mm, 1.4 mm, 1.5 mm, 1.6 mm, 1.7 mm, 1.8 mm, 1.9 mm, 2 mm, 2.5 mm, 3 mm, 3.5 mm, 4 mm, 4.5 mm, or 5 mm or more.

Comparison of Systems of the Embodiments to Conventional Hot in Place Recycle (HIR)

The systems of the embodiments are noninvasive methods of restoring the pavement to the highest possible physical properties—properties superior to those of conventionally repaired pavement, such that the asphalt exhibits characteristics similar to, or better than, virgin asphalt ("rejuvenated asphalt").

Hot In-Place Recycle (HIR) is the conventional method for repairing aged and alligatored asphalt/concrete pavement. HIR is described in detail in Chapter 9 of "Pavement Recycling Guidelines for State and Local Governments Participant's Reference Book", Publication No. FHWA-SA-98-042 published December 1997 by the U.S. Department of Transportation Federal Highway Administration, the entire contents of which is hereby incorporated by reference herein. Virtually all pavement heating employed in this re-construction/maintenance method utilizes an LPG or NO energy source. In LPG or NO energy source heating processes, the gas is mixed with air and ignited within an outer shroud. The mixing and ignition can be deployed as an open flame or controlled within a tube or ceramic blanket emitter. Whether open flame or within a controlled chamber, the surface temperature is generally above 1500° F. (815° C.) and emits an electromagnetic bandwidth which is less than 2000 nm (2.0 microns). Where the combustion is retarded by a catalyst, the emitter temperature(s) can drop to as low as 600° F. (315° C.) and exhibit a bandwidth as long as 100 microns. While the use of a catalyzed flame with a longer wavelength would be beneficial to more effectively warming aged asphalt, fumes from the process will quickly contaminate the chemistry of the catalyst; rendering it ineffective.

While gas fired technology (GFT) and the diesel-generator-driven electric heat from emitter expend nearly equivalent BTUs in fuel consumption per unit of wattage output, the tangible, emitter frequency control of the emitter system maximizes energy absorption by the heated surface; thereby resulting in up to a five-fold reduction in BTUs consumed, as compared to gas fired emitters, to achieve the same mass unit/temperature rise.

Low-to-no smoke is associated with the emitter operation during the pavement heating cycle, since the temperature of the pavement surface can be carefully regulated to not exceed a 'blue smoke' temperature. In contrast, the GFT must overheat the surface temperature (often >300° F. (149° C.)—well in excess of a 'blue smoke' threshold) to drive energy sufficiently deep (1.5 inches-2.0 inches (3.8 cm-5.1 cm)) to achieve at least a 200° F. (93° C.), sub-surface softening temperature; thereby facilitating the HIR scarifying and/or planing of the upper pavement surface. Turning the GST on and off as a method of regulating temperature overrun for the pavement surface is one commercial method of minimizing the occurrence of 'blue smoke' emissions, but the continual ramping back up from the 'off' mode substantially increases fuel consumption costs and $CO_2$ generation from the heating unit.

This air emission advantage relating to generation of 'blue smoke', coupled with the extra fuel used to warm the pavement with indiscreet, reduced radiant energy absorption, results in at least an eight fold increase in $CO_2$ emissions by GFT, as compared to the emitter technology of the embodiments.

Burns to operators are less likely with the emitter technology of the embodiments than with the gas fired technology. Explosions are non-existent with emitter technology of the embodiments, but are always a significant threat when operating with flammable gas as in a GFT process. State-of-art, electrical equipment employed in the emitter system prevents workers exposure to electrical shock.

GHT/HIR processes and/or other short wavelength IR electrical devices inevitably overheat and accelerate the oxidation of surface asphalt during the process of repairing the old road surface by disturbing it, mixing it with new material and covering it. The emitter technology of the embodiments results in 'gentle', regulated heating that prevents such accelerated oxidation from occurring. A more thorough surface preparation eliminates the adulterating effect of dirt and organic debris, thereby substantially reducing the need for any scarifying of the old road surface as the vibratory compaction of the new overlay material adequately 'mixes' these two substrates in a uniform, high performance, fused monolith.

A newly applied lift of composite material comprising AROS™ or other ground tire rubber, bio-resin enriched, high carbon pitch and stone, installed as a cold process slurry or cold mix asphalt, can be fully fused to the thermally activated existing road surface without the damaging effects of excessive temperatures to the binder chemistry. Materials added to the GFT are inevitably exposed to higher, often difficult to regulate temperatures which prematurely oxidize the chemistry. Therefore the final surface and underlying road surface restoration can be expected to last significantly longer.

The methods described herein for treating recycled asphalt/concrete pavement can be integrated into hot in place recycle methods, such that recycled asphalt/concrete pavement recovered from the road is irradiated after removal from the road, then replaced back onto the road bed from which is removed.

Characteristics of Treated Pavement in the Field

Fatigue life and stress life are properties of asphalt/concrete pavements. Stress is a unit of force per area. Strain is deformation caused by stress. Fatigue life is the number of stress cycles of specified character before a specimen or system sustains failure of a specified nature. Stress life curve plots the interrelationship between a system's specific stress quanta and range, and the strain product thereupon imparted; resulting in a predicted time to system failure. Accordingly, these measurements are of interest in determining useful life or service life of pavement.

The Federal Highway Administration (FHWA) has established that good highway design practices shall utilize aggregate that conforms to gradation bands and at percentages prescribed by the "0.45 Power Curve", and that four specific categories of tests shall be performed on those gradations. Those tests evaluate the stone for: 1) toughness and abrasion resistance, 2) durability and soundness, 3) angularity and 4) presence of minerals not otherwise considered aggregate singularities aka "sand equivalencies". Aggregate nomenclature divides rock which will not pass through a #8 sieve as coarse and that which will pass as "fines". By mass, for dense graded, hot mix pavement the 0.45 Power Curve shows that about 50% of the aggregate are fines and 50% are coarse aggregate. Coarse aggregate typically has made it through the crushing process because it is much tougher than the fines. It is much tougher because it doesn't have many micro-fissures or tiny cracks which lead to fracturing under the high pressures associated with rock pit crushing operations.

The requirement that aggregate be tested for durability and soundness is targeting the detection of micro-fissures in the aggregate as a weak point in road durability. Water which works its way into such fissures during the service life of the road will chemically weaken the stone or freeze and break it open. Typically the coarse stone is not subjected to the test. The test for durability and soundness consists of soaking the aggregate 'fines' in a dilute solution of either sodium sulfate or magnesium sulfate. The sulfate salt, upon entering the micro-fissure, expands, producing a similar effect to ice, thereby enlarging the micro-fissure. After rinsing the soaked stone in fresh water a percentage of the stone is flushed. If too much stone is lost in this process then the stone is disqualified for use. The presence of micro-fissures in the pavement mixture is a principal contributing factor to moisture sensitivity and premature fatigue degradation of the road. The homogenization process, to a great extent, corrects the presence of this weak link.

Asphalt is composed of two phases. The continuous phase comprises maltenes and the suspended phase comprises asphaltenes. Maltenes are usually low in carbon by mass and linear in molecular arrangement with molecular weights of less than 500. Maltenes have large areas of free molecular space in proportion to their hydrocarbon chain volume. Asphaltenes are much higher in carbon content and most generally are of a molecular weight ranging between 5,000 and 45,000. Asphaltenes are tightly wound with low free molecular space relative to their molecular volume.

It has been discovered that asphaltenes have a propensity to behave like a capacitor, surface storing electrons. Particularly during the high temperature, short IR wavelength excursion that the asphalt is subjected to in the preparation of hot mix asphalt in the 350° F. (177° C.) to 400° F. (204° C.) region. This electron storage creates repelling polarity between similar, highly charged asphaltene particles. This polarity induces a partial, artificial phase segregation of these high molecular weight particles. As the partial, artificial phase segregated asphalt is coated on the aggregate at the hot mix asphalt plant, this segregated condition becomes fixed within the shoreline of the rough stone surface. This imbalance within the two phases of the asphalt created in the conventional hot mix plant becomes a permanent obstacle to optimal compaction and long term durability of the thermoplastic binder. Phase segregation is an obstacle to compaction. A homogeneous asphalt behaves like a lubricant allowing the stone matrix to slide into maximum compaction whereas a stratified asphalt behaves like a contaminated (e.g., grit filled) lubricant and resists the slipping action needed to allow the rigid surfaces to easily glide to full embedment. Years of testing have verified that as little as a one percent air void density reduction in dense graded asphalt concrete can improve rutting resistance by over 100%.

Phase segregation is also an obstacle to long term resistance to oxidation as atmospheric moisture and electromagnetic energy perpetually work to strip and replace the most weakly bound hydrogen atoms from the hydrocarbon chains of the maltene structure. As hydrogen atoms are stripped both the ductility and cohesive strength of the asphalt is diminished; leading to embrittlement. A uniform dispersion of the very robust asphaltenes acts to attenuate this stripping action as it will, by its capacitive nature, attract and store much of the energy bias delivered from the combined effect of rolling loads, sun loads and water. The technology of various embodiments can be employed to re-homogenize this hot-mix-plant-induced phase segregation to a high level of uniformity. This restored phase uniformity halts accelerated fatigue degradation due to excessive, void-induced structural integrity and electro-chemical dehydrogenation.

Asphalt is typically strengthened by melting rubber and other thermoplastic polymer modifiers into the bitumen at the hot mix plant prior to coating the aggregate. This polymer modification is usually accompanied by some form of crosslinking within the polymer modifier to more fully develop, upon cooling, an interconnected, crystalline grid within which the amorphous bitumen may be stabilized.

The binder coating on the stone in a hot mix plant setting is in the 3-5 mil range. Typically, once the coated stone is placed and compacted, the crosslink exists only within the coating on each singularity. Little to no post placement crosslinking between the individual coated particles takes place. The inter-crosslinking performs its task of stabilizing the bitumen but since the potential for intra-crosslinking between the coated surface of the compacted aggregate is disrupted by: 1) the loss of mobility as the binder cools while 2) being simultaneously sheared into new, relative positions, the probability that any stabilizing crystallinity can be formed is low. This condition leaves the interstitial load transference between coated moieties at a diminished optimal quanta. Emitter heating and dielectric stirring provides an environment to at least partially correct this condition with a resultant improved resistance to fatigue degradation.

Asphalt concrete fails as its flexibility gives way to embrittlement. Embrittlement results when hydrocarbon chains in the continuous maltene phase are de-hydrogenated through oxidative cleavage. It is the combination of atmospheric moisture in the form of rain, fog, and snow multiplied by the presence of surges of electro-magnetic energy accompanying solar and mechanical loads that drives this destruction. Embrittlement fatigue in the upper one-half inch of pavement occurs more rapidly; often at two to ten times the fatigue rate below that surface depth. Not only are the oxidative forces more concentrated by the tearing action of tires, snow removal equipment and surface debris but direct solar load in the form of sunlight and wind places stress upon the surface which result in rapidly developing cracks leading to the formation of potholes, long fissures and block cracking, also referred to as "alligatoring".

The emitter wavelength can be adjusted to effectively and rapidly penetrate this upper crust region, disrupting the effects of these surface stressors and thereby extending the accepted stress life curve for surface deterioration. Cross-sections of pavement below this upper half-inch crust undergo a slower but often more persistent oxidative process. Moisture, which might quickly evaporate at the surface thus terminating its oxidative threat, becomes trapped in lower pavement voids for long periods. This encapsulation allows it to slowly but persistently attack the interstitial binder flexibility. However, of greater fatigue consequence by moisture is the attack at the binder-stone interface where direct contact between water and the plethora of reactive hydroxyl sites resident in all aggregate results in a rapid binder delamination.

Often "near new" pavement (pavement still in its first three years from installation), will have a superior driving surface but began to spall and break apart at between 1 to 3 inches (2.5 to 7.6 cm) deep. This is caused by the delaminating effect of trapped moisture finding its way to the binder-stone interface and reacting with the hydroxyl groups on the aggregate surface. The emitter's adjustable, deep pavement penetrating wavelength can, non-invasively, interrupt this accelerated fatigue degradation process; significantly extending the useful life of the pavement.

Thermal pumping is a term which describes the in-situ movement of fluidized, hot asphalt (as it expands under an outside heat source) from the confines of micro-fissures within the fine aggregate in pavement. This cavity dwelling binder was first absorbed during the hot mix plant blending but is coaxed out into the interstitial air voids of the pavement matrix. This asphalt, as well as the asphalt coating the first 100 microns thickness from the stone surface, have been shown to be unchanged from the original installed chemistry. Warming and stirring, plus re-introducing, these virgin reservoirs of ductile, highly cohesive binder, through the use of selective bandwidths of energy which optimize a dipolar response, significantly improves the flexibility of asphalt concrete.

Phase segregated binder throughout the aged asphalt concrete matrix is bathed with an emitter supplied bandwidth of energy which is between 1,000× to 100,000× longer than the near IR emitted bandwidth of the open flame heating used in conventional hot mix plants. This long wavelength, 'gentle' heating causes a dielectric relaxation of the asphaltenes allowing them to re-integrate into a uniform homogeneity. Once this homogeneity is restored the binder becomes: 1) more oxidation resistant and 2) a much superior lubricant to the slippage of rock under a re-compacting effort.

Vibratory compaction of a properly emitter treated road cross-section can reliably reduce air void densities from a typical 7% to an improved 4.5-5% range. Between 1 and 3 inches (2.5 and 7.6 cm), the core temperatures accompanying these homogenization changes is in the 240-300° F. (116-149° C.) range. Without this lubricating effect, heavy vibratory compaction attempts have proven to only break rock and damage the pavement. Re-heating aged pavement to similar pavement core temperatures with short wavelength, IR heaters do not result in this significant beneficial response. Air void density reduction not only improves the pavements resistance to mechanical rutting but it also tightens the voids into which moisture can migrate. The fluidization at the rock surface improves a re-wetting of the binder upon the rock surface as a result of the dual action from the increase of interstitial pressure upon compaction and the dipole reaction of the electromagnetic field.

Hot mix asphalt (HMA) pavement preparation is a HEAT+MIX+INSTALL dynamic. The methods of certain embodiments follow a MIX+INSTALL+HEAT dynamic. This difference has a dramatic, positive effect on fatigue life extension in addition to the improvements above referenced through the use of the technology of various embodiments on the underlying, aged asphalt. Use of adhesive systems multiplies system effectiveness in delaying fatigue degradation of new, virgin material and/or a mixture of old milled pavement augmented by mixing with new, virgin material.

Adhesive can be provided in a waterborne emulsion form. Numerous versions of the chemistry are commercially available from Coe Polymer, Inc., of San Jose, Calif. Compounding the liquid onto virgin aggregate is preferably achieved by belt or augur feeding a metered flow of graded stone into a conventional dual shaft, counter rotating pug mill, whereupon the liquid adhesive is sprayed at a pre-determined rate. As the damp, coated stone exits the pug mill it may be fed directly: 1) into a conventional paving machine and thereby placed upon the receiving surface of the road, 2) into a short term storage bin for transfer to a job site, 3) onto a stockpile for storage or air drying or 4) through a drying device which eliminates the moisture. The binder chemistry may be adjusted to accommodate a successful processing under any of these four methods of stone coating; however, method 4) is generally preferred.

Superior asphalt adhesive performance can be achieved with a binder chemistry that: 1) fully wets the irregularities of the stone surface, 2) covalently bonds to all naturally occurring, surface —OH groups, 3) upon water evaporation inter-crosslinks to absolute insolubility, 4) remains a heat flowable thermoplastic but only becomes plastic at temperatures higher than 200° F. (93° C.), 5) can be applied to stone then subjected to dehydration but thereafter retain sufficient functionality for future intra-crosslinking when tightly packed together with other similarly processed stone, 6) after placement through a paving device, to achieve a double crosslink by thermal or chemical activation and 7) remains flexible to 0° F. (−18° C.) while still retaining thermoplastic behavior within the temperature performance range specified. To achieve these seven characteristics, a two coat process has been devised. Adhesive Part 1, at approximately 60% solids content, is applied onto the virgin stone surface at a wet film thickness of about two mils as it passes through a pug mill; then immediately flash dried and cross-linked onto the inorganic surface of the aggregate. In a continuous operation the now dried, thin coated moiety receives adhesive Part 2, also approximately 60% solids, in a similar application and drying manner; whereupon it is then transferred to storage. Part 1 adhesive maintains reactive functionality, which immediately self-crosslinks upon contact with Part 2 adhesive. Part 1 adhesive achieves performance characteristics 1), 2), 3), and 4). Part 2 adhesive continues to achieve performance characteristic 4), but is the principal provider of performance characteristics 5), 6), 7), and 8).

After implementation of the above process, the coated stone may be stored in bulk stockpiles indefinitely without self-adhering at ambient temperature. Thereafter it may be shipped by any conventional means to be placed and compacted onto the receiving surface. Once partially compacted, the emitter device is rolled over the surface whereupon the emitter wavelength is tuned to activate the functionality of the reactive groups within Part 2 adhesive, thereby completing a double crosslink. The pavement cross-section, when activated by the emitter during the second crosslink typically achieves a temperature in the range of 325° F. to 350° F. (163° C. to 177° C.). As it cools to about 275° F. (135° C.) it is compacted to final density.

The deployment of the technology, beyond the prescriptive preparation of the coated stone, is manifold. For example, old pavement, after removal of surface debris and dirt embedded in open cracks, may be homogenized, thereby warming the pavement to a temperature of up to 300° F. (149° C.) at a depth of up to 3". Once the pavement is warmed and the binder therein has been stirred, a sprayable binder and stone slurry or other mixture may be injected or calendered into surface cracks of the pavement. While still warm above 250° F. (121° C.), the pavement may be vibratory compacted to a uniform, defect free, weather resistant surface. A rough, buckled or rutted pavement profile may require surface milling to achieve a desired ride quality. Once the emitter has rolled over the surface and achieved a minimum pavement temperature of 250° F. (121° C.) in the region to be milled the removal may commence without damage to the stone within the milled pavement matrix. Upon the removal of this milled material it may be then immediately re-mixed at the job site with a previously prepared binder coated stone and placed back onto the pavement surface through a paving machine for compaction and final crosslinking. This will save a lot of money by reducing the demand for imported material. Conventional cold milling damages stone but after grading out the recycled asphalt/concrete pavement (RAP) it may be mix with a binder coated stone and reinstalled as outlined herein.

Whenever the utilization of old road grindings is preferred, after grading to the appropriate sieve spectrum, any combination of site coating of these grindings and blending with binder coated aggregate may be initiated with improved results over conventional methods; but the final installed pavement mat must be heat activated with the emitter prior to compacting to assure that the adhesive is fully developed.

A pre-manufactured 0.125 inches-0.5 inches (0.32 cm-1.3 cm) thick road plating composition of graded stone and binder may be manufactured in long rolls or sheets at an offsite location. The sheets can be assembled into an elastomer binding of approximately 1 mm thickness then transferred to the point of application as, for example, 6 foot (1.8 m) wide sections which are paved upon a pre-prepared dilapidated road surface. Thereafter, the emitter rolls over the newly installed wearing surface and irradiate both the old road base and the new sheet such that a vibratory compaction can then fuse the structure together. A binder primer or levelling course can first be installed, in certain embodiments, to provide an improved surface.

Hamburg Wheel Test

The Hamburg wheel test can be used as a screening tool for hot mix asphalt. The Hamburg Wheel Tracking Test originated in Germany in the mid-1970s. The test examines the susceptibility of the HMA to rutting and moisture damage. The Hamburg Wheel Tracking Test uses a steel wheel with weight that rolls over the sample in a heated water bath. A designated number of passes are performed on the sample, e.g., 20,000 passes or more. The rut depth is measured by the machine periodically, usually every 20, 50, 100 or 200 passes. 20,000 passes typically take around 8-10 hours. Several analytics are examined with the Hamburg Wheel Tracking Test including post-compaction consolidation, creep slope, stripping inflection point, and stripping slope. The Federal Highway Administration has published a report providing details of the test (see Publication Number: FHWA-RD-02-042 dated October 2000) and an evaluation of the Hamburg test for Caltrans was published by UC Davis (see Qing Lu and John T. Harvey, Research Report: UCPRC-RR-2005-15 dated November 2005). In practical terms, the test can be employed on any particular asphalt/concrete pavement, particularly a pavement to which a fresh wearing surface has been applied, to determine what, if any damage has occurred below the visible surface of the pavement. The Hamburg test can be employed to predict whether the resurfaced pavement will maintain a long service life or whether it will rapidly degrade. Pavements prepared from the treated recycled asphalt/concrete pavements of the embodiments exhibit performance similar to that of conventional pavements prepared from virgin asphalt and virgin aggregate.

Exemplary Methods

Figure 8:
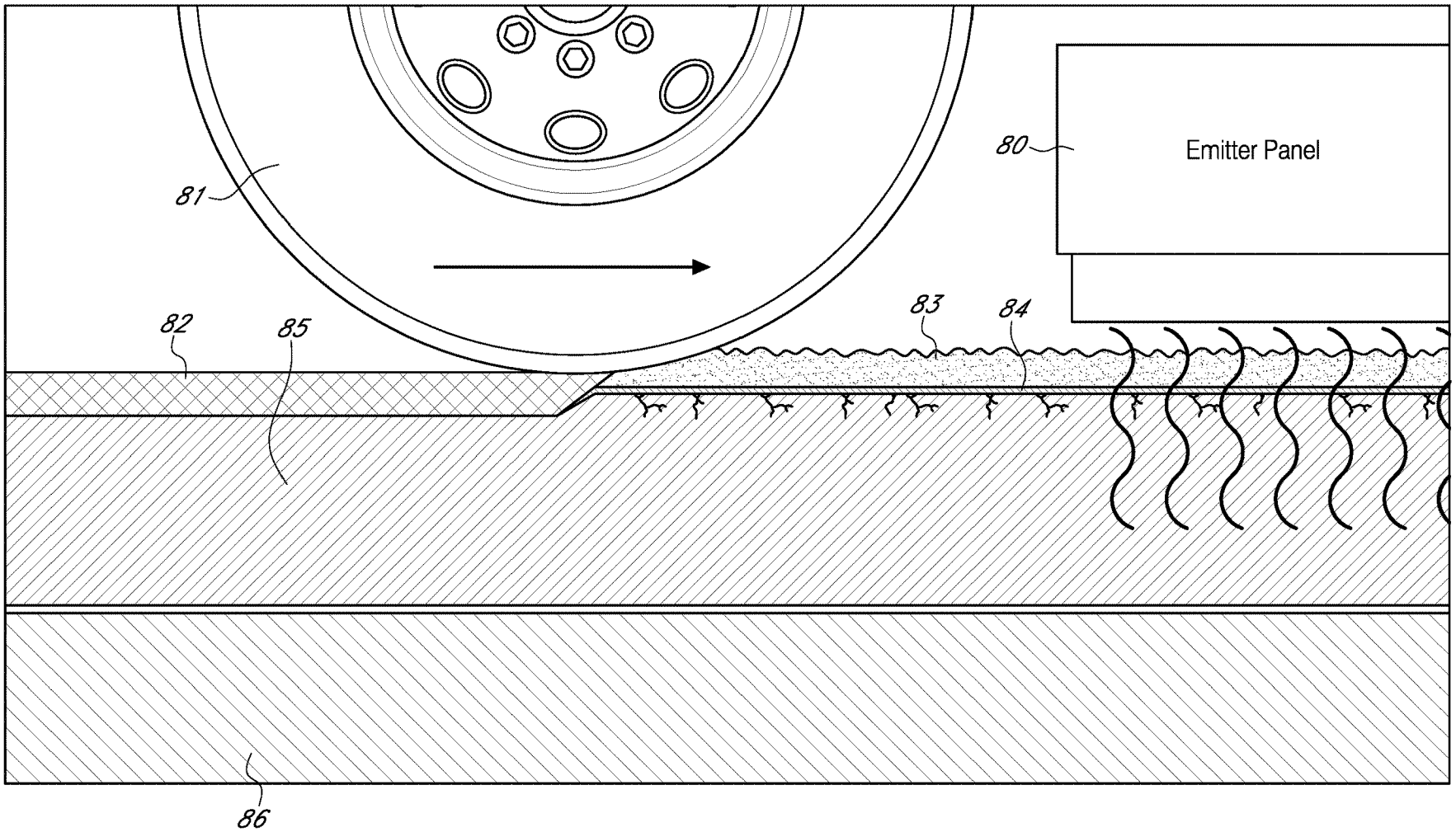
FIG. 8 is a diagram showing a process of providing an aged pavement 85 over a subgrade 86 with a wearing course 82 comprising a cold laid—thermally interfused chip seal.

A process of providing an aged pavement 85 over a subgrade 86 with a wearing course 82 comprising a cold laid—thermally interfused chip seal is depicted in FIG. 8. The wearing course 82 is a thermally interfused and compacted chip seal bonded wearing course prepared from binder coated chip (0.25 in (6.4 mm)-0.5 in (12.7 mm) chip diameter) 83 and a rubber modified binder 84. The chip seal can include treated recycled asphalt/concrete pavement as aggregate. The wearing course can be heated to a 2 in (51 mm) depth to a temperature of 275° F. (135° C.) by the emitter panel 80, then compacted with a vibratory compactor 81 (arrow indicating direction of travel). The emitter panel can be a HALO emitter as described herein. The rubber modified binder can be a SPARC rubber modified binder as disclosed herein. The cold laid, thermally interfused chip seal is smooth, safe, sustainable, can be installed with minimum traffic congestion, is longer lasting and less costly than most conventional chip seals, exhibits a surface finish characteristic of newly installed pavement, exhibits substantially zero chip loss, and provides hot rubber chip performance with a 15 year life cycle.

Figure 9:
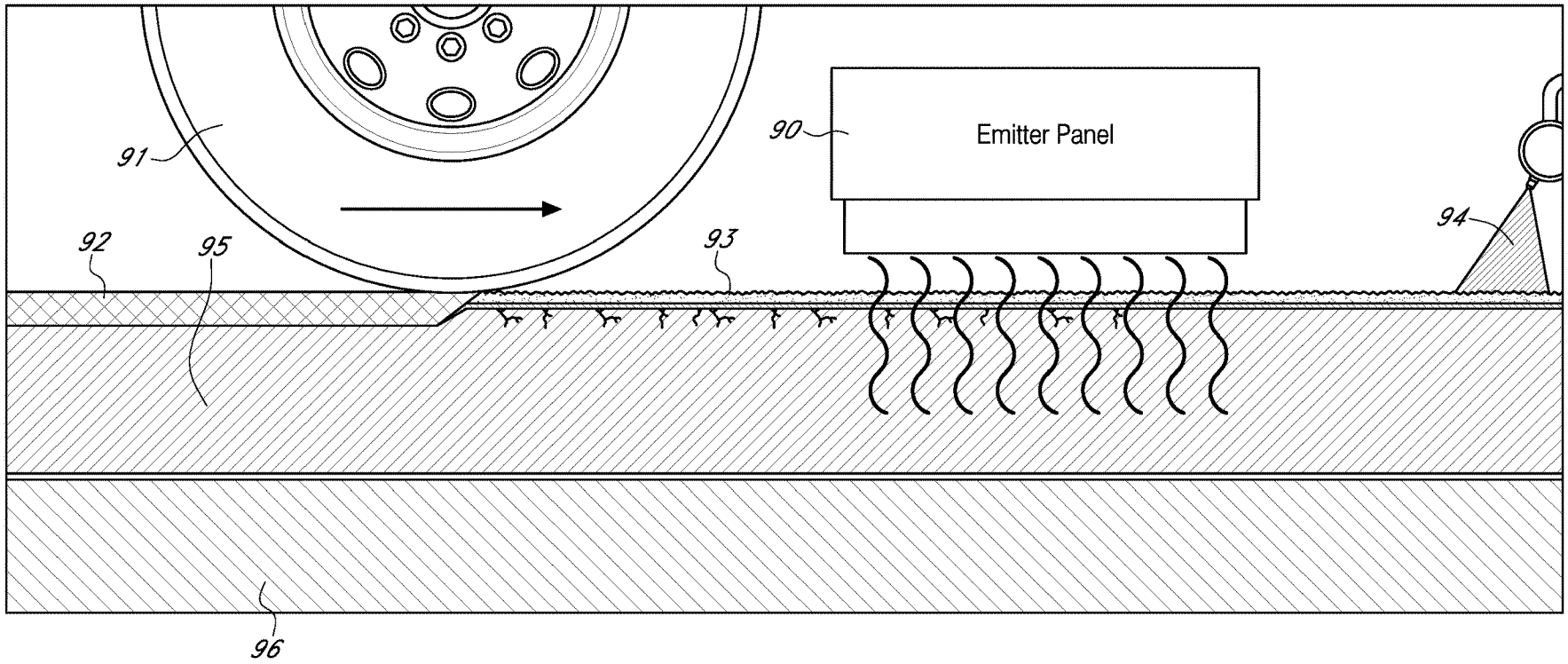
FIG. 9 is a diagram showing a process of providing an aged pavement 95 over a subgrade 96 with a wearing course comprising a cold laid—thermally interfused Type-I$^{(F)}$ microsurface 92.

A process of providing an aged pavement 95 over a subgrade 96 with a wearing course comprising a cold laid—thermally interfused Type-I(F) microsurface 92 is depicted in FIG. 9. The microsurface is a thermally interfused and compacted Type-I fine slurry bonded wearing course 92 prepared from a sprayable asphalt rubber binder (ARB) modified Type-I Fine Slurry 94 applied to aged pavement 95 at a thickness of approx. 0.125 in (3.2 mm). The microsurface can include treated recycled asphalt/concrete pavement as aggregate and a sprayable acrylonitrile butadiene styrene (ABS) modified Type-I fine slurry. The wearing course can be heated to a 2 in (51 mm) depth to a temperature of 275° F. (135° C.) by the emitter panel 90, then compacted with a vibratory compactor 91 (arrow indicating direction of travel). The emitter panel can be a HALO emitter as described herein. The cold laid—thermally interfused Type-I(F) microsurface 92 is smooth, safe, sustainable, can be installed with minimum traffic congestion, is longer lasting and less costly than most conventional slurry coatings, provides a tight interwoven aggregate structure, and exhibits an asphalt rubber binder (ARB) performance twice as good as conventional slurry coatings.

Figure 10:
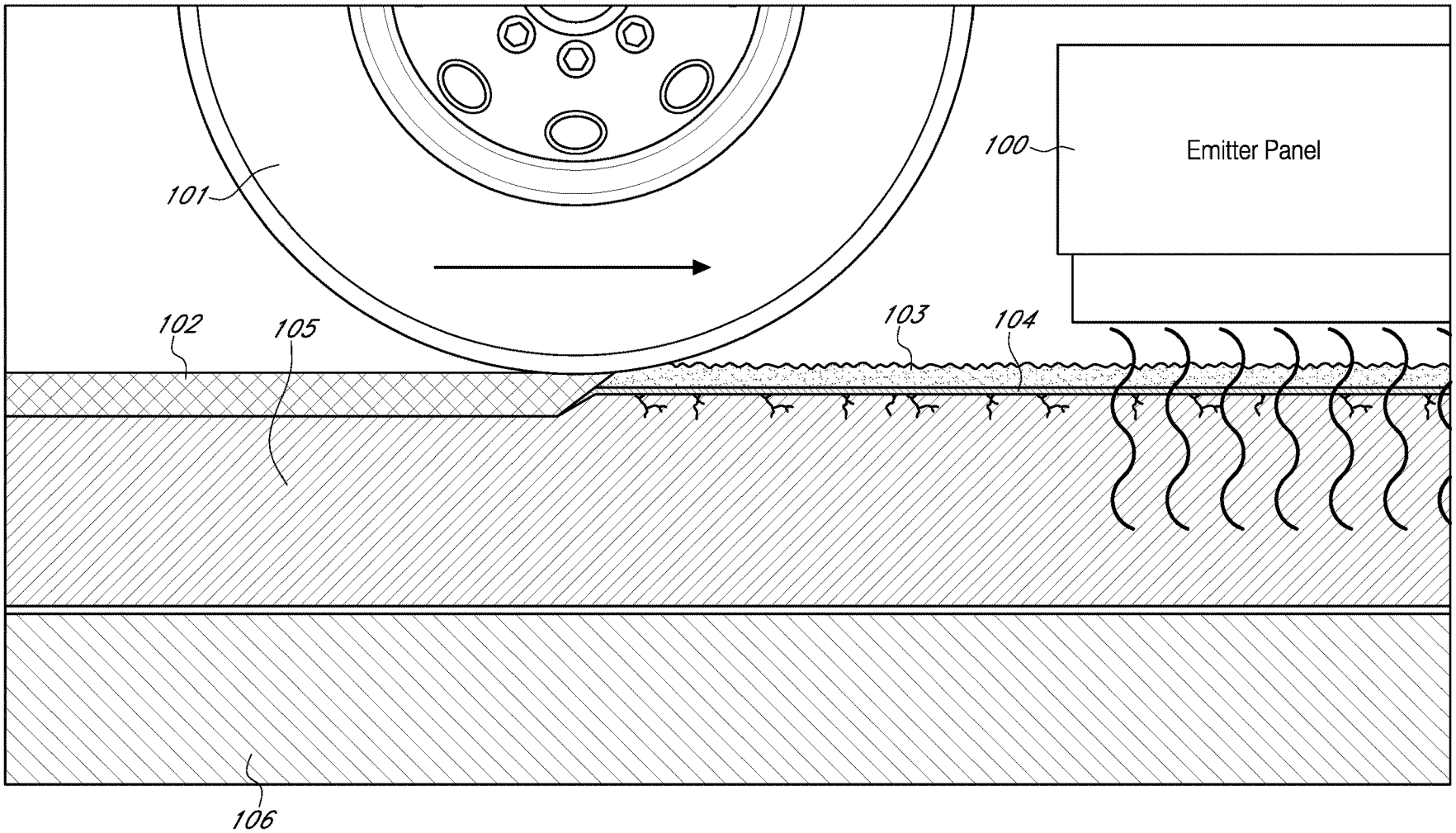
FIG. 10 is a diagram showing a process of providing an aged pavement 105 over a subgrade 106 with a wearing course comprising a cold laid—thermally interfused Type II microsurface 102.

A process of providing an aged pavement 105 over a subgrade 106 with a wearing course comprising a cold laid—thermally interfused Type II microsurface 102 is depicted in FIG. 10. The microsurface is a thermally interfused and compacted Type-II slurry bonded wearing course 102 prepared from an ISSA Type II aggregate slurry (approx. 0.25 in (6.4 mm) thick, 16 lb/yd (9.5 kg/m3) 103 and an asphalt rubber modified binder 104 applied to aged pavement 105. The microsurface can include treated recycled asphalt/concrete pavement as aggregate and an acrylonitrile butadiene styrene (ABS) modified binder. The wearing course can be heated to a 2 in (51 mm) depth to a temperature of 275° F. (135° C.) by the emitter panel 100, then compacted with a vibratory compactor 101 (arrow indicating direction of travel). The emitter panel can be a HALO emitter as described herein. The cold laid—thermally interfused Type II microsurface 102 is smooth, safe, sustainable, can be installed with minimum traffic congestion, is longer lasting and less costly than most conventional slurry coatings, provides a compacted new pavement surface, exhibits substantially zero aggregate loss, and exhibits an asphalt rubber binder (ARB) performance twice as good as conventional slurry coatings.

Figure 11A:
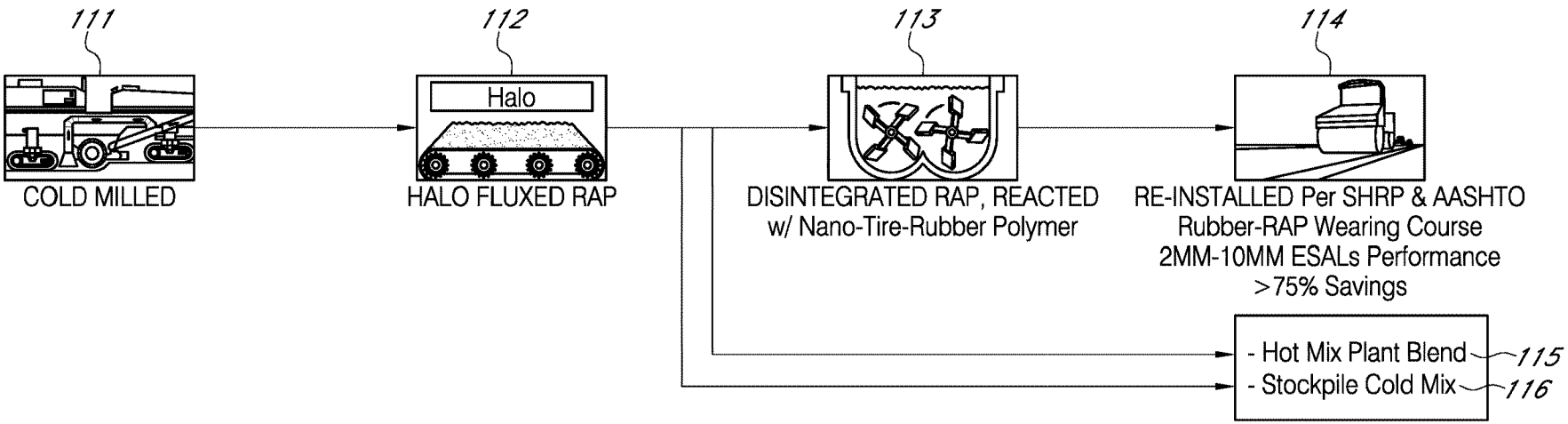
FIG. 11A is a diagram showing a process of recovering recycled asphalt/concrete pavement (RAP) using irradiation.

A process of recovering recycled asphalt/concrete pavement (RAP) using irradiation is depicted in FIG. 11A. An existing pavement is subjected to cold milling 111 to obtain RAP. Recycled aggregate with liquid asphalt concrete (AC) can have the same value as the virgin material they replace, when the RAP is processed into the same sizes and shapes as the original virgin material. The RAP can be subjected to irradiation 112 (e.g., by a HALO emitter panel as described herein) to yield disintegrated RAP. The disintegrated RAP can be subjected to a hot mix plant blend process 115, a stockpile cold mix process 116, or reaction with a nano-tire-rubber polymer 113 (e.g., by pugmilling) followed by reinstallation 114 per SHRP and AASHTO standards as a rubber-RAP wearing course (2 million to 10 million equivalent single axle loads (ESALs) performance at >75% cost savings over conventional methods). The rubber polymer can be, e.g., Nano-Tire-Rubber Polymer, e.g., Nano-Tire-Rubber Grafted Styrene-Butadiene-Styrene (SBS).

Figure 11B:
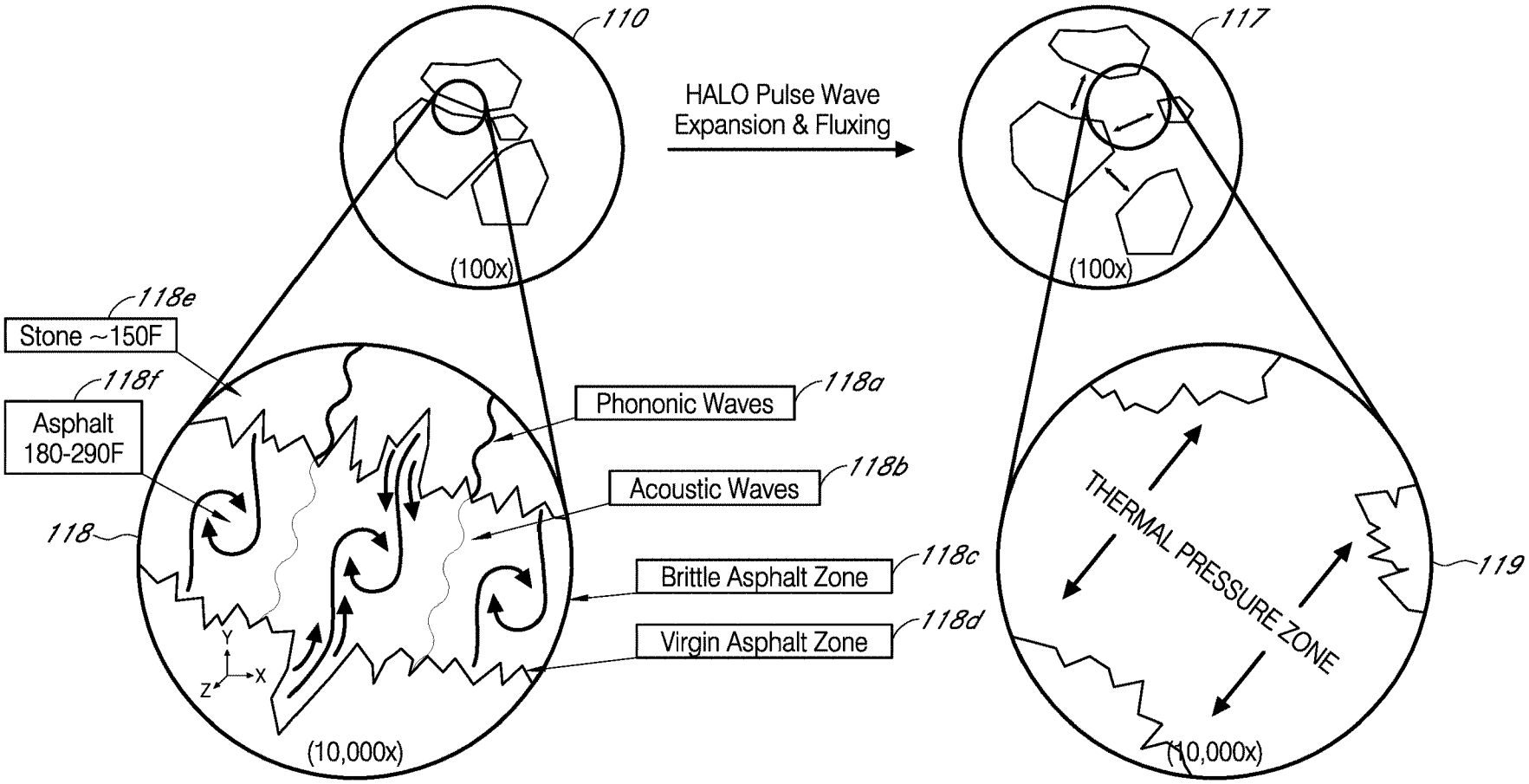
FIG. 11B is diagram illustrating the process of irradiation 112 of RAP 110, including pulse wave expansion 117 (not to scale) and fluxing 118 (not to scale).

A process of irradiation 112 of RAP 110, including pulse wave expansion 117 (not to scale) and fluxing 118 (not to scale) is depicted in FIG. 11B. Fluxing 118 occurs with the stone at approx. 150° F. (66° C.) and the asphalt at approx. 180-290° F. (82-143° C.). Phononic waves 118*a* pass through the stone 118*e* and into the asphalt 118*f* of the RAP as acoustic waves 118*b*. Dipole action fluxes (mixes) original virgin asphalt in a virgin asphalt zone 118*d* and brittle asphalt in a brittle asphalt zone 118*c* (heating the binder ahead of the stone). Thermal pressure gradients in a thermal pressure zone 119 force delamination by expansion to >98% of individual stone moieties (particles).

A unit 120 utilized in preparing a one pass, cold milled 100% RAP bonded driving surface from cold milled RAP 124 obtained using a cold milling machine 123 is depicted in FIG. 12. The unit includes Quadra, Pulse-Wave Electronics (not depicted) utilized in a mobile Wave~Bond tunnel 121 (e.g., a 1,000 kW unit producing 130 tons/hr of treated recycled asphalt/concrete pavement). In this processing tunnel configuration, emitter panels are situated in a parallel configuration over and under a flow of recycled asphalt/concrete pavement rubble. The process yields fully disintegrated RAP 122 at 300° F. (149° C.), which can be fed into a pugmill with a rubber adhesive, then into a paver. The unit 120 has a weight of 45000 lb (20000 kg), is powered by two 500 kW Tier 4F generators for a total of 1000 kW, and is carbon filter positive for air quality. The unit processes nano-tire rubber grafted SBS, and utilizes a SHRP-AASHTO design mix to provide a dense grade hot mix asphalt (HMA) with an air void density of <6%, Hamburg wheel test parameters of <3 mm, 140° F. (60° C.), and 25000 cy.

Exemplary Systems, Methods, and Compositions

Emitter System 1: An emitter system for treating recycled asphalt/concrete pavement, comprising: a first emitter configured to emit a peak wavelength of radiation of from 1,000 to 10,000 nm; a second emitter configured to emit a peak wavelength of radiation of from 1,000 to 10,000 nm; and a passage between the emitters configured to allow passage of recycled asphalt/concrete pavement there between, such that, in use, the recycled asphalt/concrete pavement absorbs the radiation emitted by the emitters.

Emitter System 2: Emitter System 1, wherein the first emitter is at least partially coaxial with the second emitter.

Emitter System 3: Emitter System 2, further comprising a helicoid rotor having a hollow tubular axis, wherein the helicoid rotor is configured to convey the recycled asphalt/concrete pavement between the emitters.

Emitter System 4: Emitter System 3, wherein the first emitter is mounted on an outer shell, wherein the second emitter is mounted on a shaft, wherein the outer shell at least partially surrounds the helicoid rotor, and wherein the hollow tubular axis of the helicoid rotor surrounds the shaft supporting the second emitter.

Emitter System 5: Emitter System 4, further comprising a drive hub assembly configured to rotate the helicoid rotor.

Emitter System 6: Emitter System 5, wherein the drive hub assembly is configured to operate the helicoid rotor at a variable speed, so as to achieve, upon exit from the tunnel, a temperature of 250° F. to 290° F. (121° C. to 143° C.) in the recycled asphalt/concrete pavement by absorption of the radiation emitted by the emitters.

Emitter System 7: Emitter System 6, wherein the outer shell comprises ports configured to meter a binder onto the recycled asphalt/concrete pavement.

Emitter System 8: Emitter System 3, wherein the helicoid rotor comprises at least two flights operating at different rotations per minute.

Emitter System 9: Emitter System 4, wherein the outer shell is U-shaped.

Emitter System 10: Emitter System 1, wherein the peak wavelength of the first emitter is different from the peak wavelength of the second emitter.

Emitter System 11: Emitter System 1, wherein the first emitter and the second emitter are each supported by a structural frame that positions the emitters at an angle to each other in a range of 60 degrees to 120 degrees, the system further comprising a conveyor belt configured to convey the recycled asphalt/concrete pavement between the emitters at a speed sufficient to achieve, upon exit from the tunnel, a temperature of 250° F. to 290° F. (121° C. to 143° C.) in the recycled asphalt/concrete pavement by absorption of the radiation emitted by the emitters.

Emitter System 12: Emitter System 11, wherein the system is sized so as to irradiate a windrow of recycled pavement atop the conveyor belt, the windrow having a height of 8 to 14 inches (20 to 36 cm) at the peak and a width of 20 to 40 inches (51 to 102 cm) at the base.

Emitter System 13: Emitter System 1, wherein the first emitter and the second emitter are in a parallel configuration, the system further comprising: a roller and a compression shoe at a loading point, wherein the roller and compression shoe are configured to compress recycled asphalt/concrete pavement into a flat sheet so as to reduce air void content prior to passing between the at least two emitters; and a conveyor belt configured to pass between the emitters while conveying the flat sheet of compressed recycled asphalt/concrete pavement at a speed sufficient to achieve a temperature of 250° F. to 290° F. (121° C. to 143° C.) in the recycled asphalt/concrete pavement by absorption of the radiation emitted by the emitters by the recycled asphalt/concrete pavement.

Method 14: A method for treating recycled asphalt/concrete pavement, comprising: providing the system of any one of Emitter Systems 1-13; and irradiating a recycled asphalt/concrete pavement with radiation from the first emitter and second emitter so as to heat the recycled asphalt/concrete pavement to a temperature of 250° F. to 290° F. (121° C. to 143° C.).

Method 15: Method 14, further comprising mixing the irradiated recycled asphalt/concrete pavement with a binder, whereby a hot mix asphalt is obtained.

Method 16: Method 14, further comprising mixing the irradiated recycled asphalt/concrete pavement with an asphalt emulsion, whereby a hot mix asphalt is obtained.

Method 17: Method 15 or Method 16, further comprising applying the hot mix asphalt onto a road base or onto an existing road surface, and subjecting the applied hot mix asphalt to compaction.

Method 18: Method 14-17, wherein the recycled asphalt/concrete pavement is recovered in a hot in place recycle process, and wherein the mixture containing irradiated recycled asphalt/concrete pavement is placed back onto an old road surface from which it has been removed.

Composition 19: A recycled asphalt pavement prepared according to any one of Methods 14-18.

Any of the features of the exemplary embodiments of Emitter System 1-13, Method 14-18, or Composition 19 is applicable to all aspects and embodiments identified herein. Moreover, any of the features of the exemplary embodiments of Emitter System 1-13, Method 14-18, or Composition 19 is independently combinable, partly or wholly with other aspects and embodiments described herein in any way, e.g., one, two, or three or more exemplary embodiments or aspects or features thereof may be combinable in whole or in part. Further, any of the features of the exemplary embodiments of Emitter System 1-13, Method 14-18, or Composition 19 may be made optional to other exemplary embodiments or aspects thereof. Any aspect or embodiment of a method can be performed by a system or apparatus of another aspect or embodiment, and any aspect or embodiment of a system or apparatus can be configured to perform a method of another aspect or embodiment.

While the disclosure has been illustrated and described in detail in the drawings and foregoing description, such illustration and description are to be considered illustrative or exemplary and not restrictive. The disclosure is not limited to the disclosed embodiments. Variations to the disclosed embodiments can be understood and effected by those skilled in the art in practicing the claimed disclosure, from a study of the drawings, the disclosure and the appended claims.

All references cited herein are incorporated herein by reference in their entirety. To the extent publications and patents or patent applications incorporated by reference contradict the disclosure contained in the specification, the specification is intended to supersede and/or take precedence over any such contradictory material.

Unless otherwise defined, all terms (including technical and scientific terms) are to be given their ordinary and customary meaning to a person of ordinary skill in the art, and are not to be limited to a special or customized meaning unless expressly so defined herein. It should be noted that the use of particular terminology when describing certain features or aspects of the disclosure should not be taken to imply that the terminology is being re-defined herein to be restricted to include any specific characteristics of the features or aspects of the disclosure with which that terminology is associated. Terms and phrases used in this application, and variations thereof, especially in the appended claims, unless otherwise expressly stated, should be construed as open ended as opposed to limiting. As examples of the foregoing, the term 'including' should be read to mean 'including, without limitation,' 'including but not limited to,' or the like; the term 'comprising' as used herein is synonymous with 'including,' 'containing,' or 'characterized by,' and is inclusive or open-ended and does not exclude additional, unrecited elements or method steps; the term 'having' should be interpreted as 'having at least;' the term 'includes' should be interpreted as 'includes but is not limited to;' the term 'example' is used to provide exemplary instances of the item in discussion, not an exhaustive or limiting list thereof; adjectives such as 'known', 'normal', 'standard', and terms of similar meaning should not be construed as limiting the item described to a given time period or to an item available as of a given time, but instead should be read to encompass known, normal, or standard technologies that may be available or known now or at any time in the future; and use of terms like 'preferably,' 'preferred,' 'desired,' or 'desirable,' and words of similar meaning should not be understood as implying that certain features are critical, essential, or even important to the structure or function of the invention, but instead as merely intended to highlight alternative or additional features that may or may not be utilized in a particular embodiment of the invention. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise.

Where a range of values is provided, it is understood that the upper and lower limit, and each intervening value between the upper and lower limit of the range is encompassed within the embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity. The indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

All numbers expressing quantities of ingredients, reaction conditions, and so forth used in the specification are to be understood as being modified in all instances by the term 'about.' Accordingly, unless indicated to the contrary, the numerical parameters set forth herein are approximations that may vary depending upon the desired properties sought to be obtained. At the very least, and not as an attempt to limit the application of the doctrine of equivalents to the scope of any claims in any application claiming priority to the present application, each numerical parameter should be construed in light of the number of significant digits and ordinary rounding approaches.

Furthermore, although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

What is claimed is:

1. An emitter system for treating recycled asphalt/concrete pavement, comprising:

a first emitter configured to emit a peak wavelength of radiation;

a second emitter configured to emit a peak wavelength of radiation; and a helicoid rotor having a hollow tubular axis, wherein the helicoid rotor is configured to convey recycled asphalt/concrete pavement between the emitters, such that, in use, the recycled asphalt/concrete pavement absorbs the radiation emitted by the emitters.

2. The system of claim 1, wherein the peak wavelength of the first emitter is from 10 nm to 20,000 nm, and wherein the peak wavelength of the second emitter is from 10 nm to 20,000 nm.

3. The system of claim 1, wherein the peak wavelength of the first emitter is from 10,000 nm to 12,000 nm, and wherein the peak wavelength of the second emitter is from 3,000 nm to 5,000 nm.

4. The system of claim 1, wherein the first emitter is at least partially coaxial with the second emitter.

5. The system of claim 4, wherein the first emitter is mounted on an outer shell, wherein the second emitter is mounted on a shaft, wherein the outer shell at least partially surrounds the helicoid rotor, and wherein the hollow tubular axis of the helicoid rotor surrounds the shaft supporting the second emitter.

6. The system of claim 5, wherein the helicoid rotor comprises at least two flights operating at different rotations per minute.

7. The system of claim 5, wherein the outer shell is U-shaped.

8. The system of claim 5, wherein the peak wavelength of the first emitter is different from the peak wavelength of the second emitter.

9. The system of claim 5, further comprising a drive hub assembly configured to rotate the helicoid rotor.

10. The system of claim 9, wherein the drive hub assembly is configured to operate the helicoid rotor at a variable speed, so as to achieve, upon exit from the tunnel, a temperature of 250° F. to 290° F. (121° C. to 143° C.) in the recycled asphalt/concrete pavement by absorption of the radiation emitted by the emitters.

11. The system of claim 10, wherein the outer shell comprises ports configured to meter a binder onto the recycled asphalt/concrete pavement.

12. A method for treating recycled asphalt/concrete pavement, comprising:

providing the system of claim 1; and irradiating a recycled asphalt/concrete pavement with radiation from the first emitter and second emitter so as to heat the recycled asphalt/concrete pavement to a temperature of 250° F. to 290° F. (121° C. to 143° C.).

13. The method of claim 12, further comprising mixing the irradiated recycled asphalt/concrete pavement with a binder, whereby a hot mix asphalt is obtained.

14. The method of claim 12, further comprising mixing the irradiated recycled asphalt/concrete pavement with an asphalt emulsion, whereby a hot mix asphalt is obtained.

15. The method of claim 14, further comprising applying the hot mix asphalt onto a road base or onto an existing road surface, and subjecting the applied hot mix asphalt to compaction.

16. The method of claim 13, wherein the recycled asphalt/concrete pavement is recovered in a hot in place recycle process, and wherein the mixture containing irradiated recycled asphalt/concrete pavement is placed back onto an old road surface from which it has been removed.

17. A recycled asphalt pavement prepared according to the method of claim 12.

* * * * *